US009594322B2

(12) United States Patent
Amemori et al.

(10) Patent No.: US 9,594,322 B2
(45) Date of Patent: Mar. 14, 2017

(54) TONER FOR IMAGE FORMATION, AND DEVELOPER AND IMAGE FORMING APPARATUS USING THE TONER

(71) Applicants: Suzuka Amemori, Shizuoka (JP); Tsuyoshi Sugimoto, Shizuoka (JP); Akinori Saito, Shizuoka (JP); Toyoshi Sawada, Kanagawa (JP); Keiji Makabe, Shizuoka (JP)

(72) Inventors: Suzuka Amemori, Shizuoka (JP); Tsuyoshi Sugimoto, Shizuoka (JP); Akinori Saito, Shizuoka (JP); Toyoshi Sawada, Kanagawa (JP); Keiji Makabe, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 70 days.

(21) Appl. No.: 14/471,024

(22) Filed: Aug. 28, 2014

(65) Prior Publication Data

US 2015/0072287 A1 Mar. 12, 2015

(30) Foreign Application Priority Data

Sep. 11, 2013 (JP) ..... 2013-188068

(51) Int. Cl.
*G03G 9/087* (2006.01)
*G03G 9/08* (2006.01)

(52) U.S. Cl.
CPC ..... *G03G 9/08755* (2013.01); *G03G 9/0821* (2013.01); *G03G 9/08788* (2013.01); *G03G 9/08793* (2013.01); *G03G 9/08797* (2013.01)

(58) Field of Classification Search
CPC ..... G03G 9/08755
See application file for complete search history.

(56) References Cited

U.S. PATENT DOCUMENTS

2012/0052434 A1* 3/2012 Sugimoto ..... G03G 9/0806 430/108.8
2012/0282000 A1 11/2012 Nakayama et al.
(Continued)

FOREIGN PATENT DOCUMENTS

JP 62-070859 4/1987
JP 62-070860 4/1987
(Continued)

OTHER PUBLICATIONS

Diamond, "Handbook of Imaging Materials," Marcel Dekker, NY, NY. 1991.*
(Continued)

*Primary Examiner* — Peter Vajda
(74) *Attorney, Agent, or Firm* — Oblon, McClelland, Maier & Neustadt, L.L.P.

(57) ABSTRACT

A toner is provided. The toner includes a crosslinked polyester resin, and a block copolymer. The crosslinked polyester resin includes a diol component, which includes an aliphatic diol component having 3 to 10 carbon atoms in an amount of 50% by mole, and a crosslinked component, which is at least one of a crosslinked component of an aliphatic alcohol having three or more valences and a crosslinked component of an aliphatic acid having three or more valences, and the block copolymer includes a crystalline segment (a) and a non-crystalline segment (b). The toner has a first glass transition temperature (Tg1st) of from 20° C. to 50° C., which is determined by subjecting the toner to differential scanning calorimetry (DSC) and measuring a glass transition temperature in a first temperature rising process in the differential scanning calorimetry (DSC).

13 Claims, 4 Drawing Sheets

(56) References Cited

U.S. PATENT DOCUMENTS

| | | | |
|---|---|---|---|
| 2013/0059247 | A1 | 3/2013 | Sugimoto et al. |
| 2013/0078563 | A1 | 3/2013 | Nakayama et al. |
| 2013/0108950 | A1 | 5/2013 | Yamamoto et al. |
| 2013/0115550 | A1 | 5/2013 | Amemori et al. |
| 2013/0143155 | A1 | 6/2013 | Santo et al. |
| 2013/0157183 | A1 | 6/2013 | Santo et al. |
| 2013/0236826 | A1 | 9/2013 | Makabe et al. |
| 2013/0244153 | A1 | 9/2013 | Nakayama et al. |
| 2013/0244154 | A1 | 9/2013 | Yamamoto et al. |
| 2013/0252158 | A1 | 9/2013 | Yamada et al. |
| 2013/0260298 | A1 | 10/2013 | Amemori et al. |
| 2013/0337374 | A1 | 12/2013 | Sugimoto et al. |
| 2014/0051019 | A1 | 2/2014 | Sekiguchi et al. |
| 2014/0065534 | A1 | 3/2014 | Amemori et al. |

FOREIGN PATENT DOCUMENTS

| | | | | |
|---|---|---|---|---|
| JP | 63-027855 | | 2/1988 | |
| JP | 9-329917 | | 12/1997 | |
| JP | 2001-305796 | | 11/2001 | |
| JP | 2003-167384 | | 6/2003 | |
| JP | 2004-046095 | | 2/2004 | |
| JP | 2004-138924 | | 5/2004 | |
| JP | 2004-309996 | | 11/2004 | |
| JP | 2006-071906 | | 3/2006 | |
| JP | 2006-251564 | | 9/2006 | |
| JP | 2007-114635 | * | 5/2007 | ..... G03G 9/087 |
| JP | 2007-271789 | | 10/2007 | |
| JP | 2007-286144 | | 11/2007 | |
| JP | 2008-052192 | | 3/2008 | |
| JP | 2012-027212 | | 2/2012 | |
| JP | 2013-054178 | | 3/2013 | |

OTHER PUBLICATIONS

Translation of JP 2007-114635.*
U.S. Appl. No. 14/190,771, filed Feb. 26, 2014.
U.S. Appl. No. 14/171,962, filed Feb. 4, 2014.
U.S. Appl. No. 14/350,213, filed Apr. 7, 2014.

* cited by examiner

TONER FOR IMAGE FORMATION, AND DEVELOPER AND IMAGE FORMING APPARATUS USING THE TONER

CROSS-REFERENCE TO RELATED APPLICATIONS

This patent application is based on and claims priority pursuant to 35 U.S.C. §119(a) to Japanese Patent Application No. 2013-188068, filed on Sep. 11, 2013, in the Japan Patent Office, the entire disclosure of which is hereby incorporated by reference herein.

BACKGROUND

Technical Field

This disclosure relates to a toner for use in developing an electrostatic latent image. In addition, this disclosure also relates to a developer, and an image forming apparatus, which use the toner.

Description of the Related Art

Recently, a need exists for toner having the following properties:

(1) A relatively small particle diameter so that the toner can produce high quality images;
(2) Good resistance to a high temperature offset problem (hot offset problem);
(3) Good low temperature fixability so that the toner can be fixed at low fixing energy; and
(4) Good high temperature preservability so that the toner can be securely stored or transported at a relatively high temperature after production of the toner.

In particular, since proportion of power consumption in the fixing process in the total power consumption of an image forming apparatus is major, it is important to enhance the low temperature fixability of toner.

In attempting to fulfill the need, a technique in that a crystalline resin is used for the binder resin of toner is proposed. Since a crystalline resin in a crystalline state sharply softens at a melting point thereof, it is possible for a toner using such a crystalline resin to have high temperature preservability at a temperature below the melting point thereof while having a significantly decreased fixing temperature. Namely, the toner has a good combination of low temperature fixability and ability of production of high quality images. However, a crystalline resin having such a melting point that the resultant toner can have good low temperature fixability has good toughness but is soft, and therefore the resin tends to cause plastic deformation. Therefore, toner including only a crystalline resin as a binder resin has poor mechanical durability, and causes various problems such that deformation, agglomeration and fixation of toner occur in an image forming apparatus, and parts of the image forming apparatus are contaminated by the toner.

In attempting to solve the problems, toners including a crystalline resin and a non-crystalline resin as binder resins have been proposed.

In addition, toners using a resin in which a molecular chain (segment) having crystallinity and a molecular chain (segment) having no crystallinity (i.e., amorphousness) are chemically bonded have been proposed. For example, toners using, as a binder resin, a resin in which a crystalline polyester resin used as a segment and a polyurethane used as another segment are bonded have been proposed. Further, a toner using, as a binder resin, a resin in which a crystalline polyester resin used as a segment and an amorphous vinyl polymer used as another segment are bonded is proposed.

Furthermore, toners using, as a binder resin, a resin in which a crystalline polyester resin used as a segment and an amorphous polyester resin used as another segment are bonded have been proposed.

Further, a toner including a crystalline resin as a main binder resin and a particulate inorganic material is proposed. In addition, a toner including a crystalline resin having a crosslinked structure formed by an unsaturated bond including a sulfonic acid group is proposed.

Further, a toner which includes a resin including a crystalline polyester resin and a release agent (wax) and in which the crystalline polyester resin and the wax form a sea-island structure (i.e., a phase separation structure) to impart a high level of low temperature fixability to the toner is proposed. Furthermore, a toner that includes a crystalline polyester resin, a release agent and a graft polymer is proposed.

Since the desired level of low temperature fixability of toner becomes higher and higher recently, the above-mentioned toners cannot fulfill the need of such a high level of low temperature fixability.

SUMMARY

As an aspect of this disclosure, a toner is provided which includes a crosslinked polyester resin and a block copolymer. The crosslinked polyester resin includes a diol component, which includes an aliphatic diol component having 3 to 10 carbon atoms in an amount of 50% by mole, and a crosslinked component, which is at least one of a crosslinked component of an aliphatic alcohol having three or more valences and a crosslinked component of an aliphatic acid having three or more valences. The block copolymer includes a crystalline segment (a) and a non-crystalline segment (b). In addition, the toner has a first glass transition temperature (Tg1st) of from 20° C. to 50° C., wherein the first glass transition temperature (Tg1) is determined by subjecting the toner to differential scanning calorimetry (DSC) and measuring the glass transition temperature of the toner in the first temperature rising process in the DSC.

As another aspect of this disclosure, a developer is provided which includes the toner mentioned above, and a carrier. The toner can be used as a one-component developer.

As another aspect of this disclosure, an image forming apparatus is provided which includes an image carrier bearing an electrostatic latent image on a surface thereof; and a developing device to develop the electrostatic latent image using the toner mentioned above to form a visible image on the surface of the image carrier.

The aforementioned and other aspects, features and advantages will become apparent upon consideration of the following description of the preferred embodiments taken in conjunction with the accompanying drawings.

DETAILED DESCRIPTION

Figure 1:
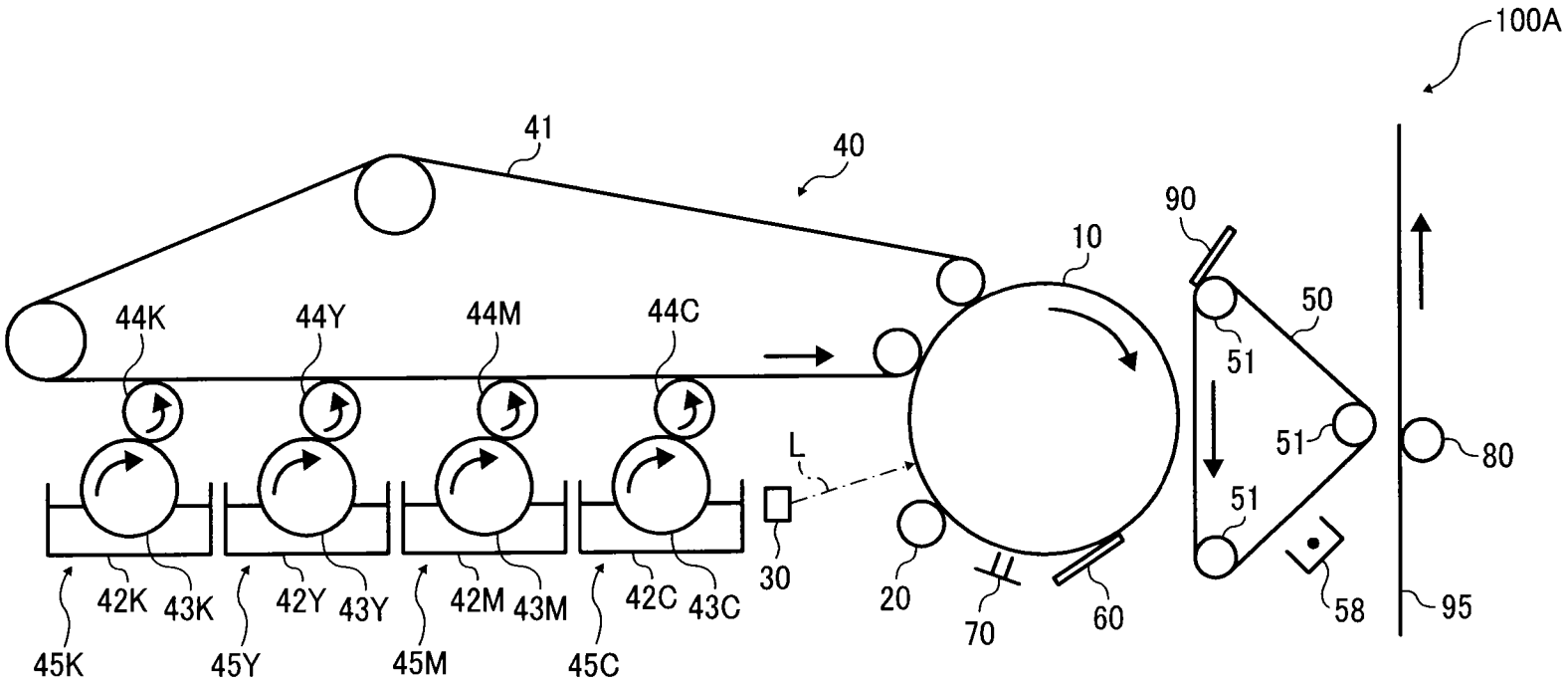
FIG. 1 is a schematic view illustrating an example of an image forming apparatus according to an embodiment.

The above-mentioned toners including a crystalline polyester resin have a relatively good low temperature fixability because such a crystalline polyester resin melts relatively sharply compared to a non-crystalline polyester resin. However, even when the crystalline polyester resin, which constitutes the islands in a sea-island structure, melts, the non-crystalline polyester resin, which constitutes the sea (which has a relatively large area compared to the islands) in the sea-island structure, does not yet melt. In this regard, unless both the crystalline polyester resin and the non-crystalline polyester resin melt to some extent, the toner cannot be fixed. Therefore, the above-mentioned toners cannot fulfill the need of a high level of low temperature fixability.

As mentioned above, proposals for toners including, as a binder resin, a resin in which a molecular chain (i.e., a crystalline segment) having crystallinity and another molecular chain (i.e., a non-crystalline segment) having no crystallinity, have been made to attempt to impart a good combination of low temperature fixability and high temperature preservability to the toners. However, the softness of the toners derived from the crystalline segment is not improved basically, and therefore the problem of the toners concerning mechanical durability cannot be solved.

In addition, although the toners including only a resin in which a crystalline segment and a non-crystalline segment are chemically bonded have improved lowest fixable temperature, the fixable temperature range of the toners cannot be widened and the mechanical strength thereof cannot be sufficiently enhanced. Namely, a need exists for a toner, which has a higher level of low temperature fixability and a wider fixable temperature range. In this regard, the fixable temperature range means the difference between the lowest fixable temperature of toner and the highest fixable temperature of the toner below which the toner does not cause the hot offset problem.

Further, toner including a crystalline resin has a problem concerning abrasion resistance, which is a problem to be solved. Specifically, when a toner image is melted on a recording medium in a heat fixing process, it takes time until the crystalline resin in the toner recrystallizes, and therefore hardness of the surface of the toner image cannot be rapidly recovered. Therefore, problems such that the surface of the toner image is damaged or glossiness of the surface of the toner image is changed by contact with a discharging roller and a feeding member to feed and discharge the recording medium bearing the toner image thereon or by being rubbed by the discharging roller and the feeding member are caused.

Therefore, a need exists for a toner, which has a higher level of low temperature fixability and a wider fixable temperature range while having good high temperature preservability and good rub resistance.

As a result of the present inventors' investigation, it is discovered that the above-mentioned problems can be solved by using, as binder resins, a specific block copolymer having a crystalline polymer chain (i.e., a crystalline segment) and a non-crystalline polymer chain (i.e., a non-crystalline segment), and a specific crosslinked polyester resin, which is nonlinear and has a branched structure.

Initially, the toner of this disclosure will be described in detail.

The toner of this disclosure includes at least a binder resin including a crosslinked polyester resin and a block copolymer. The crosslinked polyester resin includes a diol component, which includes an aliphatic diol component having 3 to 10 carbon atoms in an amount of 50% by mole, and a crosslinked component, which is at least one of a crosslinked component of an aliphatic alcohol having three or more valences and a crosslinked component of an aliphatic acid having three or more valences. The block copolymer includes a crystalline segment (a) and a non-crystalline segment (b). In addition, the toner has a first glass transition temperature (Tg1st) of from 20° C. to 50° C., wherein the first glass transition temperature (Tg1st) is determined by subjecting the toner to differential scanning calorimetry (DSC) and measuring the glass transition temperature of the toner in the first temperature rising process in the DSC.

The toner of this disclosure includes at least a binder resin as a constituent. The binder resin includes a block copolymer B, and a polyester resin C including a diol component including an aliphatic diol component having 3 to 10 carbon atoms in an amount of 50% by mole, and a crosslinked component including at least one of a crosslinked component of a tri- or more-valent aliphatic alcohol or a crosslinked component of a tri- or more-valent aliphatic acid. The block copolymer B includes a crystalline polymer chain (hereinafter referred to as a crystalline segment (a)) and a non-crystalline polymer chain (hereinafter referred to as a non-crystalline segment (b)). Namely, the block copolymer B can be obtained by subjecting a crystalline segment (a) and a non-crystalline segment (b) to block copolymerization.

The toner can further include a crystalline polyester resin. In addition, the crosslinked polyester resin can include plural polyester resins, wherein at least one of the plural polyester resins is a polyester resin, which can be obtained by reacting a compound having a group including an active hydrogen atom with a polymer reactive with the compound. For example, at least one of the plural polyester resins is a polyester resin, which can be obtained by reacting a reactive precursor (i.e., a polymer reactive with a compound having a group including an active hydrogen atom), which has a tri- or more-valent functional group and therefore has a branched structure, with a crosslinking agent (i.e., a compound having a group including an active hydrogen atom).

The crystalline segment (a) means a crystalline polymer unit (i.e., a crystalline portion), and the non-crystalline segment (b) means a non-crystalline polymer unit (i.e., a non-crystalline portion).

It is essential for the toner of this disclosure to include, as a main binder resin, a block copolymer including a crystalline segment (a) and a non-crystalline segment (b).

Block copolymers mean polymers in which different polymer units are linked by a covalent bond. In general, different kinds of polymer chains (such as a crystalline segment (a) and a non-crystalline segment (b)) are not compatible (not mixable) with each other like water and an oil. Namely, when polymers having different structural units are simply mixed with each other, the polymers are separated from each other (i.e., macroscopic phase separation is caused) because the different polymer chains can move independently.

In contrast, in a block copolymer, different polymer chains are linked with each other by a covalent bond, and therefore macroscopic phase separation is not caused. However, even though different polymer chains are linked, the same polymer chains tend to aggregate and different polymer chains tend to be separated from each other. Therefore, such a block copolymer has a structure such that a portion, which includes a crystalline segment (a) in a large amount and has a size near the length of the crystalline segment (a), and a portion, which includes a non-crystalline segment (b) in a large amount and has a size near the length of the non-crystalline segment (b), are alternately present (i.e., such portions are microscopically separated from each other).

Therefore, by changing compatibility of the crystalline segment (a) with the non-crystalline segment (b), formula of the crystalline segment (a) and the non-crystalline segment (b), length (i.e., molecular weight and distribution thereof) of the crystalline segment (a) and the non-crystalline segment (b), and molar ratio of the crystalline segment (a) to the non-crystalline segment (b), the structure (i.e., form of phase separation) of the block copolymer can be changed. By using this method, a block copolymer having a periodic order mesostructure such as a sphere structure, a cylinder structure, a gyroid structure, and a lamellar structure, which are described by A. K. Khandpur, S. Forster and F. S. Bates in Macromolecules, 28 (1995) pp. 8796-8806, can be prepared while controlling the structure.

When a block copolymer having a microscopic phase separation structure is crystallized, the block copolymer can achieve arrangement with regularity in which crystalline phases are regularly arranged on the order of from tens to hundreds of nanometers by using the microscopic phase separation structure of the melted polymer as a template if control such that the block copolymer can have the periodic order mesostructure mentioned above can be performed.

When a block copolymer including a crystalline segment (a) and a non-crystalline segment (b) is used as a main binder resin of the toner of this disclosure, the toner can have a specific higher-order structure typified by the microscopic phase separation structure. By utilizing this higher-order structure, the above-mentioned problems to be solved can be solved.

Specifically, by utilizing the higher-order structure, it becomes possible for the toner of this disclosure to have sufficient fluidity and deformability due to solid-liquid transition of the crystalline polymer unit (i.e., crystalline portion) when the toner is used for a fixing process and the like process in which fluidity is necessary for the toner. In addition, when the toner is preserved or is fed in an image forming apparatus after the fixing process, namely, in a case in which fluidity and deformability are not necessary for the toner, the crystalline portion is contained in the structure, thereby making it possible to weaken the mobility of the toner. As a result, the object of this disclosure can be attained.

The molecular structure, crystallinity, and higher-order structure such as microscopic phase separation structure of a copolymer can be easily analyzed by any known methods. Specific examples of the methods include high-resolution nuclear magnetic resonance (NMR) analysis ($^{1}H$, $^{13}C$, etc.), differential scanning calorimetry (DSC), wide-angle X-ray diffraction methods, (pyrolysis) gas chromatography (GC)/mass spectrometry (MS) methods, liquid chromatography (LC)/mass spectrometry (MS) methods, infrared (IR) absorption spectroscopy, atomic force microscopy, and transmission electron microscopy (TEM).

Next, the block copolymer to be included in the toner of this disclosure will be described.

As mentioned above, the block copolymer includes a polymer chain having crystallinity and forming the crystalline segment (a) (i.e., crystalline polymer unit (crystalline portion)), and a polymer chain having no crystallinity and forming the non-crystalline segment (b) (i.e., non-crystalline polymer unit (non-crystalline portion)).

Hereinafter, the non-crystalline segment (b) and the crystalline segment (a) will be described in detail.

The non-crystalline segment (b) (non-crystalline polymer unit (non-crystalline portion)) is not particularly limited, and one or more proper polymer chains are selected from any known non-crystalline polymer chains depending on the intended use of the toner. Among these non-crystalline polymer chains, non-crystalline polyester chains (hereinafter referred to as non-crystalline polyester (b)) are preferable because of having good affinity for paper, which is typically used for recording media, while having good high temperature preservability.

Next, the non-crystalline segment (b) will be specifically described by reference to a non-crystalline polyester (b).

The hydroxyl value of the non-crystalline polyester (b) is not particularly limited, and is properly determined depending on the intended use of the toner. However, the hydroxyl value is preferably from 5 to 40 mgKOH/g. When the hydroxyl value is too low (i.e., when the molecular weight, which can be calculated from the hydroxyl value, is too low), the high temperature preservability of the toner tends to deteriorate, and the durability of the toner to stresses such as agitation in a developing device tends to deteriorate. In contrast, when the molecular weight is too high, the viscoelasticity of the melted toner increases, thereby often deteriorating the low temperature fixability of the toner.

Similarly, the weight average molecular weight of the non-crystalline polyester (b) can also be used as an index. The weight average molecular weight of the non-crystalline polyester (b) is preferably from 3,000 to 30,000, and more preferably from 5,000 to 25,000.

The weight average molecular weight of a non-crystalline polyester (b) can be measured by gel permeation chromatography (GPC).

The glass transition temperature of the non-crystalline polyester (b) is preferably from 40° C. to 75° C. When the glass transition temperature is lower than 40° C., the high temperature preservability of the toner tends to deteriorate, and the durability of the toner to stresses such as agitation in a developing device tends to deteriorate. In contrast, when the glass transition temperature is higher than 75° C., the low temperature fixability of the toner tends to deteriorate. The glass transition temperature of the non-crystalline polyester (b) can be measured by differential scanning calorimetry (DSC).

Specific examples of alcoholic components used for forming the non-crystalline polyester (b) include dihydric alcohols (diols) such as alkylene glycols having 2 to 36 carbon atoms (e.g., ethylene glycol, 1,2-propylene glycol, 1,3-propylene glycol, 1,4-butylene glycol and 1,6-hexanediol); alkylene ether glycols having 4 to 36 carbon atoms (e.g., diethylene glycol, triethylene glycol, dipropylene glycol, polyethylene glycol, polypropylene glycol and polybutylene glycol); alicyclic diols having 6 to 36 carbon atoms (e.g., 1,4-cyclohexanedimethanol and hydrogenated bisphenol A); alkylene (C2-4) oxide (e.g., ethylene oxide (EO), propylene oxide (PO), and butylene oxide (BO)) adducts (1 to 30 moles) of the alicyclic diols mentioned above; alkylene (C2-4) oxide (e.g., EO, PO and BO) adducts (2 to 30 moles) of bisphenols (e.g., bisphenol A, bisphenol F and bisphenol S); etc.

Tri- or more-hydric alcohol components can also be used for the non-crystalline polyester (b) in addition to diols. Specific examples thereof include aliphatic polyalcohols (such as alkane polyols and inner-molecular or inter-molecular dehydration products thereof, e.g., glycerin, triethylol ethane, trimethylol propane, pentaerythritol, sorbitol, sorbitane, polyglycerin and dipentaerythritol); saccharide and derivatives thereof (such as sucrose and methylglycoxide); alkylene (C2-4) oxide (e.g., EO, PO and BO) adducts (1 to 30 moles) of the aliphatic alcohols mentioned above; alkylene (C2-4) oxide (e.g., EO, PO and BO) adducts (2 to 30 moles) of trisphenols (such as trisphenol PA); alkylene (C2-4) oxide (e.g., EO, PO and BO) adducts (2 to 30 moles) of novolac resins (such as phenol novolac resins and cresol novolac resins having an average polymerization degree of from 3 to 60); etc.

Specific examples of carboxylic acid components used for forming the non-crystalline polyester (b) include divalent carboxylic acids (dicarboxylic acids) such as alkane dicarboxylic acids having 4 to 36 carbon atoms (e.g., succinic acid, adipic acid, and sebacic acid) and alkenyl succinic acids (e.g., dodecenyl succinic acid); alicyclic dicarboxylic acids having 4 to 36 carbon atoms (such as dimer acids (e.g., dimeric linoleic acid); alkene dicarboxylic acids having 4 to 36 carbon atoms (e.g., maleic acid, fumaric acid, citraconic acid, and mesaconic acid); aromatic dicarboxylic acids having 8 to 36 carbon atoms (e.g., phthalic acid, isophthalic acid, terephthalic acid and derivatives thereof, and naphthalene dicarboxylic acid); etc. Among these dicarboxylic acids, alkene dicarboxylic acids having 4 to 20 carbon atoms, and aromatic dicarboxylic acids having 8 to 20 carbon atoms are preferable.

In addition to the polycarboxylic acids mentioned above, anhydrides and lower alkyl (C1-4) esters (e.g., methyl, ethyl, and isopropyl esters) thereof can also be used.

Further, ring-opening polymers such as polylactic acid and polycarbonate diols can also be used.

The molecular structure of the above-mentioned resins can be determined by a NMR method using a solution or a solid of the resins, or another method such as GC/MS, LC/MS and IR.

Next, the crystalline segment (a) will be described.

The crystalline segment (a) (crystalline polymer unit (crystalline portion)) is not particularly limited, and one or more proper polymer chains are selected from any known crystalline polymer chains depending on the intended use of the toner. Among such crystalline polymer chains, crystalline polyester chains (hereinafter referred to as crystalline polyester (a)) are preferable because of sharply melting in a fixing process while having a good combination of flexibility and durability even when the molecular weight is relatively low.

Among various polyester chains, aliphatic polyester chains (hereinafter referred to as aliphatic polyester (a)) are preferable because of sharply melting in a fixing process while having high crystallinity.

Next, the crystalline segment (a) will be specifically described by reference to a crystalline polyester (a).

The crystalline polyester (a) can be prepared by subjecting a polyalcohol, and a polycarboxylic acid and/or a derivative thereof (such as anhydrides, esters and derivatives of polycarboxylic acids) to condensation polymerization. In addition, ring-opening compounds such as polycaprolactones can also be used.

The melting point of the crystalline polyester (a) is preferably from 50° C. to 80° C. When the melting point is lower than 50° C., the crystalline polyester (a) tends to melt at a relatively low temperature, thereby deteriorating the high temperature preservability of the toner. In contrast, when the melting point is higher than 80° C., the crystalline polyester (a) insufficiently melts in the fixing process, thereby deteriorating the low temperature fixability of the toner.

The hydroxyl value of the crystalline polyester (a) is not particularly limited, and is properly determined depending on the intended use of the toner. However, the hydroxyl value is preferably from 5 to 40 mgKOH/g. When the hydroxyl value is too low (i.e., when the molecular weight, which can be calculated from the hydroxyl value, is too low), the high temperature preservability of the toner tends to deteriorate, and the durability of the toner to stresses such as agitation in a developing device tends to deteriorate. In contrast, when the molecular weight is too high, the viscoelasticity of the melted toner increases, thereby often deteriorating the low temperature fixability of the toner.

Similarly, the weight average molecular weight of the crystalline polyester (a) can also be used as an index. The weight average molecular weight of the crystalline polyester (a) is preferably from 3,000 to 30,000, and more preferably from 5,000 to 25,000.

The weight average molecular weight of a crystalline polyester (a) can be measured by gel permeation chromatography (GPC).

The polyalcohol used for synthesizing the crystalline polyester (a) is not particularly limited, and one or more proper polyalcohols (such as diols and tri- or more-hydric alcohols) are selected depending on the intended use of the toner.

Among various diols, saturated aliphatic diols (such as saturated linear aliphatic diols and saturated branched aliphatic diols) are preferably used. Among these saturated aliphatic diols, saturated linear aliphatic diols are preferable, and saturated linear aliphatic diols having 2 to 12 carbon atoms are more preferable.

When saturated branched aliphatic diols are used, the crystallinity of the resultant crystalline polyester (a) tends to deteriorate, resulting in decrease of the melting point of the crystalline polyester (a). It is hard to obtain saturated linear aliphatic diols having 13 or more carbon atoms, and therefore the number of carbon atoms of the saturated linear aliphatic diols is preferably not greater than 12.

Specific examples of such saturated linear aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosanedecanediol, etc. These diols can be used alone or in combination.

Among these diols, ethylene glycol, 1,4-butanediol, 1,6-hexanediol, 1,8-octanediol, 1,10-decanediol, and 1,12-dodecanediol are preferable because the resultant crystalline polyester (a) has high crystallinity and sharp melting property.

Specific examples of the tri- or more-hydric alcohols include glycerin, trimethylol ethane, trimethylol propane, pentaerythritol, etc. These can be used alone or in combination.

The polycarboxylic acid for use in synthesizing the crystalline polyester (a) is not particularly limited, and one or more proper polycarboxylic acids (such as dicarboxylic acids and tri- or more-carboxylic acids) are selected depending on the intended use of the toner.

Specific examples of such dicarboxylic acids include saturated aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids such as phthalic acid, isophthalic acid, terephthalic acid, naphthalene-2,6-dicarboxylic acid, malonic acid, and mesacnic acid; and anhydrides and lower alkyl (C1-3) esters of these dicarboxylic acids. These can be used alone or in combination.

Specific examples of such tricarboxylic acids include 1,2,4-benzenetricarboxylic acid, 1,2,5-benzenetricarboxylic acid, 1,2,4-naphthalenetricarboxylic acid, and anhydrides and lower alkyl (C1-3) esters of these tricarboxylic acids. These can be used alone or in combination.

In this regard, polycarboxylic acids including a sulfonic acid group and/or a double bond can also be used as polycarboxylic acids in addition to the above-mentioned aliphatic and aromatic polycaroxylic acids.

The crystalline polyester (a) is preferably a polyester prepared by subjecting a saturated linear aliphatic dicarboxylic acid having 4 to 12 carbon atoms and a saturated linear aliphatic diol having 2 to 12 carbon atoms to condensation polymerization. Namely, the crystalline polyester (a) preferably includes a unit obtained from a saturated linear aliphatic dicarboxylic acid having 4 to 12 carbon atoms and a unit obtained from a saturated linear aliphatic diol having 2 to 12 carbon atoms. In this case, the resultant aliphatic polyester (a) has high crystallinity and a good sharp melting property, and therefore the resultant toner has good low temperature fixability.

Whether or not the crystalline polyester (a) has crystallinity, and the molecular structure of the crystalline polyester (a) can be determined by a method such as nuclear magnetic resonance (NMR) methods, differential scanning calorimetry (DSC), X-ray diffraction methods, gas chromatography (GC)/mass spectrometry (MS) methods, liquid chromatography (LC)/mass spectrometry (MS) methods, and infrared absorption spectroscopy (IR).

As mentioned above, the block copolymer is a copolymer including a crystalline segment (a) (i.e., crystalline polymer unit (crystalline portion)) and a non-crystalline segment (b) (i.e., non-crystalline polymer unit (non-crystalline portion)), which are copolymerized. Particularly, copolymers including a crystalline polyester chain (i.e., crystalline polyester (a)) and a non-crystalline polyester chain (i.e., non-crystalline polyester (b)) are preferable.

The copolymerization method is not particularly limited, and a proper copolymerization method is used depending on the intended use of the toner. For example, one of the below-mentioned methods (1)-(3) is used. Among these methods, the method (1) or (3) is preferably used, and the method (1) is more preferably used from the viewpoint of flexibility in molecular design of the copolymer.

(1) A method in which a non-crystalline polyester (b) preliminarily prepared by a polymerization reaction and a crystalline polyester (a) preliminarily prepared by a polymerization reaction are dissolved or dispersed in a proper solvent, and a polymer chain growth agent having two or more functional groups (such as isocyanate, epoxy and carbodiimide groups) capable of reacting with a hydroxyl group or a carboxyl group at the end of the polymer chain of the polyesters (a) and (b) is added to be reacted with the polyesters (a) and (b).

(2) A method in which a non-crystalline polyester (b) preliminarily prepared by a polymerization reaction and a crystalline polyester (a) preliminarily prepared by a polymerization reaction are melted and kneaded, and the mixture is subjected to an ester exchange reaction under a reduced pressure.

(3) A method in which by using a hydroxyl group at the end of a crystalline polyester (a) preliminarily prepared by a polymerization reaction as a polymerization initiator, a non-crystalline polyester (b) is prepared by a ring-opening reaction so that the non-crystalline polyester (b) is connected with the end of the crystalline polyester (a).

In the block copolymer, the weight ratio (b/a) of the non-crystalline portion (i.e., non-crystalline polyester (b)) to the crystalline portion (i.e., crystalline polyester (a)) is preferably from 1.5 to 4.0. When the weight ratio (b/a) is less than 1.5, the crystalline portion influences the resultant copolymer too strongly, thereby forming a copolymer having a full lamellar structure instead of a copolymer having a microscopic phase separation structure specific to block copolymers. Therefore, the copolymer can be effectively contributed to a case (e.g., a fixing process) for which fluidity is necessary, but cannot suppress its mobility in a case (e.g., preservation of toner, and a feeding process of a fixed toner image after the fixing process) for which fluidity and deformability are not necessary. Therefore, the object of the toner of this disclosure cannot be attained.

In contrast, when the weight ratio (b/a) is greater than 4.0, the non-crystalline portion influences the resultant copolymer too strongly. Therefore, the copolymer can be effectively contributed to a case (e.g., preservation of toner, and a feeding process of a fixed toner image after the fixing process) for which fluidity and deformability are not necessary, but cannot impart good fluidity and deformability to the toner in a case (e.g., a fixing process) for which fluidity is necessary. Therefore, the object of the toner of this disclosure cannot be attained.

When the method (1) mentioned above is used as the copolymerization method, one or more of any known polymer chain growth agents can be used as the polymer chain growth agent. Among these polymer chain growth agents, isocyanate compounds are preferable from the viewpoint of costs and reactivity. Specific examples of preferable isocyanate compounds include toluene diisocyanate (TDI), diphenylmethane diisocyanate (MDI), hexamethylene diisocyanate (HDI), hydrogenated MDI, and isophorone diisocyanate (IPDI).

When the block copolymerization is performed, the added amount of the polymer chain growth agent is preferably controlled such that the molar ratio (OH/NCO) of the total number of moles of polyester polyols of the preliminarily prepared non-crystalline polyester (b) and crystalline polyester (a) to the total number of moles of the isocyanate (polymer chain growth agent), is from 0.35 to 0.7.

When the molar ratio (OH/NCO) is less than 0.35, bonding (copolymerization) of the non-crystalline polyester (b) with the crystalline polyester (a) cannot be well performed, and therefore each of the non-crystalline polyester (b) and the crystalline polyester (a) tends to be present independently. In this case, it is hard for the copolymer to have the desired quality. In contrast, when the molar ratio (OH/NCO) is greater than 0.7, the quality of the copolymer is influenced too strongly by the molecular weight of the copolymer and the interaction between urethane groups. Therefore, the resultant toner cannot have good fluidity and deformability in a case (e.g., a fixing process) for which fluidity is necessary. Therefore, the object of the toner of this disclosure cannot be attained.

The crystalline segment (a) of the block copolymer is preferably a crystalline polyester obtained by subjecting an aliphatic dihydric alcohol and an aliphatic dicarboxylic acid to condensation, and the non-crystalline segment (b) is preferably a non-crystalline polyester obtained by subjecting an aliphatic dihydric alcohol and a dicarboxylic acid including an aromatic dicarboxylic acid as a main component to condensation. The molar ratio (a/b) of the crystalline segment (a) to the non-crystalline segment (b) is preferably from 10/90 to 40/60. When the molar ratio (a/b) is less than 10/90, it is hard to impart good low temperature fixability to the toner. In contrast, when the molar ratio (a/b) is greater than 40/60, it is hard to impart good high temperature preservability to the toner.

With respect to the molecular weight of the block copolymer, the weight average molecular weight determined by gel permeation chromatography (GPC) is preferably from 20,000 to 70,000. When the weight average molecular weight is less than 20,000, it is hard to impart good viscoelasticity to the toner. In this case, although the resultant toner has good fluidity in a fixing process, but has too low a melt viscosity, thereby often causing the hot offset problem. In addition, the resultant toner has poor preservability and rub resistance. In contrast, when the weight average molecular weight is greater than 70,000, the fluidity of the resultant toner seriously deteriorates, thereby making it impossible to impart good low temperature fixability to the toner.

The molecular structure, crystallinity, and higher-order structure such as microscopic phase separation structure of a block copolymer can be easily analyzed by any known methods. Specific examples of the methods include high-resolution nuclear magnetic resonance (NMR) analysis ($^{1}H$, $^{13}C$, etc.), differential scanning calorimetry (DSC), wide-angle X-ray diffraction methods, (pyrolysis) gas chromatography (GC)/mass spectrometry (MS) methods, liquid chromatography (LC)/mass spectrometry (MS) methods, infrared (IR) absorption spectroscopy, atomic force microscopy, and transmission electron microscopy (TEM).

Whether or not such a copolymer as mentioned above is included in a toner can be determined by the following method.

Initially, the toner is dissolved in a solvent such as ethyl acetate and tetrahydrofuran (THF). In this regard, soxhlet extraction may be used. Next, the solution is centrifuged, for example, under conditions of 20° C. in temperature, 10,000 rpm in revolution, and 10 minutes in centrifugation time using a high speed centrifugal separator with a cooling function to separate the soluble components from insoluble components of the toner. The soluble components are subjected to a re-precipitation treatment plural times to be refined. By performing these treatments, the resin components can be separated from highly-crosslinked resin components, pigments and waxes.

The thus obtained resin components are then subjected to gel permeation chromatography (GPC) to obtain the molecular weight, the molecular weight distribution and the chromatogram of the resin components. In this regard, when the chromatogram has plural peaks, the resin components are subjected to fractionation or sorting, and a film of each of the fractions is prepared. By performing this operation, the resin components can be separated and refined, and therefore the separated resin components can be subjected to various analyses.

Each of the thus prepared films of refined resin components is subjected to differential scanning calorimetry (DSC) to determine the glass transition temperature (Tg), the melting point, and whether the films exhibit crystallization behavior. When a crystallization peak is observed in a cooling process in the DSC, the film is annealed in the temperature range for 24 hours or more to grow the crystal components. When a crystallization peak is not observed but a melting peak is observed, the film is annealed at a temperature about 10° C. lower than the melting point. By performing this annealing, it becomes possible to determine whether or not the film has various kinds of transition temperatures and a crystalline skeleton.

Next, the film is observed by a scanning probe microscope (SPM) (atomic force microscope (AFM)) (optionally together with a transmission electron microscope (TEM)) to determine whether or not the film has a phase separation structure. When the microscopic phase separation structure is observed, it can be determined that the film includes a copolymer or is a system having a high intramolecular or intermolecular interaction.

Further, the refined film is subjected to Fourier transform infrared spectroscopy (FT-IR), nuclear magnetic resonance (NMR) analysis ($^{1}H$, $^{13}C$, etc.), and gas chromatography (GC)/mass spectrometry (MS) (optionally NMR analysis (2D), by which the molecular structure can be analyzed more precisely) to determine the formula, structure and various kinds of properties of the film (resin components). For example, whether or not the film includes a polyester skeleton and a urethane bond, and the formula and the ratio of components can be determined.

By performing the above-mentioned measurements (analyses), and analyzing the results of the measurements, whether or not the toner includes the first resin (i.e., copolymer) of the toner of this disclosure can be determined.

Examples of the procedure and condition of the above-mentioned measurements are the following. The procedure and condition of the scanning probe microscope (SPM) (atomic force microscope (AFM)) are mentioned later.

Initially, an example of the gel permeation chromatography (GPC) will be described.

For example, an instrument, HLC-8220GPC from Tosoh Corporation, can be used for GPC. In this regard, it is preferably to use an instrument with a fraction collector. In addition, a column, TSKGEL SUPERHZM-H (15 cm, three columns in series) from Tosoh Corporation, is preferably used as the column.

A sample (resin) is dissolved in tetrahydrofuran (THF) including a stabilizer and prepared by Wako Pure Chemical Industries, Ltd. to prepare a solution of the resin having a concentration of 0.15% by weight. After the solution is filtered using a 0.2 μm filter, the solution is used as a sample for GPC. Next, 100 μl of the sample (THF solution) is injected into the instrument mentioned above, and then measurement is performed under conditions of 40° C. in temperature and 0.35 ml/min in flow rate of the sample.

The molecular weight of the sample (resin) is determined using a working curve previously prepared using monodisperse polystyrene standard samples. In this regard, monodisperse polystyrenes, SHODEX STANDARD SERIES from Showa Denko K.K., and toluene are used as the standard samples. Specifically, the below-mentioned three kinds of THF solutions of monodisperse polystyrene standard samples (i.e., solutions A-C) are prepared, and measurement is performed under the above-mentioned conditions, followed by preparation of a working curve. When the working curve is prepared, the retention time at the peak top is used as the light scattering molecular weight of the monodisperse polystyrene sample.

| Solution A | |
|---|---|
| SHODEX STANDARD S-7450 | 2.5 mg |
| SHODEX STANDARD S-678 | 2.5 mg |
| SHODEX STANDARD S-46.5 | 2.5 mg |
| SHODEX STANDARD S-2.90 | 2.5 mg |
| THF | 50 ml |

| Solution B | |
|---|---|
| SHODEX STANDARD S-3730 | 2.5 mg |
| SHODEX STANDARD S-257 | 2.5 mg |
| SHODEX STANDARD S-19.8 | 2.5 mg |
| SHODEX STANDARD S-0.580 | 2.5 mg |
| THF | 50 ml |

| Solution C | |
|---|---|
| SHODEX STANDARD S-1470 | 2.5 mg |
| SHODEX STANDARD S-112 | 2.5 mg |
| SHODEX STANDARD S-6.93 | 2.5 mg |
| Toluene | 2.5 mg |
| THF | 50 ml |

In this regard, a refractive index (RI) detector can be used as the detector. However, when fractionation is performed, a UV detector, which has a better sensitivity than the RI detector, is preferably used.

Next, an example of the differential scanning calorimetry (DSC) will be described.

Five (5) milligrams of a sample (resin) is contained in a sealed pan T-ZERO from TA Instruments, and the pan is set in a differential scanning calorimeter Q2000 from TA Instruments.

Initially, the first glass transition temperature (Tg1st) of the sample, which is measured in the first heating process of DSC, is determined. Specifically, the sample is heated from 40° C. to 150° C. at a temperature rising speed of 5° C./min under nitrogen gas flow. After the temperature of the sample is maintained at 150° C. for 5 minutes, the sample is cooled to −70° C. at a cooling speed of 5° C./min. The sample is cooled at −70° C. for 5 minutes. The first glass transition temperature (Tg1st) is determined from the DSC curve in the first heating process using a mid-point method. In this regard, it is possible to separate the enthalpy relaxation component by performing modulation of ±0.3° C. in the first heating process.

Next, the second glass transition temperature (Tg2nd) of the sample, which is measured in the second heating process of DSC. Specifically, the sample is heated again at a temperature rising speed of 5° C./min to measure the thermal change of the sample. Specifically, a graph showing the relation between endothermic/exothermic energy and temperature is prepared, and the Tg (Tg2nd), the cold crystallization temperature, the melting point and the crystallization temperature of the sample are determined by standard methods.

Next, an example of observation using a SPM (scanning probe microscope) will be described.

In this example, the sample is observed by an atomic force microscope (AFM) in the tapping mode to obtain a phase image thereof. The copolymer of the toner of this disclosure is characterized in that a soft portion, which is observed as a portion having a high phase difference in the image, and a hard portion, which is observed as a portion having a low phase difference in the image, are finely dispersed in the copolymer. In this regard, it is important for the copolymer for use in the toner of this disclosure that the hard portion (i.e., low phase difference portion, second phase difference image) is dispersed as an external phase, and the soft portion (i.e., high phase difference portion, first phase difference image) is dispersed as an internal phase.

A sample to be observed by an AFM can be prepared by cutting a resin block, for example, with an ultramicrotome ULTRACUT UCT from Leica Camera AG under the following conditions.

Thickness of cut sample: 60 nm

Cutting speed: 0.4 mm/s

Cutter used: Diamond knife (ULTRA SONIC 35°)

In this example, MFP-3D from Asylum Technology, is used as the instrument, by which the above-mentioned AFM phase difference image can be obtained, together with a cantilever OMCL-AC240TS-C3. The observation conditions are the following.

Target amplitude: 0.5V

Target percent: −5%

Amplitude setpoint: 315 mV

Scan rate: 1 Hz

Scan points: 256×256

Scan angle: 0°

Next, an example of observation using a TEM (transmission electron microscope) will be described.

The procedure of the observation is the following.

(1) A sample is dyed for 2 hours in an atmosphere of an aqueous solution of $RuO_4$.

(2) After the sample is trimmed by a glass knife, the sample is cut by a microtome under the following conditions:
Thickness of cut sample: 60 nm
Cutting speed: 0.05-0.2 mm/s
Cutter used: Diamond knife (ULTRA SONIC 35°)

(3) The cut sample is fixedly set on a net, and is dyed for 5 minutes in an atmosphere of an aqueous solution of $RuO_4$.

(4) The dyed sample is observed with a TEM under the following conditions:
Instrument used: Transmission electron microscope JEM-2100F from JEOL Ltd.
Acceleration voltage: 200 kV
Observation method: Bright field method
Setting conditions of TEM:
Spot size: 3
CLAP: 1
OLAP: 3
Alpha: 3

Next, an example of Fourier transform infrared spectroscopy (FT-IR) will be described.

In this example, the FT-IR measurement is performed using a FT-IR spectrometer, SPECTRUM ONE from PerkinElmer Inc. under conditions of 16 scans and 2 $cm^{-1}$ in resolution. The wavelength range is a middle infrared range of from 400 to 4000 $cm^{-1}$.

Next, an example of nuclear magnetic resonance (NMR) measurement will be described.

The procedure of the NMR measurement is the following.

A sample is dissolved in deuterochloroform at as high a concentration as possible. The solution is contained in a NMR sample tube with a diameter of 5 mm so as to be used for the NMR measurement. The instrument is JNM-ECX-300 from JEOL RESONANCE Inc.

The measurement temperature is 30° C. The $^{1}$H-NMR measurement is performed under conditions of 256 times in cumulated number and 5.0 seconds in repetition time. The $^{13}$C-NMR measurement is performed under conditions of 10,000 times in cumulated number and 1.5 seconds in repetition time. The components of the sample can be determined from the chemical shift, and the ratio of the components can be calculated from a number obtained by dividing the integral value of the corresponding peak by the number of protons or carbons.

When a detailed structural analysis is performed, Double Quantum Filtered Correlation Spectroscopy (DQF-COSY) can be used. In this case, the measurement is performed under conditions of 1,000 times in cumulated number, and 2.45 or 2.80 seconds in repetition time, and the coupling condition (i.e., reaction site) can be determined from the obtained spectrum. However, the structure can be determined by general $^{1}$H-NMR and $^{13}$C-NMR measurement.

Next, an example of gas chromatography (GC)/mass spectrometry (MS) measurement (analysis) will be described.

In this example, a reaction pyrolysis gas chromatography (GC)/mass spectrometry (MS) method using a reactive agent is used. In this regard, a 10% methanol solution of tetramethylammonium hydroxide (TMAH) (from Tokyo Kasei Kogyo Co., Ltd.) is used as the reactive agent. The GC-MS instrument is QP2010 from Shimadzu Corp., the data analysis software is GCM SOLUTION from Shimadzu Corp., and the heating device is PY-2020D from Frontier Laboratories Ltd.

The conditions of the analysis are the following.

Reaction pyrolysis temperature: 300° C.

Column used: ULTRA ALLOY-5 (L=30 m, ID=0.25 mm, and Film of 0.25 μm)

Heating of column: Heating is performed from 50° C. (retained for 1 minute) to 330° C. (retained for 11 minutes) at a temperature rising speed of 10° C./min.

Pressure of carrier gas: 53.6 kPa (constant)

Column flow rate: 1.0 ml/min

Ionization method: EI method (70 eV)

Range of mass: m/z 29-700

Injection mode: Split (1:100)

The toner of this disclosure includes a crosslinked polyester resin and a block copolymer including a crystalline segment (a) and a non-crystalline segment (b). The crosslinked polyester resin includes an acid component, and an alcohol component. The alcohol component includes a diol component, which includes an aliphatic diol component having 3 to 10 carbon atoms in an amount of 50% by mole. The crosslinked polyester resin includes a crosslinked component, which is at least one of a crosslinked component of an aliphatic alcohol component having three or more valences and a crosslinked component of an aliphatic acid component having three or more valences. The crosslinked component is preferably at least one of a crosslinked component of an aliphatic alcohol component having three or four valences and a crosslinked component of an aliphatic acid component having three or four valences.

In order to enhance the low temperature fixability of toner, a method in which a crosslinked polyester resin is mixed with a crystalline polyester resin to decrease the glass transition temperature of the binder resin (toner) or a method in which the molecular weight of the binder resin is decreased can be used. However, when the glass transition temperature or the molecular weight of a non-crystalline polyester resin serving as a binder resin is decreased to decrease the melt viscosity of the toner, the high temperature preservability and the hot offset resistance of the toner deteriorate.

In contrast, the crosslinked polyester resin included in the toner of this disclosure includes a diol component as a constituent, and the diol component is an aliphatic diol component having 3 to 10 carbon atoms, wherein the aliphatic diol component is included in the crosslinked polyester resin in an amount of 50% by mole based on the total alcohol components in the crosslinked polyester resin. Therefore, the glass transition temperature and the melt viscosity of the toner can be decreased, thereby making it possible to impart good low temperature fixability to the toner. In addition, since the crosslinked polyester resin includes, as a crosslinked component, an acid or an alcohol (such as aliphatic alcohol) component having three or more valences, the crosslinked polyester resin has a branched structure in the molecular chain thereof, i.e., the molecular chain of the crosslinked polyester resin has a three dimensional network structure, and therefore the crosslinked polyester resin has a rubber-like property such that the resin is deformed at a relatively low temperature but does not flow, thereby making it possible to impart a good combination of high temperature preservability and hot offset resistance to the toner.

When the crosslinked polyester resin is prepared, it is possible to use a tri- or more-valent acid (carboxylic acid) or a tri- or more-valent alcohol (including an epoxy compound) as a crosslinking agent. In this regard, when a carboxylic acid is used as a crosslinking agent, an aromatic carboxylic acid is typically used. In this case, the ester bond density of the crosslinked portion increases. Therefore, when an image of a toner including such a resin is heated to be fixed, the fixed toner image tends to have low glossiness. When an epoxy compound is used as a crosslinking agent, a crosslinking reaction has to be performed on a polymerized polyester resin. In this case, it is hard to control the distance between crosslinking points, and therefore it is hard to prepare a crosslinked polyester resin having the desired viscoelasticity. In addition, the crosslinking agent is easily reacted with oligomers formed when the polyester resin is prepared, and therefore a portion having a higher crosslinking density is formed in the crosslinked polyester resin. In this case, the resultant toner tends to cause a problem such that fixed toner images have uneven glossiness and/or image density.

It is preferable for the diol component of the crosslinked polyester resin to have a main chain having odd-numbered carbon atoms while having an alkyl group as a side chain.

In addition, it is also preferable that the crosslinked polyester resin includes plural polyester resins, and at least one of the plural polyester resins is a polyester resin which is obtained by reacting a compound having an active hydrogen atom (i.e., a crosslinking agent) with a polymer (i.e., non-linear reactive precursor), which can be reacted with the compound having an active hydrogen group.

The crosslinked polyester resin preferably includes at least one of a urethane bond and a urea bond so that the resultant toner has good adhesiveness to recording media such as paper. In addition, since the urethane or urea bond exhibits behavior like a pseudo crosslinking point, the rubber-like property of the crosslinked polyester resin is enhanced, thereby further enhancing the high temperature preservability and the hot offset resistance of the toner.

The above-mentioned non-linear reactive precursor is not particularly limited as long as the precursor has a group reactive with the compound having an active hydrogen group (i.e., a crosslinking agent). Particularly, the precursor is preferably a polyester resin (hereinafter referred to as a prepolymer).

Specific examples of the group of the prepolymer reactive with the crosslinking agent include isocyanate groups, epoxy groups, carboxylic groups, and acid chloride groups. Among these groups, isocyanate groups are preferable because a urethane bond or a urea bond can be incorporated in the crosslinked polyester resin.

The prepolymer is non-linear. As mentioned above, the term "non-linear" means a branched structure formed by at least one of a tri- or more-valent alcohol and a tri- or more-valent carboxylic acid. Among various prepolymers, polyester prepolymers having an isocyanate group are preferable.

The polyester resin in the plural polyester resins of the crosslinked polyester resin is preferably a polyester resin obtained from a reaction of a polyester prepolymer having an isocyanate group with a compound having an active hydrogen group. The polyester prepolymer having an isocyanate group is not particularly limited, and specific examples thereof include reaction products of a polyester having an active hydrogen group with a polyisocyanate. Such a polyester having an active hydrogen group can be prepared, for example, by subjecting a diol, a dicarboxylic acid, and at least one of a tri- or more-valent alcohol and a tri- or more-valent carboxylic acid to polycondensation. In this regard, at least one of a tri- or more-valent alcohol and a tri- or more-valent carboxylic acid forms a branched structure in the polyester prepolymer having an isocyanate group.

The diol for use in preparing the polyester having an active hydrogen group is not particularly limited. Specific examples of the diol include aliphatic diols such as ethylene glycol, 1,2-propylene glycol, 1,3-propylene glycol, 1,4-butanediol, 3-methyl-1,5-pentanediol, 1,6-hexanediol, 1,8-octanediol, 1,10-decanediol, and 1,12-dodecanediol; diols having an oxyalkylene group such as diethylene glycol, triethylene glycol, dipropylene glycol, polyethylene glycol, polypropylene glycol, and polytetramethylene glycol; alicyclic diols such as 1,4-cyclohexane dimethanol, and hydrogenated bisphenol A; alkylene oxide (such as ethylene oxide, propylene oxide, and butylene oxide) adducts of alicyclic diols; bisphenols such as bisphenol A, bisphenol F, and bisphenol S; alkylene oxide (such as ethylene oxide, propylene oxide, and butylene oxide) adducts of bisphenols; etc.

Among these diols, aliphatic diols having 4 to 12 carbon atoms are preferable. These diols can be used alone or in combination.

The dicarboxylic acid for use in preparing the polyester having an active hydrogen group is not particularly limited. For example, aliphatic dicarboxylic acids and aromatic dicarboxylic acids can be used as the dicarboxylic acid. In addition, anhydrides, lower alkyl (C1-3) esters, and halogenated compounds of these dicarboxylic acids can also be used.

Specific examples of the aliphatic dicarboxylic acids include succinic acid, adipic acid, sebacic acid, dodecanedioic acid, maleic acid, fumaric acid, etc.

Among various aromatic dicarboxylic acids, aromatic dicarboxylic acid having 8 to 20 carbon atoms are preferable. Specific examples of the aromatic dicarboxylic acids having 8 to 20 carbon atoms include phthalic acid, isophthalic acid, terephthalic acid, naphthalene dicarboxylic acid, etc.

Among these dicarboxylic acids, aliphatic dicarboxyic acids having 4 to 12 carbon atoms are preferable.

These dicarboxylic acids can be used alone or in combination.

The tri- or more-valent alcohol for use in preparing the polyester having an active hydrogen group is not particularly limited. For example, tri- or more-valent aliphatic alcohols, tri- or more-valent polyphenols, and alkylene oxide adducts of tri- or more-valent polyphenols can be used.

Specific examples of the tri- or more-valent aliphatic alcohols include glycerin, trimethylolethane, trimethylolpropane, pentaerythritol, sorbitol, etc.

Specific examples of the tri- or more-valent polyphenols include trisphenol PA, phenol novolac, cresol novolac, etc.

Specific examples of the alkylene oxide adducts of tri- or more-valent polyphenols include ethylene oxide adducts, propylene oxide adducts, and butylene oxide adducts of tri- or more-valent polyphenols.

The tri- or more-valent carboxylic acid for use in preparing the polyester having an active hydrogen group is not particularly limited. For example, tri- or more-valent aromatic carboxylic acids can be used. In addition, anhydrides, lower alkyl (C1-3) esters, and halogenated compounds of these aromatic carboxylic acids can also be used.

Among these tri- or more-valent aromatic carboxylic acids, tri- or more-valent aromatic carboxylic acids having 9 to 20 carbon atoms are preferable. Specific examples thereof include trimellitic acid, pyromellitic acid, etc.

The polyisocyanate for use in preparing the polyester prepolymer having an isocyanate group is not particularly limited, and for example, diisocyanates and polyisocyanates having three or more isocyanate groups can be used.

Specific examples of the diisocyanates include aliphatic diisocyanates, alicyclic diisocyanates, aromatic diisocyanates, aromatic aliphatic diisocyanates, isocyanurates, and blocked diisocyanates such that these diisocyanates are blocked with a phenol derivative, an oxime, a caprolactam, etc.

Specific examples of the aliphatic diisocyanates include tetramethylene diisocyanate, hexamethylene diisocyanate, 2,6-diisocyanatocaproic acid methyl ester, octamethylene diisocyanate, decamethylene diisocyanate, dodecamethylene diisocyanate, tetradecamethylene diisocyanate, trimethylhexane diisocyanate, tetramethylhexane diisocyanate, etc.

Specific examples of the alicyclic diisocyanates include isophorone diisocyanate, cyclohexylmethane diisocyanate, etc.

Specific examples of the aromatic diisocyanates include tolylene diisocyanate, diisocyanatodiphenyl methane, 1,5-naphthylene diisocyanate, 4,4'-diisocyanatodiphenyl, 4,4'-diisocyanato-3,3'-dimethyldiphenyl, 4,4'-diisocyanato-3-methyldiphenylmethane, 4,4'-diisocyanatodiphenyl ether, etc.

Specific examples of the aromatic aliphatic diisocyanates include $\alpha,\alpha,\alpha',\alpha'$-tetramethylxylylene diisocyanate, etc.

Specific examples of the isocyanurates include tris(isocyanatoalkyl)isocyanurate, tris(isocyanatocycloalkyl)isocyanurate, etc.

These polyisocyanates can be used alone or in combination.

The crosslinking agent reactive with a non-linear reactive precursor is not particularly limited as long as the crosslinking agent can react with such a non-linear reactive precursor as mentioned above and can form a crosslinked polyester resin. For example, compounds having an active hydrogen group can be used.

The active hydrogen group of compounds for use as the crosslinking agent is not particularly limited, and specific examples thereof include hydroxyl groups (such as alcoholic hydroxyl groups and phenolic hydroxyl groups), amino groups, carboxyl groups, mercapto groups, etc. These groups can be used alone or in combination.

The compound having an active hydrogen group for use as the crosslinking agent is not particularly limited, and amine compounds are preferable because a urea bond can be formed thereby.

For example, diamines, polyamines having three or more amino groups, amino alcohols, aminomercaptans, amino acids, and blocked amines can be used as the amine compounds. These can be used alone or in combination. Among these amino compounds, diamines, and combinations of a diamine and a small amount of a polyamine having three or more amino groups are preferable.

Suitable materials for use as the diamines include aromatic diamines, alicyclic diamines, and aliphatic diamines. Specific examples of the aromatic diamines include phenylenediamine, diethyltoluenediamine, 4,4'-diaminodiphenylmethane, etc. Specific examples of the alicyclic diamines include 4,4'-diamino-3,3'-dimethyldicyclohexylmethane, diaminocyclohexane, isophoronediamine, etc. Specific examples of the aliphatic diamines include ethylenediamine, tetramethylenediamine, hexamethylenediamine, etc.

Specific examples of the polyamines having three or more amino groups include diethylenetriamine, triethylenetetramine, etc.

Specific examples of the aminoalcohols include ethanolamine, hydroxyethylaniline, etc.

Specific examples of the aminomercaptans include aminoethylmercaptan, aminopropylmercaptan, etc.

Specific examples of the amino acids include aminopropionic acid, aminocaproic acid, etc.

Specific examples of the blocked amines include ketamine compounds, which are prepared by blocking an amino group with a ketone such as acetone, methyl ethyl ketone, and methyl isobutyl ketone, and oxazoline compounds.

In order that the crosslinked polyester resin has a lower glass transition temperature (Tg) and has such a property as to be deformed at a relatively low temperature, the polyester prepolymer for use in preparing the crosslinked polyester resin preferably includes an aliphatic diol component having 4 to 12 carbon atoms in an amount of 50% by mole or more based on the total moles of the alcohol components included in the prepolymer. When the amount of an aliphatic diol component is less than 50% by mole the resultant crosslinked polyester resin is not easily deformed at a relatively low temperature.

In addition, in order that the crosslinked polyester resin has a lower glass transition temperature (Tg) and has such a property as to be deformed at a relatively low temperature, the crosslinked polyester resin preferably includes an aliphatic diol component having 3 to 10 carbon atoms in an amount of 50% by mole or more based on the total moles of the alcohol components included in the crosslinked polyester resin.

Further, in order that the crosslinked polyester resin has a lower glass transition temperature (Tg) and has such a property as to be deformed at a relatively low temperature, the polyester prepolymer for use in preparing the crosslinked polyester resin preferably includes an aliphatic dicarboxylic acid component having 4 to 12 carbon atoms in an amount of 50% by mole or more based on the total moles of the carboxylic acid components included in the prepolymer. When the amount of an aliphatic acid component is less than 50% by mole, the resultant crosslinked polyester resin is not easily deformed at a relatively low temperature.

The toner of this disclosure preferably has a first glass transition temperature (Tg1st) of from 20° C. to 50° C., which is measured in the first temperature rising process of differential scanning calorimetry (DSC).

A conventional toner having a glass transition temperature (Tg) of not higher than about 50° C. causes an agglomeration problem such that when the toner is transported or preserved in summer or is transported to a tropical region, the toner is agglomerated due to temperature changes, resulting in solidification of the toner in a toner bottle or fixation of the toner to an inside wall or a part of a developing device. In this case, the toner causes problems such that the toner cannot be supplied to a developing device from a toner bottle due to agglomeration of the toner in the toner bottle, and abnormal images are formed due to fixation of the toner to an inside wall or a part of a developing device.

The toner of this disclosure has a relatively low glass transition temperature compared to conventional toners. However, since the crosslinked polyester resin included in the toner of this disclosure has a non-linear molecular structure, the toner of this disclosure can have a good high temperature preservability. In particular, when the crosslinked polyester resin includes a urethane bond or a urea bond, which has a high cohesion force, the toner of this disclosure can have better high temperature preservability.

It is preferable that the first glass transition temperature (Tg1st) of the toner of this disclosure is from 20° C. to 50° C., and the second glass transition temperature (Tg2nd) thereof is from 0° C. to 30° C., which is measured in the second temperature rising process of differential scanning calorimetry (DSC), wherein (Tg1st) is higher than (Tg2nd) (i.e., (Tg1st)>(Tg2nd)).

The difference (Tg1st−Tg2nd) between the first and second glass transition temperatures is not particularly limited, but is preferably not lower than 10° C. and not higher than 50° C.

As mentioned above, the toner of this disclosure includes a block copolymer having a crystalline segment (a) and a non-crystalline segment (b). In this regard, the crystalline polyester resin constituting the crystalline segment (a) is incompatible with the crosslinked polyester resin before the first temperature rising process of DSC, but the crystalline polyester resin and the crosslinked polyester resin are mixed after the first temperature rising process.

When the first glass transition temperature (Tg1st) of the toner is lower than 20° C., the toner often causes problems such that the high temperature preservability of the toner deteriorates, the toner is adhered to a developing device, and a film of the toner is formed on a photoreceptor serving as an image carrier. In contrast, when the first glass transition temperature (Tg1st) is higher than 50° C., the low temperature fixability of the toner tends to deteriorate. When the second glass transition temperature (Tg2nd) is lower than 0° C., the toner often causes a blocking problem in that the fixed toner images (i.e., copy sheets) are adhered to each other, resulting in formation of a block of copy sheets. When the second glass transition temperature (Tg2nd) is higher than 30° C., it becomes hard to impart a good combination of low temperature fixability and glossiness to the toner.

The weight average molecular weight of the crosslinked polyester resin is not particularly limited, but is preferably from 20,000 to 1,000,000, which is measured by gel permeation chromatography (GPC). In this regard, the weight average molecular weight of the crosslinked polyester resin means the weight average molecular weight of a reaction product of the above-mentioned non-crystalline reactive precursor with the above-mentioned crosslinking agent. When the weight average molecular weight is less than 20,000, the toner tends to easily flow at a relatively low temperature, i.e., the toner has poor high temperature preservability. In addition, the melt viscosity of the toner deteriorates, and therefore the hot offset resistance of the toner deteriorates.

The molecular structure of the crosslinked polyester resin can be determined by NMR measurements of a solution or solid of the resin, X-ray diffraction analysis, GC/MS, LC/MS, and IR spectroscopy. Among these methods, the IR spectroscopy method is preferably used as a simple method. In this IR spectroscopy method, a resin, which does not have absorption based on δCH (vending) of olefin to be observed at 965±10 $cm^{-1}$ and 990±10 $cm^{-1}$, can be considered to be a crosslinked polyester resin.

The content of the crosslinked polyester resin in the toner is preferably from 5 to 25 parts by weight, and more preferably from 10 to 20 parts by weight, based on 100 parts by weight of the toner. When the content is less than 5 parts by weight, the low temperature fixability and the hot offset resistance of the toner tend to deteriorate. In contrast, when the content is greater than 25 parts by weight, the high temperature preservability often deteriorates, and the glossiness of fixed toner images often decreases. In other words, when the content falls in the preferable range, a good combination of low temperature fixability, hot offset resistance, and high temperature preservability can be imparted to the toner.

The binder resin of the toner of this disclosure includes the above-mentioned block copolymer and the above-mentioned crosslinked polyester resin as essential components, and optionally includes a crystalline polyester resin.

Since crystalline polyester resins have high crystallinity, the crystalline polyester resins have such a melting property as to sharply decrease viscosity at a melt starting temperature (i.e., fixation starting temperature). By using a crystalline polyester resin having such a melting property as a binder resin in combination with the block copolymer and the crosslinked polyester resin, the resultant toner has good high temperature preservability even when the toner is heated to a temperature just below the melt starting temperature due to the crystallinity of the crystalline polyester resin. In addition, when the toner is heated to the melt starting temperature, the toner sharply decreases viscosity due to melting of the crystalline polyester resin (i.e., the toner has sharp melting property). In this case, the melted crystalline polyester resin is mixed with the blocked copolymer, and the melted crystalline polyester resin and blocked copolymer sharply decrease viscosity thereof, resulting in fixation of the toner. Therefore, the toner has a good combination of high temperature preservability and low temperature fixability. In addition, the toner has a relatively wide fixable temperature range (i.e., wide releasable temperature range), wherein the fixable temperature range means the difference between the lowest fixable temperature and the highest fixable temperature of the toner, above which the hot offset problem is caused.

In this application, "crystalline polyester resin" means a crystalline polyester resin produced by a polyalcohol, and a polycarboxylic acid (including derivatives thereof such as anhydrides and esters).

For example, the above-mentioned polyester prepolymer, and the polyester resin obtained by subjecting the prepolymer to a crosslinking reaction and/or a polymer chain growth reaction are not a crystalline polyester resin.

The polyalcohol for use in preparing the crystalline polyester resin is not particularly limited, and diols and polyols having three or more hydroxyl groups can be used as the polyalcohol.

For example, saturated aliphatic diols (such as saturated linear aliphatic diols and saturated branched aliphatic diols) can be used as the polyalcohol. Among these saturated aliphatic diols, saturated linear aliphatic diols are preferable, and saturated linear aliphatic diols having 2 to 12 carbon atoms are more preferable. When saturated branched aliphatic diols are used, the crystallinity of the resultant crystalline polyester resin tends to decrease, thereby decreasing the melting point of the crystalline polyester resin. In this regard, it is hard to obtain saturated aliphatic diols having greater than 12 carbon atoms. Therefore, the number of carbon atoms of saturated aliphatic diols is preferably not greater than 12.

Specific examples of such saturated aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosanedecanediol, etc.

Among these saturated aliphatic diols, ethylene glycol, 1,4-butanediol, 1,6-hexanediol, 1,8-octanediol, 1,10-decandiol, and 1,12-dodecanediol are preferable because the resultant crystalline polyester resin has high crystallinity and good sharp melting property.

Specific examples of the polyols having three or more hydroxyl groups include glycerin, trimethylol ethane, trimethylol propane, pentaerythritol, etc.

These diols and polyols can be used alone or in combination.

The polycarboxylic acid for use in preparing the crystalline polyester resin is not particularly limited, and dicarboxylic acids and polycarboxylic acids having three or more carboxyl groups can be used as the polycarboxylic acid.

Specific examples of the dicarboxylic acids include saturated aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-decanedicarboxylic acid, 1,14-tetradecanedicarboxylic acid, and 1,18-octadecanedicarboxylic acid; aromatic dicarboxylic acids such as phthalic acid, isophthalic acid, terephthalic acid, naphthalene-2,6-dicarboxylic acid, malonic acid, and mesacnic acid; and anhydrides and lower alkyl (C1-3) esters of these dicarboxylic acids.

Specific examples of such tricarboxylic acids include 1,2,4-benzenetricarboxylic acid, 1,2,5-benzenetricarboxylic acid, 1,2,4-naphthalenetricarboxylic acid, and anhydrides and lower alkyl (C1-3) esters of these tricarboxylic acids.

In this regard, polycarboxylic acids including a sulfonic acid group and/or a double bond can also be used as polycarboxylic acids in addition to the above-mentioned aliphatic and aromatic polycaroxylic acids.

These polycarboxylic acids can be used alone or in combination.

The crystalline polyester resin is preferably a polyester resin prepared by subjecting a saturated linear aliphatic dicarboxylic acid having 4 to 12 carbon atoms and a saturated linear aliphatic diol having 2 to 12 carbon atoms to condensation polymerization. Namely, the crystalline polyester resin preferably includes a unit obtained from a saturated linear aliphatic dicarboxylic acid having 4 to 12 carbon atoms and a unit obtained from a saturated linear aliphatic diol having 2 to 12 carbon atoms. In this case, the resultant crystalline polyester resin has high crystallinity and good sharp melting property, and therefore the resultant toner has good low temperature fixability.

The melting point of the crystalline polyester resin is not particularly limited, and is determined depending on the intended use of the toner. However, the melting point is preferably from 60° C. to 80° C. When the melting point is lower than 60° C., the crystalline polyester tends to melt at a low temperature, resulting in deterioration of the high temperature preservability of the toner. In contrast, when the melting point is higher than 80° C., the crystalline polyester resin is insufficiently melted at a fixing temperature, resulting in deterioration of the low temperature fixability of the toner.

The molecular weight of the crystalline polyester resin is not particularly limited, and is determined depending on the intended use of the toner. Since a crystalline polyester having a sharp molecular weight distribution and a low molecular weight can impart good low temperature fixability to the toner, and a crystalline polyester resin including low molecular weight components in a large amount deteriorates the high temperature preservability of the toner, the weight average molecular weight (Mw) of the crystalline polyester resin is preferably from 3,000 to 30,000, the number average molecular weight (Mn) thereof is preferably from 1,000 to 10,000, and the ratio (Mw/Mn) is preferably from 1.0 to 10. The Mw, Mn, and the ratio Mw/Mn are more preferably from 5,000 to 15,000, from 2,000 to 10,000, and from 1.0 to 5.0, respectively. In this regard, the Mw and Mn of the crystalline polyester resin are measured by subjecting o-dichlorobenzne soluble components of the crystalline polyester resin to GPC.

The acid value of the crystalline polyester resin is not particularly limited, and is determined depending on the intended use of the toner. In order to impart a good combination of affinity for receiving papers and low temperature fixability to the resultant toner, the acid value is preferably not less than 5 mgKOH/g, and more preferably not less than 10 mgKOH/g. In order to impart good hot offset resistance to the toner, the acid value is preferably not greater than 45 mgKOH/g.

The hydroxyl value of the crystalline polyester resin is not particularly limited, and is determined depending on the intended use of the toner. In order to impart a good combination of low temperature fixability and charging property to the resultant toner, the hydroxyl value is preferably from 0 to 50 mgKOH/g, and more preferably from 5 to 50 mgKOH/g.

The molecular structure of the crystalline polyester resin can be determined by NMR measurements of a solution or solid of the resin, X-ray diffraction analysis, GC/MS, LC/MS, and IR spectroscopy. Among these methods, the IR spectroscopy method is preferably used as a simple method. In this IR spectroscopy method, a resin, which has absorption based on δCH (vending) of olefin to be observed at 965±10 $cm^{-1}$ and 990±10 $cm^{-1}$, can be considered to be a crystalline polyester resin.

The content of the crystalline polyester resin in the toner is preferably from 3 to 20 parts by weight, and more preferably from 5 to 15 parts by weight, based on 100 parts by weight of the toner. When the content is less than 3 parts by weight, it is often hard for the crystalline polyester resin to impart good sharp melting property to the toner. In contrast, when the content is greater than 20 parts by weight, the high temperature preservability of the toner often deteriorates, and the toner often causes background development in that background of images is soiled with the toner. In other words, when the content falls in the preferable range, the resultant toner has good low temperature fixability, and can produce high quality images.

The present inventors discover that when the binder resin included in toner has a configuration such that a portion, which has a large phase difference and can effectively act on stress relaxation property while enhancing toughness of the toner and which is observed as the above-mentioned first phase difference image, is finely dispersed in another portion, which has a small phase difference and which is observed as the above-mentioned second phase difference image, establishment of the trade-off relation between toughness and relaxation property of the binder resin can be prevented.

Specifically, the crosslinked polyester resin, the non-crystalline segment (b) of the blocked copolymer, and the crystalline segment (a) of the blocked copolymer are observed using an atomic force microscope (AFM) in the tapping mode under the below-mentioned conditions. In this regard, the following relationships (2) and (3) are preferably satisfied.

$$Ta \geq Tc > Tb \quad (2), \text{ and}$$

$$Tc - Tb \geq 5 \quad (3),$$

wherein Tc represents the phase (degree) of the probe of the AFM when the crosslinked polyester resin is observed, Tb represents the phase (degree) of the probe of the AFM when the non-crystalline segment (b) of the block copolymer is observed, and Tc represents the phase (degree) of the probe of the AFM when the crystalline segment (a) of the block copolymer is observed.

[Conditions of Tapping Mode]

Cantilever: A Si probe is used.

Resonance frequency: 300 kHz

Spring constant: 42N/m

As mentioned above, when the crosslinked polyester resin, the non-crystalline segment (b) of the block copolymer, and the crystalline segment (a) of the block copolymer are incompatible with each other, a sea-island structure in which the crosslinked polyester resin is present like an island in a sea of the non-crystalline segment of the block copolymer is formed.

In this regard, when the probe of the AFM in the tapping mode (under conditions of 300 kHz in resonance frequency, and 42N/m in spring constant) is vibrated under a certain condition, the phase Tc of the probe in observation of the crosslinked polyester resin is preferably greater than the phase Tb of the probe in observation of the non-crystalline segment (b) (i.e., Tc>Tb).

This means that the crosslinked polyester resin achieves a softer state than the non-crystalline segment (b) of the block copolymer. In this case, the crosslinked polyester resin achieving an island state is protected by the non-crystalline segment (b) of the block copolymer under a condition in which a certain pressure is not applied, and therefore the crosslinked polyester resin does not flow.

However, when a pressure and a heat are applied thereto in the fixing process, the crosslinked polyester resin and the non-crystalline segment (b) behave in such a manner as to be mixed with each other. Therefore, the toner can be fixed at a relatively low temperature. In addition, when the phase difference (Tc−Tb) is not less than 5 ((Tc−Tb)≥5), a clear sea-island structure can be formed, and thereby good high temperature preservability can be imparted to the toner.

Thus, by combining the crosslinked polyester resin, which has high melt viscosity and is hard to flow, with the non-crystalline segment (b) of the block copolymer in such a manner that the crosslinked polyester resin and the non-crystalline segment (b) have a microscopic phase separation structure, it becomes possible to impart a good combination of high temperature preservability, hot offset resistance and low temperature fixability to the toner even when the glass transition temperature of the toner is relatively low.

Next, the phase of the probe of the AFM in the tapping mode in observation of a resin will be described.

When observing a resin in a toner with the AFM in the tapping mode, a sample is prepared from a torn surface of the toner, and the torn surface is observed with the AFM. The procedure for preparation of the sample is the following.

(1) After a toner is subjected to Ru block dyeing, the toner is embedded in an epoxy resin.

(2) The toner is cut by an ultrasonic microtome so as to have a thickness of 100 nm.

(3) The cut toner is mounted on a silicon wafer.

In this regard, the toner is cut such that the area of the cross-section is maximized.

The above-mentioned phase image is obtained by cutting a block of a toner or a resin for toner using an ultramicrotome ULTRACUT UCT from Leica Camera AG and then observing the cross-section of the toner or the resin. The cutting conditions are the following.

Thickness of cut sample: 60 nm
Cutting speed: 0.4 mm/s
Cutter used: Diamond knife (ULTRA SONIC 35°)

The observation conditions are the following.

Instrument used: Intermolecular force probe microscopic system from Asylum Technology
Cantilever used: OMCL-AC240TS-C2 (Probe: Si probe, Resonance frequency: 300 kHz (Typ.), Spring constant: 42N/m (Typ.))
Measurement mode: Tapping mode
Target amplitude: 0.5V
Target percent: −5%
Amplitude setpoint: 193-241 mV
Scan rate: 0.5 Hz
Scan points: 256×256

In this regard, measurement is performed by setting the scanning range such that the entire surface of the sample (a particle) can be scanned. In this application, a phase image of a portion with a size of 10 μm×10 μm is obtained.

In a phase image, a portion having a relatively large phase value is a relatively soft portion.

Next, the property of toner or resin determined by the observation using the AFM will be described.

It is preferable that the resin used for the toner of this disclosure has a configuration (i.e., dispersed structure) such that a binarized image obtained by subjecting the phase image obtained by the AFM in the tapping mode to a binarizing processing using the intermediate value between the maximum value and the minimum value of the phase difference of the phase image has a first phase difference image (i.e., a first portion) having a relatively large phase difference and a second phase difference image (i.e., a second portion) having a relatively small phase difference, wherein the first phase difference image is dispersed in the second phase difference image. In addition, the average of the Feret diameter (max) of the first phase difference image (i.e., diameter of the dispersed first phase difference image) is preferably not greater than 100 nm, and more preferably from 10 nm to 100 nm.

The diameter of the dispersed first phase difference image of the toner of this disclosure is preferably not greater than 100 nm, and more preferably from 10 nm to 100 nm.

In this regard, formation of the above-mentioned structure such that the first phase difference image is dispersed in the second phase difference image means that in the above-mentioned binarized image, domains have defined borders, and the Feret diameter of the dispersed first phase difference image can be determined. When the diameter of the phase difference image (first phase difference image) is small and it is hard to judge whether the phase difference image in the binarized image is a noise or a first phase difference image or it is hard to determine the Feret diameter of the phase difference image, it is judged that sample does not have the dispersed structure mentioned above. When boundaries of domains cannot be clarified due to image noises, the Feret diameter cannot be determined.

When the domains have a stripe shape and the Feret diameter (max) thereof is not less than 300 nm, Feret diameter (min) is used as the domain diameter instead of the Feret diameter (max).

In order to enhance the toughness of the binder resin, it is preferable that the resin has a structure such that the inner portion of the resin relaxes the deformation of the outer portion or the pressure applied form outside. Therefore, it is preferable that the inner portion of the resin has a softer structure. However, in this case, problems such that toner particles are agglomerated (i.e., blocking of toner particles occurs) when the toner is preserved; and toner images are easily damaged and are adhered to parts of image forming apparatus are often caused. Therefore, it is necessary to prevent establishment of a trade-off relationship between toughness of toner and relaxation property of the toner.

The spin-spin relaxation time of the toner measured by pulse NMR preferably satisfies the following conditions.

Spin-spin relaxation time of the toner at 50° C. measured by a solid echo method using pulse NMR (i.e., t50): not greater than 1.0 ms
Spin-spin relaxation time of the toner at 130° C. measured by heating the toner from 50° C. to 130° C. (i.e., t130): not less than 10 ms
Spin-spin relaxation time of the toner at 70° C. measured by cooling the toner from 130° C. to 70° C. (i.e., t'70): not greater than 3.0 ms Next, the property of toner or resin determined by the pulse NMR will be described.

One of the points of the toner of this disclosure is to use a technique that by chemically bonding a crystalline segment (a) with a non-crystalline segment (b) while controlling the structures of the segments (a) and (b), the molecular movement of the crystalline segment (a) is restricted. In this regard, it is preferable to quantify the molecular movement by using pulse NMR.

The pulse NMR methods do not provide chemical shift information unlike high resolution NMR methods, but can rapidly measure the relaxation time of the $^{1}H$ core (i.e., spin-lattice relaxation time (T1 ) and spin-spin relaxation time (T2 )), which closely relates to the molecular movement. Therefore, the pulse NMR methods have been broadly used recently. Specific examples of the pulse NMR methods include a Hahn echo method, a solid echo method, a CPGM (Carr/Purcell/Maiboom/Gill) method, and a 90° pulse method. Any one of these methods can be preferably used.

Since the toner of this disclosure and the resins (such as the block copolymer and the crosslinked polyester resin) used as the binder resin of the toner have a medium spin-spin relaxation time (T2 ), the Hahn echo method is suitable. In general, the solid echo method and the 90° pulse method are suitable for measuring a relatively short spin-spin relaxation time (T2 ), the Hahn echo method is suitable for measuring a medium spin-spin relaxation time (T2 ), and the CPMG method is suitable for measuring a relatively long spin-spin relaxation time (T2 ).

In this disclosure, the spin-spin relaxation time at 50° C. (t50) is used as an index of the molecular movement, which relates to the preservation stability of toner (or resin). In addition, the spin-spin relaxation time at 130° C. (t130) is used as an index of the molecular movement in the fixing process. Further, the spin-spin relaxation time at 70° C. (t'70) measured when the temperature is dropped from 130° C. to 70° C. is used as an index of the molecular movement, which relates to rub resistance of the toner in the fixed toner image feeding process.

When these relaxation times (t50, t130 and t'70) of the toner fall in specific ranges, the toner can have sufficient molecular movement for the fixing process, in which it is necessary for the toner to have fluidity, while having restricted molecular movement during storage and in the fixed toner image feeding process, in which it is not necessary for the toner to have fluidity.

Next, the relaxation times (t50, t130 and t'70) of the toner will be described.

The relaxation time t50, which is an index of the molecular movement of the toner concerning the preservation stability, is preferably not greater than 1.0 ms. When the relaxation time t50 is greater than 1.0 ms, the molecular movement of the resin of the toner at 50° C. is active, and thereby the toner is easily deformed or agglomerated by an external force, resulting in occurrence of problems during storage in summer or in oversea transportation in summer.

The relaxation time t130, which is an index of the molecular movement of the toner concerning the fixing property, is preferably not less than 10 ms. When the relaxation time t130 is less than 10 ms, the toner has insufficient molecular movement when the toner is heated, resulting in deterioration of fluidity and deforming property of the toner using the resin. In this case, the spreading property of the toner deteriorates, and the toner is insufficiently bonded with a recording medium, thereby causing image quality problems such that the glossiness of fixed toner images decreases, and fixed toner images are peeled from a recording medium.

The relaxation time t'70, which is an index of the molecular movement of the toner concerning the rub resistance of fixed toner images in the fixed toner image feeding process, is preferably not greater than 3.0 ms. When the relaxation time t'70 is greater than 3.0 ms, fixed toner images are contacted with or rubbed by rollers and feeding members of image forming apparatus in the fixed toner image feeding process (i.e., copy discharging process) before the molecular movement of the toner is fully restricted, thereby causing image quality problems such that the glossiness of fixed toner images changes, and fixed toner images are damaged (scratched).

Next, the relaxation times (t50, t130 and t'70) of the binder resin of the toner (i.e., the block copolymer, the crosslinked polyester, etc.) will be described.

The relaxation time t50 of the binder resin, which is an index of the molecular movement of the binder resin concerning the preservation stability, is preferably not greater than 2.0 ms. When the relaxation time t50 is greater than 2.0 ms, the molecular movement of the toner using the binder resin at 50° C. is active, and thereby the toner is easily deformed or agglomerated by an external force, resulting in occurrence of problems during storage in summer or in oversea transportation in summer.

The relaxation time t130 of the binder resin, which is an index of the molecular movement of the binder resin concerning the fixing property, is preferably not less than 8.0 ms. When the relaxation time t130 is less than 8.0 ms, the toner using the resin has insufficient molecular movement when the toner is heated, resulting in deterioration of fluidity and deforming property of the toner using the binder resin. In this case, the spreading property of the toner deteriorates, and the toner is insufficiently bonded with a recording medium, thereby causing image quality problems such that the glossiness of fixed toner images decreases, and fixed toner images are peeled from a recording medium.

The relaxation time t'70 of the binder resin, which is an index of the molecular movement of the binder resin concerning the rub resistance of the toner using the binder resin in the fixed toner image feeding process, is preferably not greater than 3.0 ms. When the relaxation time t'70 is greater than 3.0 ms, fixed toner images are contacted with or rubbed by rollers and feeding members of image forming apparatus in the fixed toner image feeding process (i.e., copy discharging process) before the molecular movement of the toner is fully restricted, thereby causing image quality problems such that the glossiness of fixed toner images changes, and fixed toner images are damaged (scratched).

The relaxation time t50 of the binder resin is more preferably not greater than 1.0 ms.

The relaxation time t130 of the binder resin is more preferably from 10.0 ms to 17.0 ms.

The relaxation time t'70 of the binder resin is more preferably not less than 1.0 ms.

The method for determining the relaxation times using the pulse NMR method will be described.

The measurement using the pulse NMR method can be performed, for example, by using an instrument, MINISPEC-MQ20 from Bruker Optics K.K. In the below-mentioned examples, this instrument is used. The measuring method is the following.

Specifically, $^{1}H$ NMR is used, and the resonance frequency and the measurement interval are 19.65 MHz, and 5 seconds, respectively. The relaxation time t50 is measured from the attenuation curve obtained from the pulse sequence (90° x-Pi-180° x) of the solid echo method, and the relaxation times t130 and t'70 are measured from the attenuation curve obtained from the pulse sequence (90° x-Pi-180° x) of the Hahn echo method. In this regard, the measurement is performed under the following conditions.

Pi: 0.01 ms-100 ms

Number of points: 100

Cumulated number: 32

Measurement temperature: 50° C.→130° C.→70° C.

Initially, 0.2 g of a sample (i.e., toner or resin) is fed into a special sample tube, and the sample tube is inserted into the instrument to an extent such that the magnetic field falls in a proper range, followed by measurement. By performing this measurement, the spin-spin relaxation time at 50° C. (t50), the spin-spin relaxation time at 130° C. (t130), and the spin-spin relaxation time (t'70) measured at 70° C. when the temperature is dropped from 130° C. to 70° C. can be determined.

In addition to the binder resin mentioned above, the toner of this disclosure can include other components such as a release agent, a colorant, a charge controlling agent, an external additive, a fluidity improver, a cleanability improver, and a magnetic material.

The release agent is not particularly limited, and any known release agents can be used.

For example, natural waxes, synthesized waxes, amide compounds, low molecular weight crystalline polymers, etc. can be used as the release agent.

Specific examples of the natural waxes include vegetable waxes such as carnauba waxes, cotton waxes, Japan waxes, and rice waxes; animal waxes such as bees waxes, and lanolin; mineral waxes such as ozocerite and ceresin; and petroleum waxes such as paraffin waxes, microcrystalline waxes, and petrolatum.

Specific examples of the synthesized waxes include synthesized hydrocarbon waxes such as Fischer Tropsch waxes, polyethylene waxes, polypropylene waxes, and chlorinated hydrocarbons; and other synthesized waxes such as ester waxes, ketone waxes, and ether waxes.

Specific examples of the amide compounds include aliphatic amide compounds such as 12-hydroxystearamide, stearamide, and phthalic anhydride imide.

Specific examples of the crystalline polymers include low molecular weight crystalline polymers such as acrylic homopolymers or copolymers, e.g., poly-n-stearyl methacrylate, and poly-n-lauryl methacrylate; and crystalline polymers having a long alkyl group in a side chain thereof.

Among these, hydrocarbon waxes such as paraffin waxes, microcrystalline waxes, Fischer Tropsch waxes, polyethylene waxes, and polypropylene waxes are preferable.

The melting point of the release agent for use in the toner of this disclosure is not particularly limited, but is preferably from 60° C. to 80° C. When the melting point is lower than 60° C., the release agent melts at a low temperature, and therefore the high temperature preservability of the toner tends to deteriorate. In contrast, when the melting point is higher than 80° C., the release agent does not fully melt even when the toner is heated to a temperature in a fixing temperature range and the resin in the toner melts, thereby causing the offset problem, resulting in formation of defective images.

The content of the release agent in the toner is preferably from 2 to 10 parts by weight, and more preferably from 3 to 8 parts by weight, based on 100 parts by weight of the toner. When the content is less than 2 parts by weight, the hot offset resistance and the low temperature fixability of the toner tend to deteriorate. In contrast, when the content is greater than 10 parts by weight, the high temperature preservability of the toner tends to deteriorate and the background development problem in that the background of images is soiled with the toner tends to be caused. In other words, when the content falls in the preferable range, the toner can produce high quality images while having good fixing stability.

Next, the colorant optionally included in the toner will be described. Suitable materials for use as the colorant include known dyes and pigments. Specific examples of such dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials can be used alone or in combination.

The content of the colorant in the toner is preferably from 1 to 15 parts by weight, and more preferably from 3 to 10 parts by weight, based on 100 parts by weight of the toner.

Master batches, which are complexes of a colorant and a resin, can also be used as the colorant of the toner. Specific examples of the resins for use in the master batches include the above-mentioned crosslinked polyester resins; styrene polymers and substituted styrene polymers such as polystyrene, poly-p-chlorostyrene and polyvinyl toluene; copolymers of styrene and substituted styrene such as styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleate copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic acid resins, rosin, modified rosins, terpene resins, aliphatic or alicyclic hydrocarbon resins, aromatic petroleum resins, chlorinated paraffin, paraffin waxes, etc. These resins can be used alone or in combination.

Such master batches can be prepared by mixing a resin and a colorant, and kneading the mixture while applying a high shearing force thereto. In this case, an organic solvent can be added to enhance the interaction between the colorant and the resin. In addition, a flushing method, in which an aqueous paste including a colorant and water is mixed with a resin dissolved in an organic solvent, the mixture is kneaded to transfer the colorant from the aqueous phase to the resin (i.e., the oil phase), and then water and the organic solvent are removed from the kneaded mixture, can be preferably used because the resultant wet cake can be used without being dried. When performing the mixing and kneading process, dispersing devices capable of applying a high shearing force such as three roll mills can be preferably used.

Next, the charge controlling agent optionally included in the toner will be described. Any known charge controlling agents can be used for the toner. Suitable materials of such charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, and metal salts of salicylic acid derivatives.

Specific examples of the marketed charge controlling agents include BONTRON 03 (Nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; LRA-901, and LR-147 (boron complex), which are manufactured by Japan Carlit Co., Ltd., copper phthalocyanine, perylene, quinacridone, azo pigments, polymer compounds having a functional group such as sulfonate groups, carboxylate groups, and quaternary ammonium groups, etc. These materials can be used alone or in combination.

The content of the charge controlling agent is not particularly limited, and is properly determined based on the intended use of the toner. However, the content of the charge controlling agent is preferably from 0.1 to 10 parts by weight, and more preferably from 0.2 to 5 parts by weight, based on 100 parts by weight of the toner. When the content is greater than 10 parts by weight, the charging property of the toner is excessively enhanced, thereby excessively increasing the electrostatic attraction between the toner and a developing roller, resulting in deterioration of fluidity of the toner (developer) and decrease of image density.

The charge controlling agent can be melted and dispersed in a melted/kneaded mixture of a colorant (master batch) and a binder resin. Alternatively, another method in which the charge controlling agent is dissolved in an organic solvent, and the solution is mixed with other components such as a colorant and a binder resin when the components are dispersed or dissolved in a solvent can also be used. In addition, a method in which after toner particles are prepared, the charge controlling agent is fixed to the surface of the toner particles can also be used.

Next, the external additive optionally included in the toner will be described.

Particulate materials such as particulate oxides, particulate inorganic materials, and hydrophobized particulate inorganic materials can be used as the external additive. Among these particulate materials, hydrophobized particulate inorganic materials having an average primary particle diameter of from 1 nm to 100 nm, and preferably from 5 nm to 70 nm, are preferable.

In addition, it is preferable to use, as the external additive, a combination of at least one hydrophobized particulate inorganic material having an average primary particle diameter of not greater than 20 nm and at least one hydrophobized particulate inorganic material having an average primary particle diameter of not less than 30 nm.

The BET specific surface area of the external additive is preferably from 20 to 500 $m^2/g$.

Specific examples of the external additive include particulate silica, hydrophobized silica, fatty acid metal salts (e.g., zinc stearate, and aluminum stearate), metal oxides (e.g., titania, alumina, tin oxide, and antimony oxide), and fluoropolymers.

Hydrorphobized silica, titania (titanium oxide), and alumina are preferably used as the external additive. Specific examples of marketed products of the particulate silica include R972, R974, RX200, RY200, R202, R805 and R812, which are from Nippon Aerosil Co. Specific examples of marketed products of the particulate titania include P-25 from Nippon Aerosil Co.; STT-30 and STT-65C-S, which are from Titan Kogyo K.K.; TAF-140 from Fuji Titanium Industry Co., Ltd.; and MT-150W, MT-500B, MT-600B, and MT-150A, which are from Tayca Corp.

Specific examples of marketed products of the hydrophobized particulate titanium oxide include T-805 from Nippon Aerosil Co.; STT-30A and STT65S-S, which are from Titan Kogyo K.K.; TAF-500T and TAF-1500T, which are from Fuji Titanium Industry Co., Ltd.; MT-100S and MT-100T, which are from Tayca Corp.; and IT-S from Ishihara Sangyo Kaisha Ltd.

Specific example of the method for hydrophobizing a particulate material such as silica, titania and alumina include a method including treating a particulate material (hydrophilic material) with a silane coupling agent such as methyl trimethoxysilane, methyl triethoxysilane, and octyl trimethoxysilane, and a method including treating an inorganic material (such as oxides) with a silicone oil upon application of heat thereto.

Specific examples of the silicone oil for use in the hydrophobizing treatment include dimethyl silicone oil, methylphenyl silicone oil, chlorophenyl silicone oil, methylhdyrodiene silicone oil, alkyl-modified silicone oil, fluorine-modified silicone oil, polyether-modified silicone oil, alcohol-modified silicone oil, amino-modified silicone oil, epoxy-modified silicone oil, epoxy/polyether-modified silicone oil, phenolic-modified silicone oil, carboxylate-modified silicone oil, mercapto-modified silicone oil, methacryl-modified silicone oil, and α-methyl styrenemodified silicone oil.

Specific examples of the inorganic materials for use as the external additive include silica, alumina, titanium oxide, barium titanate, magnesium titanate, calcium titanate, strontium titanate, iron oxide, copper oxide, zinc oxide, tin oxide, silica sand, clay, mica, wollastonite, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among these, silica and titanium dioxide are particularly preferable.

The content of an external additive in the toner is not particularly limited, but is preferably from 0.1 to 5 parts by weight, and more preferably from 0.3 to 3 parts by weight, based on 100 parts by weight of the toner.

When a particulate inorganic material is used as the external additive, the average primary particle diameter thereof is preferably not greater than 100 nm, and more preferably from 3 nm to 70 nm. When the average primary particle diameter is less than the range, the particulate inorganic material tends to be embedded into toner particles, and thereby the function of the particulate inorganic material cannot be fully achieved. In contrast, when the average primary particle diameter is greater than the range, a problem in that the surface of a photoreceptor contacted with the toner is damaged by the inorganic material tends to be caused.

The toner of this disclosure can include a fluidity improver to improve the fluidity and charging property of the toner under high humidity conditions. The fluidity improver is not particularly limited as long as the fluidity improver can be used for a surface treatment to enhance the hydrophobicity of the toner. Specific examples of the materials for use as the fluidity improver include silane coupling agents, silylating agents, silane coupling agents having a fluoroalkyl group, organic titanate coupling agents, aluminum coupling agents, silicone oils, and modified silicone oils. Hydrophobized silica and titanium oxide, which are subjected to a surface treatment using such a fluidity improver to enhance hydrophobicity thereof, are preferably used as an external additive.

The cleanability improver to be optionally included in the toner is not particularly limited as long as the toner including the cleanability improver and remaining on image carriers such as photoreceptors and transfer media can be easily removed therefrom. Specific examples of the materials for use as the cleanability improver include fatty acids and metal salts thereof such as stearic acid, zinc stearate, and calcium stearate; and particulate polymers such as polymethyl methacrylate, and polystyrene, which are prepared by a soap-free emulsion method. In this regard, particulate polymers, which have a relatively narrow particle diameter distribution and which have a volume average particle diameter of from 0.01 μm to 1 μm, are preferable.

The magnetic material to be optionally included in the toner is not particularly limited, and a proper magnetic material is selected depending on the intended use of the toner. Specific examples thereof include iron powders, magnetite and ferrite. Among these, white magnetic materials are preferable so that the color tone of the toner is not changed by the magnetic material used.

The volume average particle diameter (Dv) of the toner is not particularly limited, and is properly determined depending on the intended use of the toner. However, the volume average particle diameter is preferably from 3 μm to 7 μm. Further, the ratio (Dv/Dn) of the volume average particle diameter (Dv) of the toner to the number average particle diameter (Dn) thereof is preferably not greater than 1.2. Furthermore, the toner preferably includes toner particles having a volume particle diameter of not greater than 2 μm in an amount of from 1% to 10% by number.

Next, methods for measuring properties of the toner and toner constituents will be described.

The solubility parameter (SP), glass transition temperature (Tg), acid value, hydroxyl value, molecular weight and melting point of each of the toner constituents, i.e., the crosslinked polyester resin, the non-crystalline segment (b) and the crystalline segment (a) of the block copolymer, and the release agent may be measured to determine their own properties. In addition, it is possible to separate (extract) each of the toner constituents from the toner by using a method such as gel permeation chromatography (GPC), followed by measurements of the properties, and calculation of the weight ratio of each of the constituents.

The procedure of the separation method using GPC is the following.

In the GPC measurement using tetrahydrofuran (THF) as the mobile phase, dividing is performed on the eluate using a fraction collector or the like to obtain a fraction having a molecular weight corresponding to an area of the elution curve in the desired molecular weight range.

After the thus obtained fraction is condensed and dried using an evaporator, the resultant solid is dissolved in a deuterated solvent such as deuterated chloroform and deuterated THF to perform the $^{1}$H-NMR measurement on the solution. Next, the ratios of the constituent monomers of the resin in the eluate are determined by calculation based on the integral ratio of each element.

In addition, it is possible to use another method in which after the eluate is condensed, the eluate is subjected to hydrolysis using sodium hydroxide or the like, and the decomposition product is subjected to a qualitative/quantitative analysis such as high-performance liquid chromatography (HPLC) to determine the ratios of the constituent monomers of the resin.

When the toner is prepared by a method including subjecting the non-linear reactive precursor and the crosslinking agent mentioned above to a polymer chain growth reaction and/or a crosslinking reaction to prepare a crosslinked polyester resin while forming the main body of the toner (mother toner particles), a method in which the crosslinked polyester resin is separated from the toner by GPC, etc., and the properties of the resin such as Tg are measured may be used. In addition, it is possible to use a method in which the non-linear reactive precursor and the crosslinking agent mentioned above is subjected to a polymer chain growth reaction and/or a crosslinking reaction to prepare a crosslinked polyester resin, and the properties of the resin such as Tg are measured.

Next, an example of the method for use in separating the toner constituents in the analysis of the toner will be described in detail.

Initially 1 g of a sample (toner) is fed into 100 ml of tetrahydrofuran (THF), and the mixture is agitated for 30 minutes at a temperature of 25° C. to obtain a solution in which soluble components of the sample are dissolved.

The solution is filtered using a membrane filter with openings of 0.2 μm to obtain THF-soluble components of the toner.

Next, the THF-soluble components are dissolved in THF to prepare a sample for GPC, and the sample is injected into a gel permeation chromatographic apparatus to determine the molecular weight of each of the resins.

In this measurement, a fraction collector is set to the exit (exit of eluate) of the GPC apparatus to separate portions of the eluate having predetermined counts from the start of elution in such a manner that each of the portions has an area of 5% in the elution curve.

Next, 30 mg of each of the fractions is dissolved in 1 ml of deutrated chloroform while adding a reference, tetramethyl silane (TMS) in an amount of 0.05% by volume, thereto.

The solution is contained in a glass tube for NMR measurement with a diameter of 5 mm, and the NMR measurement is performed using an instrument JNM-AL400 from Jeol Ltd. under conditions of 23° C. to 25° C. in temperature, and 128 times in integration number, to obtain a spectrum.

The monomers of the crosslinked polyester resin and the block copolymer included in the toner, and the ratios of the monomers can be determined based on the integral ratios (area ratios) of the peaks thereof in the spectrum.

For example, the group corresponding to a peak is determined as follows.

- Peak in the vicinity of 8.25 ppm: Benzene ring of trimellitic acid (for one hydrogen atom)
- Peak in the vicinity of from 8.07 to 8.10 ppm: Benzene ring of terephthalic acid (for four hydrogen atoms)
- Peak in the vicinity of from 7.1 to 7.25 ppm: Benzene ring of bisphenol A (for four hydrogen atoms)
- Peak in the vicinity of 6.8 ppm: Benzene ring of bisphenol A (for four hydrogen atoms), and double bond of fumaric acid (for two hydrogen atoms)
- Peak in the vicinity of from 5.2 to 5.4 ppm: Methine group of propylene oxide adduct of bisphenol A (for one hydrogen atom)
- Peak in the vicinity of from 3.7 to 4.7 ppm: Methine group of propylene oxide adduct of bisphenol A (for two hydrogen atoms), and methylene group of ethylene oxide adduct of bisphenol A (for four hydrogen atoms)
- Peak in the vicinity of 1.6 ppm: Methyl group of bisphenol A (for six hydrogen atoms)

It can be determined from these results of the above-mentioned separation and identification operations that the extract collected from a fraction including the crosslinked polyester resin in an amount of not less than 90% can be used as the crosslinked polyester resin. Similarly, the extract collected from a fraction including the block copolymer in an amount of not less than 90% can be used as the block copolymer.

The hydroxyl value can be measured by the method described in JIS K0070-1996. Specifically, 0.5 g of a sample is precisely weighed in a 100 ml measuring flask, and 5 ml of an acetylating agent is added thereto. Next, the flask is heated for 1 to 2 hours in a hot bath heated to 100±5° C., and the flask is then taken out of the hot bath to be cooled. Further, water is added to the flask, and the mixture is shaken to decompose acetic anhydride. Next, in order to perfectly decompose acetic anhydride, the flask is heated in a hot bath for 10 minutes or more, followed by cooling, and the inner wall of the flask is washed with an organic solvent. Further, by using a potentiometric automatic titrator DL-53 and an electrode DG113-SC, which are from METTLER TOLEDO International Inc., the hydroxyl value is measured at 23° C., followed by analysis using analysis software LABX LIGHT VERSION 1.00.000. When performing calibration on the instrument, a mixture solvent of 120 ml of toluene and 30 ml of ethanol is used. In this regard, the measuring conditions are as follows.

- Stir
  - Speed: 25%
  - Time: 15 s
- EQP Titration
  - Titration/Sensor
    - Titrant: $CH_3ONa$
    - Concentration: 0.1 mole/l
    - Sensor: DG115
    - Unit of measurement: mV
  - Predispensing to Volume
    - Volume: 1.0 ml
    - Wait time: 0 s
  - Titrant Addition: Dynamic
    - dE (set): 8.0 mV
    - dV (min): 0.03 ml
    - dV (max): 0.5 ml
  - Measure Mode: Equilibrium Controlled
    - dE: 0.5 mV
    - dt: 1.0 s
    - t (min): 2.0 s
    - t (max): 20.0 s
  - Recognition
    - Threshold: 100.0
    - Steepest jump only: No
    - Range: No
    - Tendency: None
  - Termination
    - at maximum volume: 10.0 ml
    - at potential: No
    - at slope: No
    - after number EQPs: Yes
      - n=1
    - comb. termination conditions: No
  - Evaluation
    - Procedure: Standard
    - Potential 1: No
    - Potential 2: No
    - Stop for reevaluation: No The acid value can be measured by the method described in JIS K0070-1992.

Specifically, 0.5 g of a sample (0.3 g when an ethyl acetate-soluble component is used as the sample), which is precisely weighed, is added to 120 ml of toluene, and the mixture is agitated for about 10 hours at 23° C. to prepare a solution of the sample. Next, 30 ml of ethanol is added to the solution to prepare a sample solution. If the sample is not dissolved in the solvents, another solvent such as dioxane and tetrahydrofuran is used.

The acid value of the sample is measured at 23° C. by using a potentiometric automatic titrator DL-53 and an electrode DG113-SC, which are from METTLER TOLEDO International Inc., followed by analysis using analysis software LABX LIGHT VERSION 1.00.000. When performing calibration on the instrument, a mixture solvent of 120 ml of toluene and 30 ml of ethanol is used. In this regard, the measuring conditions are the same as those mentioned above in the measurement of the hydroxyl value.

In the measurement of the acid value, titration is performed using a 0.1N alcohol solution of potassium hydroxide, whose concentration is preliminarily determined precisely, and the acid value of the sample can be determined from the following equation.

$$\text{Acid value (mgKOH/g)} = V\ (\text{ml}) \times N \times 56.1\ (\text{mg/ml}) / W\ (\text{g}),$$

wherein V represents the volume of the 0.1N alcohol solution of potassium hydroxide used for the titration, W represents the weight of the sample, and N represents the factor of the 0.1N alcohol solution of potassium hydroxide.

Next, the method for measuring the melting point, and the glass transition temperature (Tg) will be described.

In this application, the melting point, and the glass transition temperature (Tg) are measured by using a differential scanning calorimeter (DSC system), Q-200 from TA Instruments.

The procedure for measurement of the melting point and the glass transition temperature (Tg) using the instrument are the following.

Specifically, about 5.0 g of a sample is contained in the aluminum sample container. After the sample container is set on the holder unit, the holder unit is set in the electric furnace. In a nitrogen atmosphere, the sample is heated from −80° C. to 150° C. at a temperature rising speed of 10° C./m (this is the first heating process). Next, the sample is cooled from 150° C. to −80° C. at a cooling speed of 10° C./m, and then the sample is heated again from −80° C. to 150° C. at a temperature rising speed of 10° C./m (this is the second heating process). The DSC curves obtained in the first and second heating processes of the instrument (i.e., Q-200 from TA Instruments) are analyzed to determine the melting point and the glass transition temperature (Tg) of the sample.

The thus obtained DSC curves are analyzed using the analysis program of the DSC system Q-200. Specifically, the first glass transition temperature of the sample can be determined from the DSC curve obtained in the first heating process, and the second glass transition temperature of the sample can be determined from the DSC curve obtained in the second heating process.

In addition, the melting point of the sample can be determined as the peak temperature of the endothermic peak of the DSC curve obtained in the first heating process by using the analysis program of the DSC system Q-200. In addition, the melting point of the sample can be determined as the peak temperature of the endothermic peak of the DSC curve obtained in the second heating process by using the analysis program.

In this application, the first glass transition temperature of a toner determined from the DSC curve obtained in the first heating process is referred to as a first glass transition temperature (Tg1st), and the second glass transition temperature of the toner determined from the DSC curve obtained in the second heating process is referred to as a second glass transition temperature (Tg2nd).

In addition, in this application, the melting point (Tm) and the glass transition temperature (Tg) of each of the crosslinked polyester resin, the non-crystalline segment (b) of the block copolymer, and other toner constituents such as the release agent mentioned above are respectively the peak temperature of the endothermic peak of the DSC curve obtained in the second heating process, and the second glass transition temperature determined from the DSC curve obtained in the second heating process unless otherwise specified.

Next, the method for measuring the particle diameter distribution of the toner will be described. The volume average particle diameter ($D_4$), the number average particle diameter (Dn) and the ratio ($D_4$/Dn) of the toner can be determined by using an instrument such as COULTER COUNTER TA-II and COULTER MULTISIZER II from Beckman Coulter Inc.

The procedure for measuring the volume average particle diameter ($D_4$), and the number average particle diameter (Dn) is the following. Specifically, 0.1 to 5 ml of a surfactant (preferably a polyoxyethylene alkyl ether (nonionic surfactant)) serving as a dispersant is added to 100 to 150 ml of an electrolyte. In this regard, a 1% by weight aqueous solution of first-class NaCl can be used as the electrolyte. Specific examples of marketed products of the electrolyte include ISOTON-II from Beckman Coulter Inc.

Next, 2 to 20 mg of a sample is added to the electrolyte including the dispersant. The mixture is subjected to a dispersing treatment for about 1 to 3 minutes using an ultrasonic dispersing device. The volume-basis particle diameter distribution and the number-basis particle diameter distribution of the sample are determined using the instrument mentioned above and an aperture of 100 μm. The volume average particle diameter ($D_4$), and the number average particle diameter (Dn) of the sample can be determined from the volume-basis particle diameter distribution, and the number-basis particle diameter distribution, respectively.

In this case, the particle diameter channels are following 13 channels:

2.00 μm≤C1<2.52 μm; 2.52 μm≤C2<3.17 μm; 3.17 μm≤C3<4.00 μm;

4.00 μm≤C4<5.04 μm; 5.04 μm≤C5<6.35 μm; 6.35 μm≤C6<8.00 μm;

8.00 μm≤C7<10.08 μm; 10.08 μm≤C8<12.70 μm; 12.70 μm≤C9<16.00 μm;

16.00 μm≤C10<20.20 μm; 20.20 μm≤C11<25.40 μm; 25.40 μm≤C12<32.00 μm; and 32.00 μm≤C13<40.30 μm.

Thus, particles having a particle diameter of not less than 2.00 μm and less than 40.30 μm are targeted.

In this application, the molecular weight of the toner constituents such as binder resins is determined by a gel permeation chromatographic (GPC) apparatus, GPC-8220GPC from Tosoh Corp. The conditions are the following.

Column used: TSKGEL SUPERHZM-H (15 cm, three consecutive column) from Tosoh Corp.

Temperature: 40° C.

Solvent used: tetrahydrofuran (THF)

Flow rate: 0.35 ml/min

Amount of sample injected: 0.4 ml of 0.15% by weight solution

Pretreatment of sample: A sample (toner) is dissolved in tetrahydrofuran (THF), followed by filtration using a filter with openings of 0.2 μm to prepare a 0.15% by weight THF solution of the sample. The filtrate is used as the sample.

Next, 100 ml of the sample is injected into the GPC apparatus. The molecular weight of the sample is determined by using a working curve, which is preliminarily prepared using several mono-disperse polystyrene standard samples and which shows the relation between counts of GPC and logarithmic values of molecular weight. In this regard, SHOWDEX STANDARD Nos. S-7300, S-210, S-390, S-875, S-1980, S-10.9, S-629, S-3.0, and S-0.580, which are from Showa Denko K.K., are used as the mono-disperse polystyrene standard samples. In addition, a refractive index (RI) detector is used as the detector.

Next, the method for preparing the toner of this disclosure will be described.

The toner preparation method is not particularly limited, and any known methods can be used depending on the intended use of the toner. However, it is preferable to use a granulation method including dispersing an oil phase liquid, which includes at least a binder resin including the cross-linked polyester resin and the block copolymer mentioned above and which optionally includes other toner constituents such as a release agent and a colorant, in an aqueous medium to prepare particles (toner particles) in the aqueous medium.

In addition, it is also preferable to use another granulation method including dispersing an oil phase liquid, which includes at least a binder resin including the non-linear reactive precursor, the crosslinking agent, and the block copolymer mentioned above and which optionally includes other toner constituents such as a release agent and a colorant, in an aqueous medium while reacting the precursor with the crosslinking agent to prepare particles (toner particles) in the aqueous medium. In this method, the non-linear reactive precursor is reacted with the crosslinking agent, and thereby the crosslinked polyester resin is generated in the oil phase liquid dispersed in the aqueous medium. In this regard, the non-linear reactive precursor has a branched structure which is imparted to the precursor by a tri- or more-valent functional group, and the crosslinking agent is a compound reactive with the non-linear reactive precursor. It is more preferable that the reactive precursor is a polyester prepolymer having an isocyanate group, and the crosslinking agent is a compound having an active hydrogen group.

Specific examples of such a granulation method include known solution suspension methods.

Next, one example of the granulation method will be described by reference to a method including forming a crosslinked polyester resin by subjecting the non-linear reactive precursor and the crosslinking mentioned above to a polymer chain growth reaction and/or a crosslinking reaction while forming particles of the toner (mother toner particles). This method includes preparing an aqueous phase liquid; preparing an oil phase liquid including toner constituents (such as a binder resin, a release agent, and a colorant) and an organic solvent; emulsifying or dispersing the oil phase liquid in the aqueous phase liquid; and removing the organic solvent from the emulsion or dispersion.

Initially, preparation of the aqueous phase liquid will be described. The aqueous phase liquid is prepared, for example, by dispersing a particulate resin in an aqueous medium. The added amount of such a particulate resin is not particularly limited, but is preferably from 0.5 to 10 parts by weight based on 100 parts by weight of the aqueous medium.

Specific examples of the aqueous medium include water, and solvents compatible with water such as alcohols (such as methanol, isopropanol, and ethylene glycol), dimethylformamide, tetrahydrofuran, cellosolves, and lower ketones (such as acetone and methyl ethyl ketone). These can be used alone or in combination. Among these, water is preferably used as the aqueous medium.

Next, preparation of the oil phase liquid will be described. The oil phase liquid is prepared by dissolving or dispersing toner constituents, which include at least the above-mentioned non-linear reactive precursor, the above-mentioned crosslinking agent, and the above-mentioned block copolymer and which optionally include other components such as the release agent and the colorant mentioned above, in an organic solvent.

The organic solvent is not particularly limited, and any known organic solvents can be used. However, organic solvents having a boiling point of lower than 150° C. are preferable because such solvents can be easily removed in the solvent removing process.

Specific examples of organic solvents having a boiling point of lower than 150° C. include toluene, xylene, benzene, carbon tetrachloride, methylene chloride, 1,2-dichlorethane, 1,1,2-trichloroethane, trichloroethylene, chloroform, monochlorobenzene, dichloroethylidene, methyl acetate, ethyl acetate, methyl ethyl ketone, and methyl isobutyl ketone. Among these, ethyl acetate, toluene, xylene, benzene, methylene chloride, 1,2-dichloroethane, chloroform, and carbon tetrachloride are preferable, and ethyl acetate is more preferable.

Next, the emulsifying or dispersing process will be described. The thus prepared oil phase liquid is dispersed in the aqueous phase liquid. When the oil phase liquid including the toner constituents is emulsified or dispersed, the non-linear reactive precursor and the crosslinking agent are subjected to a polymer chain growth reaction and/or a crosslinking reaction to prepare the crosslinked polyester resin mentioned above.

The crosslinked polyester resin can be prepared, for example, by one of the following methods (1) to (3).

(1) A method in which an oil phase liquid including the non-linear reactive precursor and the crosslinking agent is emulsified or dispersed in an aqueous phase liquid, and the crosslinking agent and the reactive precursor are subjected to a polymer chain growth reaction and/or a crosslinking reaction in the aqueous phase liquid to prepare the crosslinked polyester resin mentioned above.

(2) A method in which an oil phase liquid including the non-linear reactive precursor is emulsified or dispersed in an aqueous phase liquid including the crosslinking agent so that the crosslinking agent and the reactive precursor are subjected to a polymer chain growth reaction and/or a crosslinking reaction in the aqueous phase liquid, thereby preparing the crosslinked polyester resin mentioned above.

(3) A method in which after an oil phase liquid including the non-linear reactive precursor is emulsified or dispersed in an aqueous phase liquid, the crosslinking agent is added to the aqueous phase liquid so that a polymer chain growth reaction and/or a crosslinking reaction is caused starting from the interfaces of the aqueous phase liquid and the oil phase liquid, thereby preparing the crosslinked polyester resin mentioned above.

When a polymer chain growth reaction and/or a crosslinking reaction is caused starting from the interfaces of the aqueous phase liquid and the oil phase liquid, the crosslinked polyester resin is formed preferentially on the surface of toner particles, and therefore it becomes possible to form concentration gradient of the crosslinked polyester resin in the toner particles.

The condition (such as reaction time and reaction temperature) of the reaction for forming the crosslinked polyester resin is not particularly limited, and is properly determined depending on the combination of the non-linear reactive precursor and the crosslinking agent used.

The reaction time is not particularly limited, but is preferably from 10 minutes to 40 hours, and more preferably from 2 hours to 24 hours.

The reaction temperature is not particularly limited, but is preferably from 0° C. to 150° C., and more preferably from 40° C. to 98° C.

The method for stably dispersing the oil phase liquid including the non-linear reactive precursor in the aqueous phase liquid is not particularly limited. For example, a method in which an oil phase liquid prepared by dissolving or dispersing toner constituents in a solvent is added to an aqueous medium (aqueous phase liquid), and the mixture is dispersed by a dispersing machine using a shearing force can be used.

The dispersing machine for use in emulsifying or dispersing the oil phase liquid in the aqueous phase liquid is not particularly limited, and for example, low-speed shearing type dispersing machines, high-speed shearing type dispersing machines, friction type dispersing machines, high pressure type dispersing machines, and ultrasonic dispersing machines can be used.

Among these dispersing machines, high-speed shearing type dispersing machines are preferable because the particle diameter of droplets of the oil phase liquid dispersed in the aqueous phase liquid can be controlled so as to be from 2 μm to 20 μm. The dispersing condition such as revolution of rotor, dispersing time and dispersing temperature is not particularly limited, and is properly determined depending on the targeted particle diameter of droplets of the oil phase liquid dispersed in the aqueous phase liquid.

The revolution of rotor of the dispersing machine is not particularly limited, but is preferably from 1,000 rpm to 30,000 rpm, and more preferably from 5,000 rpm to 20,000 rpm.

The dispersing time is not particularly limited, but is preferably from 0.1 minutes to 5 minutes when the dispersing machine is a batch dispersing machine.

The dispersing temperature is not particularly limited, but is preferably from 0° C. to 150° C., and more preferably from 40° C. to 98° C. In general, as the dispersing temperature increases, the dispersing efficiency can be enhanced.

The amount of the aqueous phase liquid used for emulsifying or dispersing the oil phase liquid therein is not particularly limited, but is preferably from 50 to 2,000 parts by weight, and more preferably from 100 to 1,000 parts by weight, based on 100 parts by weight of the toner constituents.

When the amount of the aqueous phase liquid is less than 50 parts by weight, the toner constituents (oil phase liquid) cannot be well dispersed in the aqueous phase liquid, thereby making it impossible to prepare toner particles having the desired particle diameter. When the amount of the aqueous phase liquid is greater than 2,000 parts by weight, the manufacturing cost of the toner increases.

When the oil phase liquid is emulsified or dispersed, a dispersant is preferably used to stabilize droplets of the oil phase liquid such that the droplets have the desired shape and a sharp particle diameter distribution.

The dispersant is not particularly limited, and for example, surfactants, inorganic dispersants hardly soluble in water, and polymeric protection colloids can be used as dispersants. These dispersants can be used alone or in combination. Among these, surfactants are preferably used.

Anionic surfactants, cationic surfactants, nonionic surfactants, and ampholytic surfactants can be used as the surfactants. Specific examples of the anionic surfactants include alkylbenzene sulfonates, α-olefin sulfonates, and phosphoric acid esters. Among these, anionic surfactants having a fluoroalkyl group are preferable.

When performing the polymer chain growth reaction and/or the crosslinking reaction, a catalyst can be used. The catalyst is not particularly limited, and for example, dibutyltin laurate, and dioctyltin laurate can be used Next, removal of the organic solvent will be described.

The method for removing the organic solvent from the emulsion or dispersion of the toner constituents is not particularly limited. For example, a method in which the temperature of the entire reaction system is gradually increased to evaporate the organic solvent included in droplets of the oil phase liquid; and a method in which the emulsion or dispersion including the oil phase liquid and the aqueous phase liquid is sprayed into a dry atmosphere to evaporate the organic solvent included in the oil phase liquid can be used.

When the organic solvent included in the oil phase liquid is removed, particles of the toner can be formed. The thus prepared toner particles can be subjected to other treatments such as washing, drying and classifying. Classifying can be performed on the dispersion including the toner particles by using a cyclone, a decanter, or a centrifugal separator to remove relatively fine particles. Alternatively, a classifying treatment can be performed after the toner particles are dried.

The thus prepared toner particles may be mixed with an external additive (such as the external additives and the charge controlling agents mentioned above. In this regard, by applying a mechanical impact force, the external additive can be prevented from being released from the surface of the toner particles. Specific examples of the method applying a mechanical impact force include a method in which an impact force is applied by a blade, which is rotated at a high speed; and a method in which a mixture of the toner particles and the external additive are fed into a high speed air flow so that the particles of the toner particles and the external additive are collided with each other or a collision plate.

Specific examples of the device capable of applying an impact force include ONG MILL (from Hosokawa Micron Corp.), modified I-TYPE MILL (from Nippon Pneumatic, Mfg. Co., Ltd.), which is modified to decrease the pulverization air pressure, HYBRIDIZATION SYSTEM (from Nara Machinery Co., Ltd.), KRYPTRON SYSTEM (from Kawasaki Heavy Industries, Ltd.), and automatic mortars.

The toner of this disclosure preferably has a Martens' hardness of not less than 20 $N/mm^2$, and more preferably from 20 to 120 $N/mm^2$, wherein the Martens' hardness is measured at 50° C. using a molded material of the toner. When the Martens' hardness of the toner at 50° C. is less than 20 $N/mm^2$, the hardness of the surface of the toner decreases, and therefore the toner tends to easily deteriorate. As a result, the toner is unevenly charged by a toner bearing member (such as developing sleeves), thereby causing an uneven image density problem and a density variation problem in that the density of images formed on plural sheets of a recording medium in one job varies. In addition, a problem in that the image density decreases when the toner is used over a long period of time tends to be caused.

In contrast, when the Martens' hardness is greater than 120 $N/mm^2$, the hardness of the surface of the toner excessively increases, and the external additive on the surface of the toner particles cannot easily disperse the impact force formed when the toner is collided with the surface of the photoreceptor (image carrier) because the external additive is sandwiched by the photoreceptor and the toner particles. Therefore, the external additive tends to be released from the surface of the toner particles, thereby forming free particles of the external additive, resulting in formation of defective images such that white spots are formed in a solid image due to the free particles of the external additive.

The Martens' hardness of toner means a hardness which is determined by the method of the pressing test described in ISO and which means the hardness of a material (toner) when the material is pressed by a pressing member at a predetermined load. In this application, a micro compression tester, FISCHER SCOPE H100 from Fischer Instruments K.K., is used for measuring the Martens' hardness.

The sample to be used for measurement of the Martens' hardness is a melted and molded toner (or resin), which is prepared by a heat and pressure molding method (such as precision hot press methods) using a die having predetermined shape and size and which is a plate having a smooth planar surface. For example, about 5 g of a sample (toner) is fed into a cylindrical die having a diameter of 40 mm, and is subjected to a heat and pressure molding treatment at 120° C. under a load of 0.5 kN. The molded toner in the die is cooled to 20° C. under the load to prepare a disc-shaped molded toner whose upper and lower surfaces are smooth and parallel to each other.

The Martens' hardness of the molded toner is measured by using a micro hardness tester. Specifically, the molded toner is set on a hot plate and is heated to a temperature (e.g., 100° C.) at which the molded toner is melted but does not deform, followed by cooling from 100° C. to 50° C. After the temperature falls to 50° C. and the toner is heated for 15 minutes to maintain the temperature, the Martens' hardness of the toner is measured with a micro hardness tester, FISCHER SCOPE H100 from Fischer Instruments K.K., under the following conditions.

Pressing member: Pressing member having square pyramid shape

Applied load: 250 mN

Time necessary for obtaining the load: 30 seconds

Retention time of the load: 5 seconds

The measurement is performed four times, and the average of the four data of the Martens' hardness of the toner is obtained to determine the Martens' hardness of the toner.

In order that the surface of the toner has a proper hardness, the dispersing state of toner constituents on the surface of the toner has to be properly controlled. Specifically, it is important to prevent low viscosity components from being segregated so as to be present on the surface of the toner particles.

In particular, in order to prepare the toner of this disclosure by a melt kneading method, it is important to use plural resins having different melt viscosities for satisfactorily dispersing the toner constituents in the melt kneading process, to use a solvent-insoluble component having an elasticity for the toner constituents, and to optimize the kneading zone in the melt kneading process.

Next, the developer of this disclosure will be described.

The developer of this disclosure includes at least the toner mentioned above, and optionally includes another component such as a carrier.

Therefore, the developer of this disclosure has a good combination of transferability and charging property, and can stably produce high quality images.

The developer of this disclosure may be a one-component developer consisting essentially of the toner, or a two-component developer including the toner and a carrier. When the developer is used for high speed printers used for recent high speed information processing, a two-component developer is preferably used because of having a relatively long life.

When the toner is used as a one component developer, the average particle diameter of the developer (toner) hardly varies even when supply and consumption of the toner are performed. In addition, the developer hardly causes problems such that a film of the toner (developer) is formed on a developing roller; and the toner is adhered to a blade used for forming a thin toner layer on a developing roller. Further, even when the developer is agitated in a developing device for a long period of time, the developer can maintain good developing ability, and therefore high quality images can be stably produced.

When the toner is used for a two-component developer, the average particle diameter of the developer (toner) hardly varies even when supply and consumption of the toner are performed over a long period of time. In addition, even when the developer is agitated in a developing device for a long period of time, the developer can maintain good developing ability, and therefore high quality images can be stably produced.

The carrier used for the two component developer of this disclosure is not particularly limited, but is preferably a carrier including a core and a resin layer covering the core.

The material of the core is not particularly limited. For example, magnetic materials such as manganese-strontium materials having a magnetic moment of from 50 emu/g ($5\times10^{-2}$ A·m$^2$/g) to 90 emu/g ($9\times10^{-2}$ A·m$^2$/g), and manganese-magnesium materials having a magnetic moment of from 50 emu/g ($5\times10^{-2}$ A·m$^2$/g) to 90 emu/g ($9\times10^{-2}$ A·m$^2$/g) can be used. In order to produce high density images, high magnetization materials such as iron powders having a magnetic moment of not less than 100 emu/g ($1\times10^{-1}$ A·m$^2$/g), and magnetite having a magnetic moment of from 75 ($7.5\times10^{-2}$ A·m$^2$/g) emu/g to 120 emu/g ($1.2\times10^{-1}$ A·m$^2$/g) are preferably used. When low magnetization materials are used as a carrier, impact of magnetic chains of the developer on the surface of a photoreceptor can be decreased, and high quality images can be produced. Therefore, it is also preferable to use low magnetization materials such as copper-zinc materials having a magnetic moment of from 30 emu/g ($3\times10^{-2}$ A·m$^2$/g) to 80 emu/g ($8\times10^{-2}$ A·m$^2$/g).

These magnetic materials can be used alone or in combination.

The volume average particle diameter of the core is not particularly limited, but is preferably from 10 μm to 150 μm, and more preferably from 40 μm to 100 μm. When the volume average particle diameter of the core is less than 10 μm, the carrier includes fine particles in a large amount, and therefore the magnetization per one core particle decreases, thereby often causing a carrier scattering problem. In contrast, when the volume average particle diameter is greater than 150 μm, the specific surface area of the carrier decreases, thereby often causing a toner scattering problem. In this case, when full color images, which typically include a large solid image, are produced, a problem in that the solid image is not well reproduced is often caused.

When the developer is a two component developer, the toner mentioned above is mixed with the carrier mentioned above. The content of the carrier in the two component developer is not particularly limited, but is preferably from 90 to 98 parts by weight, and more preferably from 93 to 97 parts by weight, based on 100 parts by weight of the two-component developer.

Next, the image forming apparatus of this disclosure and the image forming method thereof will be described.

The image forming apparatus of this disclosure includes at least an electrostatic latent image carrier (hereinafter sometimes referred to as a photoreceptor or an image carrier), an electrostatic latent image forming device to form an electrostatic latent image on the electrostatic latent image carrier, and a developing device to develop the electrostatic latent image using the developer mentioned above, and optionally includes other devices.

The image forming method includes at least an electrostatic latent image forming step of forming an electrostatic latent image on an electrostatic latent image carrier, and a developing step of developing the electrostatic latent image using the developer mentioned above, and optionally includes other steps. The image forming method is preferably performed by the image forming apparatus mentioned above, the electrostatic latent image forming step is preferably performed by the electrostatic latent image forming device mentioned above, and the developing step is preferably performed by the developing device mentioned above. The optional other steps are performed by the optional other devices.

The material, configuration and size of the electrostatic latent image carrier are not particularly limited. For example, inorganic photoreceptors such as amorphous silicon and selenium, and organic photoreceptors such as polysilane and phthalopolymethine can be used. Among these, amorphous silicon is preferable because of having a relatively long life.

Amorphous silicon photoreceptors can be prepared, for example, by heating a substrate to a temperature of from 50° C. to 400° C. and forming a photosensitive layer including amorphous silicon on the substrate using a method such as vacuum deposition methods, sputtering methods, ion plating methods, thermal chemical vapor deposition (CVD) methods, optical CVD methods, and plasma CVD methods. Among these methods, plasma CVD methods in which a gaseous raw material is decomposed by glow discharge using direct current, high frequency wave, or microwave to form a film of amorphous silicon on the surface of the substrate are preferable.

The shape of the electrostatic latent image carrier is not particularly limited, but cylindrical image carriers are preferable. The outer diameter of such cylindrical image carriers is not particularly limited, but is preferably from 3 mm to 100 mm, more preferably from 5 mm to 50 mm, and even more preferably from 10 mm to 30 mm.

The electrostatic latent image forming device is not particularly limited as long as the device can form an electrostatic latent image on the electrostatic latent image carrier. For example, a combination of a charger to charge a surface of the electrostatic latent image carrier and an irradiator to irradiate the charged surface of the electrostatic latent image carrier with light modulated according to image information can be used as the electrostatic latent image forming device.

The electrostatic latent image forming step is not particularly limited as long as the step includes forming an electrostatic latent image on an electrostatic latent image carrier. For example, a combination of a step of charging a surface of the electrostatic latent image carrier and a step of irradiating the charged surface of the electrostatic latent image carrier with light modulated according to image information can be used as the electrostatic latent image forming step.

The electrostatic latent image forming step can be performed by the electrostatic latent image forming device mentioned above.

The charger is not particularly limited, and specific examples thereof include contact chargers equipped with an electroconductive or semiconductive member such as rollers, brushes and rubber blades, and non-contact chargers using corona discharge such as corotrons and scorotrons.

The charging step can be performed, for example, by applying a voltage to a surface of the above-mentioned electrostatic latent image carrier.

The shape of the charger is not particularly limited, and chargers using a roller, a magnetic brush, or a fur brush can be used depending on the specification and structure of the image forming apparatus for which the charger is used. When a charger having a magnetic brush is used, for example, a charger including a charging member (serving as a magnetic brush) including a particulate ferrite such as Zn—Cu ferrite, a non-magnetic electroconductive sleeve to support the charging member, and a magnet roller set inside the sleeve to form the magnetic brush on the sleeve can be used.

When a charger having a fur brush is used, fur subjected to an electroconductive treatment using carbon, copper sulfide, a metal or a metal oxide is preferably used for the fur brush. The fur is then looped around or attached to a metal rod to prepare a charger having a fur brush.

Among various chargers, contact chargers are preferable because the amount of ozone generated by contact chargers is relatively small compared to non-contact chargers.

The irradiator is not particularly limited as long as the irradiator can irradiate the charged surface of the above-mentioned electrostatic latent image carrier with light modulated according to image information. Specific examples thereof include optical systems of copiers, rod lens arrays, laser optical systems, and optical systems using a liquid crystal shutter.

Specific examples of the light sources for use in the irradiator include fluorescent lamps, tungsten lamps, halogen lamps, mercury lamps, sodium vapor lamps, light emitting diodes (LED), laser diodes (LD), and electroluminescence (EL) devices.

In order to irradiate the electrostatic latent image carrier with light having a wavelength in a desired wavelength range, filters such as sharp cut filters, band-pass filters, infrared cut filters, dichroic filters, interference filters, and color temperature changing filters, can be used.

The irradiating step can be performed by irradiating a surface of the charged electrostatic latent image carrier using the irradiator mentioned above.

It is possible to irradiate the electrostatic latent image carrier from the backside (inside) thereof.

Next, the developing device of the image forming apparatus and the developing step of the image forming method will be described. The developing device is not particularly limited as long as the device can form a visible image by developing an electrostatic latent image on the electrostatic latent image carrier using the toner of this disclosure.

The developing step is not particularly limited as long as the step includes developing an electrostatic latent image on the electrostatic latent image carrier using the toner of this disclosure to form a visible image on the electrostatic latent image carrier. The developing step is preferably performed by using the developing device mentioned above.

The developing device may be a dry developing device or a wet developing device. In addition, the developing device may be a monochromatic developing device or a multi-color developing device.

Among various developing devices, a developing device including an agitator to agitate the toner to frictionally charge the toner, and a developer carrier which includes a magnetic generating member therein and which can rotate while bearing thereon the developer including the toner is preferable.

In the developing device using a two component developer, for example, the developing operation is performed as follows. The toner and the carrier are mixed and agitated to frictionally charge the toner. The developer is born on the surface of a rotating magnetic roller (or on the surface of a sleeve including a magnetic roller) so as to be erected thereon (i.e., to form a magnetic brush thereon). Since the magnetic roller is arranged in the vicinity of the electrostatic latent image carrier, part of the toner in the magnetic brush formed on the magnet roller is transferred to the surface of the electrostatic latent image carrier by an electric attractive force, thereby developing the electrostatic latent image with the toner, resulting in formation of a visible image (toner image) on the surface of the electrostatic latent image carrier.

Next, the optional other devices of the image forming apparatus and the optional other steps of the image forming method will be described.

Specific examples of the other devices include a transferring device, a fixing device, a cleaner, a discharger, a recycling device, and a controller.

Specific examples of the other steps include a transferring step, a fixing step, a cleaning step, a discharging step, a recycling step, and a controlling step.

The transferring device is not particularly limited as long as the device can transfer the visible image to a recording medium. Among various transferring devices, a transferring device including a primary transferring device to transfer the visible image on the image carrier to an intermediate transfer medium to form a combined color toner image, in which multiple color images are overlaid, on the intermediate transfer medium, and a secondary transferring device to transfer the combined color toner image onto a recording medium is preferable.

The transferring step is not particularly limited as long as the step includes transferring the visible image to a recording medium. The transferring step preferably includes primarily transferring the visible image on the image carrier to an intermediate transfer medium to form a combined color toner image on the intermediate transfer medium, and then secondarily transferring the combined color toner image onto a recording medium.

The transferring step is performed, for example, by charging the visible image using a transfer charger. The transferring step is preferably performed by the transferring device mentioned above.

When the visible image transferred to a recording medium is a color toner image consisting of multiple color toner images, it is typical that initially the multiple color toner images are sequentially transferred onto an intermediate transfer medium to form a combined color toner image thereon, and the combined color toner image is secondarily transferred to a recording medium.

The intermediate transfer medium is not particularly limited, and any known intermediate transfer media such as transfer belts can be used.

The transferring device (the primary transferring device and secondary transferring device mentioned above) preferably includes at least a transferring member to transfer the visible image to a recording medium by charging (i.e., charging by separation). Specific examples of the transferring member include corona transferring members using corona discharge, transfer belts, transfer rollers, pressure transfer rollers, and adhesive transferring members.

The recording medium is not particularly limited, and any known materials can be used as long as a visible image can be transferred thereto. Specific examples thereof include paper, and polyethylene terephthalate films for use in overhead projectors.

The fixing device is not particularly limited as long as the device can fix a transferred visible image to the recording medium. Among various fixing methods, a fixing device using a heating/pressing member is preferable. Specific examples of the heating/pressing member include combinations of a heat roller and a pressure roller, and combinations of a heat roller, a pressure roller and an endless belt. In addition, a light fixing device can be used alone or in combination with another fixing device.

The fixing step is not particularly limited as long as the step includes fixing a transferred visible image to the recording medium. The fixing step may be performed on each of the transferred toner images after the toner image is transferred to a recording medium, or on the transferred and overlaid toner images after all the toner images are transferred to a recording medium. The fixing step is performed by the fixing device mentioned above. When a fixing device using a heating/pressing member is used, heating is preferably performed at a temperature of from 80° C. to 200° C., and pressing is preferably performed at a contact pressure of from 10 to 80 $N/cm^2$.

The cleaner is not particularly limited as long as the cleaner can remove toner particles remaining on the surface of a photoreceptor (image carrier). Specific examples of the cleaner include magnetic brush cleaners, electrostatic brush cleaners, magnetic roller cleaners, blade cleaners, brush cleaners, and web cleaners.

The cleaning step is not particularly limited as long as the step includes removing toner particles remaining on the surface of a photoreceptor. The cleaning step can be performed by the cleaner mentioned above.

The discharger is not particularly limited as long as the discharger can remove charges remaining on the surface of a photoreceptor. Specific examples of the discharger include devices capable of applying a discharge bias to a photoreceptor, and discharging lamps.

The discharging step is not particularly limited as long as the step includes removing charges remaining on the surface of a photoreceptor. The discharging step can be performed by the discharger mentioned above.

The recycling device is not particularly limited as long as the recycling device can recycle the toner particles collected in the cleaning step so that the toner can be used for the developing device. Specific examples of the recycling device include known feeding devices.

The recycling step is not particularly limited as long as the recycling step includes recycling the toner particles collected in the cleaning step so that the toner can be used for the developing device. The recycling step can be performed by the recycling device mentioned above.

The controller is not particularly limited as long as the controller can control operations of the above-mentioned devices of the image forming apparatus. Specific examples of the controller include sequencers and computers.

The controlling step is not particularly limited as long as the step includes controlling operations of the above-mentioned devices of the image forming apparatus. The controlling step can be performed by the controller mentioned above.

Next, an example of the image forming apparatus of this disclosure and an example of the image forming method will be described by reference to FIG. 1.

FIG. 1 is a schematic view illustrating an example of the image forming apparatus of this disclosure.

Referring to FIG. 1, an image forming apparatus 100A includes a photoreceptor drum 10 serving as the electrostatic latent image carrier mentioned above, a charging roller 20 serving as the charger mentioned above, an irradiator 30 serving as the irradiator mentioned above to irradiate the image carrier with light L, a developing device 40 serving as the developing device mentioned above, an intermediate transfer medium 50, a cleaner 60, which includes a cleaning blade and which serves as the cleaner mentioned above, and a discharging lamp 70 serving as the discharger mentioned above.

The intermediate transfer medium 50 is an endless belt, which can be rotated in a direction indicated by an arrow by three rollers 51 while tightly stretched by the rollers. One or more of the rollers 51 serve as a transfer bias applying roller to apply a predetermined transfer bias (primary transfer bias) to the intermediate transfer medium 50. A cleaner 90 including a cleaning blade is arranged in the vicinity of the intermediate transfer medium 50. In addition, a transfer roller 80, which serves as a transferring device to apply a transfer bias to transfer a visible image (toner image) to a recording medium 95, is arranged in the vicinity of the intermediate transfer medium 50. Further, a corona charger 58 is arranged at a location between the contact portion of the intermediate transfer medium 50 with the photoreceptor drum 10 and the contact portion of the intermediate transfer medium with the recording medium 95 relative to the moving direction of the intermediate transfer medium to charge the toner image on the intermediate transfer medium.

The developing device 40 includes a developing belt 41, and a black developing unit 45K, a yellow developing unit 45Y, a magenta developing unit 45M, and a cyan developing unit 45C, which are arranged in the vicinity of the developing belt 41. The black developing unit 45K includes a developer container 42K, a developer supplying roller 43K, and a developing roller 44K. The yellow developing unit 45Y includes a developer container 42Y, a developer supplying roller 43Y, and a developing roller 44Y. The magenta developing unit 45M includes a developer container 42M, a developer supplying roller 43M, and a developing roller 44M. The cyan developing unit 45C includes a developer container 42C, a developer supplying roller 43C, and a developing roller 44C. The developing belt 41 is an endless belt and is rotated in a direction indicated by an arrow by plural belt rollers while tightly stretched by the rollers, wherein part of the developing belt is contacted with the photoreceptor drum 10.

In the image forming apparatus 100A illustrated in FIG. 1, the charging roller 20 evenly charges the surface of the photoreceptor drum 10, and the irradiator 30 irradiates the charged surface of the photoreceptor drum 10 with light L modulated according to image information to form an electrostatic latent image on the surface of the photoreceptor drum 10. The electrostatic latent image is developed with a toner supplied by the developing device 40, thereby forming a toner image on the surface of the photoreceptor drum. The toner image formed on the photoreceptor drum 10 is transferred to the intermediate transfer medium 50 (primary transferring) by a voltage applied by one or more of the rollers 51. The toner image on the intermediate transfer medium 50 is transferred onto the recording medium 95 (secondary transferring) by the transfer roller 80, thereby forming a toner image on the recording medium. Toner particles remaining on the surface of the photoreceptor drum 10 after the primary transferring process are removed by the cleaner 60, and charges remaining on the surface of the photoreceptor drum 10 after the primary transferring process are removed by the discharging lamp 70.

Figure 2:
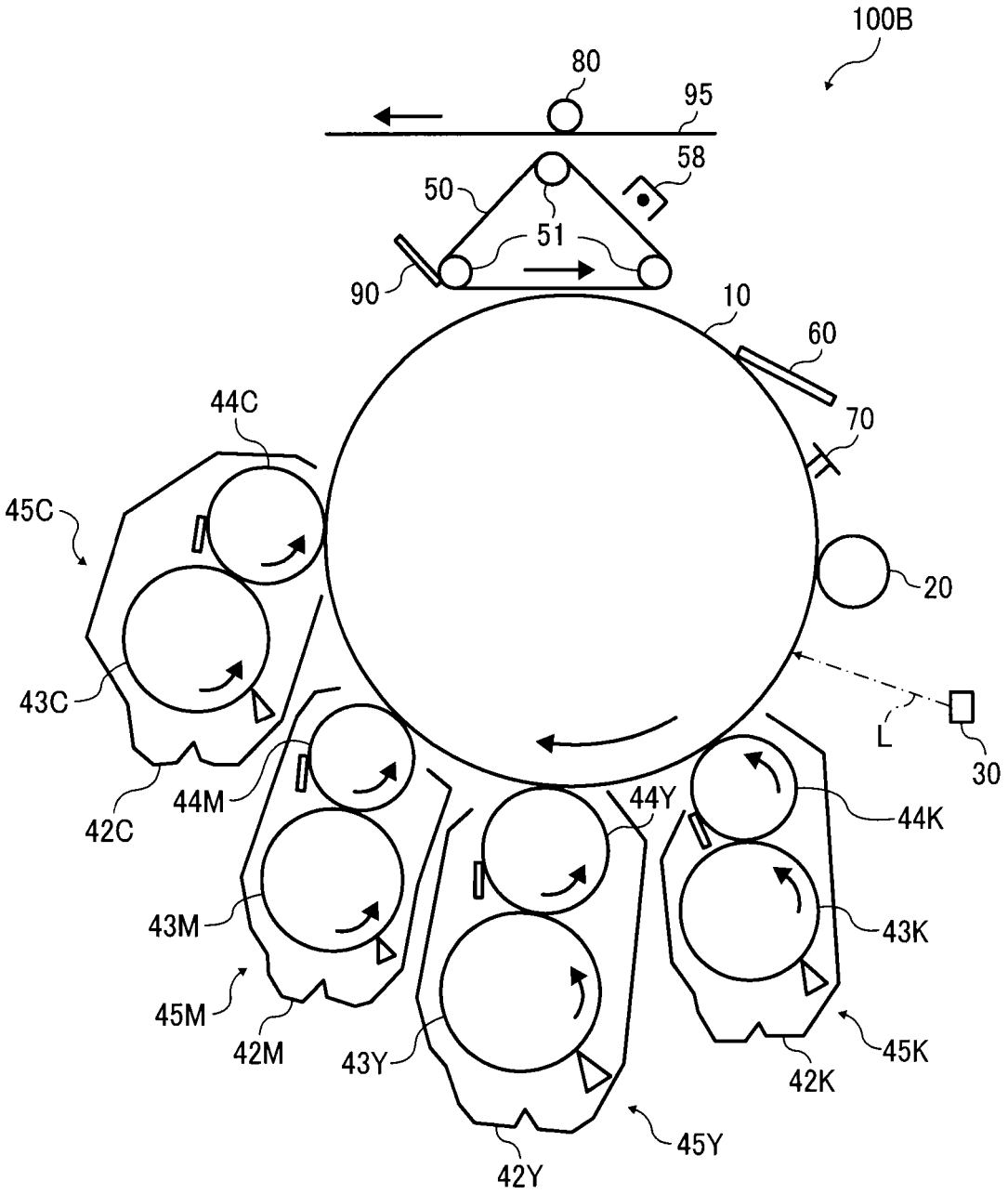
FIG. 2 is a schematic view illustrating another example of the image forming apparatus.

FIG. 2 illustrates another example of the image forming apparatus of this disclosure.

An image forming apparatus 100B illustrated in FIG. 2 has the same configuration as that of the image forming apparatus 100A illustrated in FIG. 1 except that the apparatus does not use a developing belt, and the black developing unit 45K, the yellow developing unit 45Y, the magenta developing unit 45M, and the cyan developing unit 45C are arranged so as to be opposed to the photoreceptor drum 10.

Figure 3:
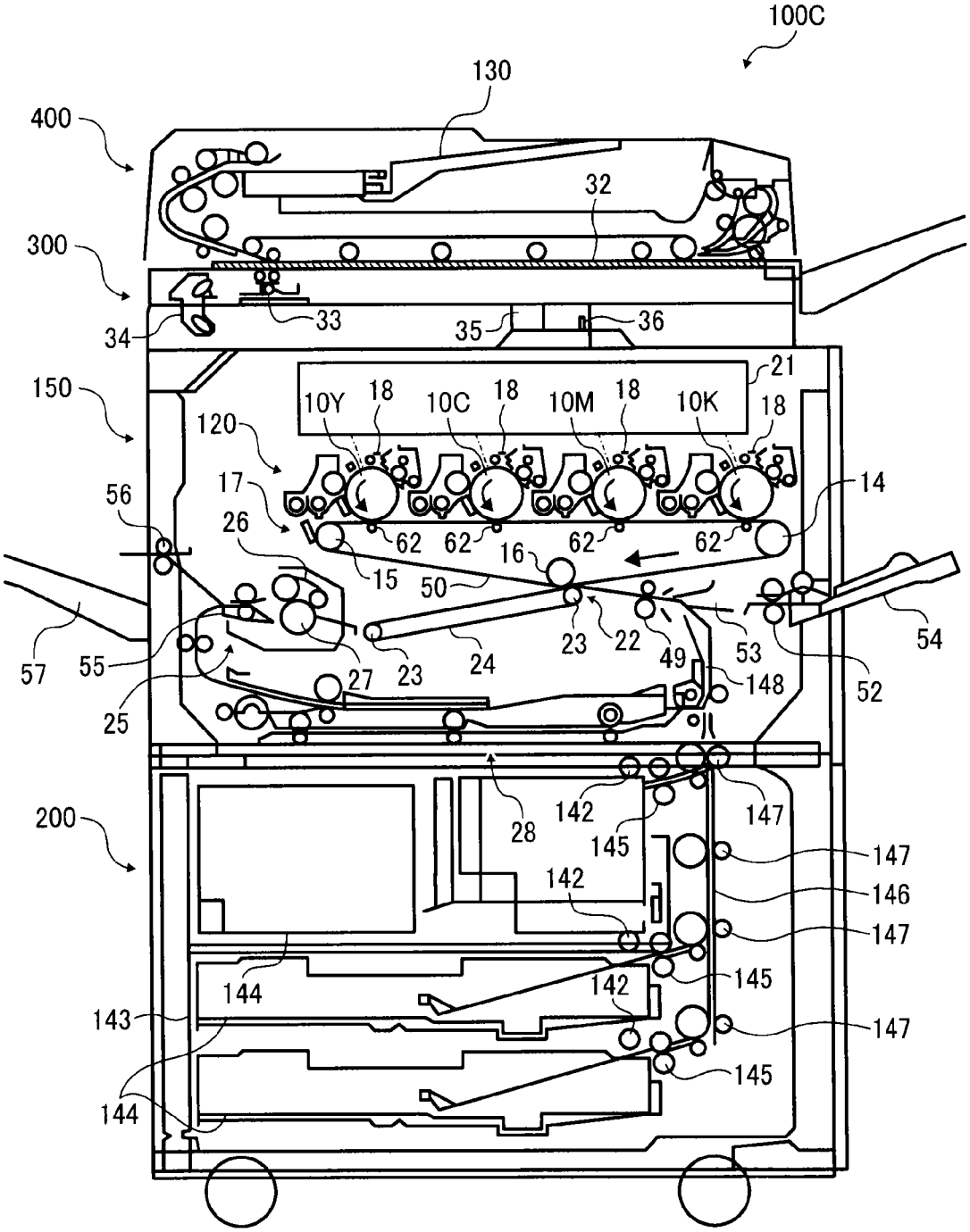
FIG. 3 is a schematic view illustrating yet another example of the image forming apparatus.

FIG. 3 illustrates another example of the image forming apparatus of this disclosure.

An image forming apparatus 100C illustrated in FIG. 3 includes an image forming section 150, a recording sheet feeding device 200, a scanner 300, and an automatic document feeder (ADF) 400.

The image forming section 150 includes the endless intermediate transfer medium 50 in the center thereof. The intermediate transfer medium 50 is tightly stretched by support rollers 14, 15 and 16 while rotated thereby in a direction indicated by an arrow. In the vicinity of the support roller 15, an intermediate transfer medium cleaner 17 is provided to remove toner particles remaining on the intermediate transfer medium 50 even after the secondary transferring process. Above the upper portion of the intermediate transfer medium 50, which is tightly stretched by the support rollers 14 and 15, a tandem image forming device 120, in which yellow, cyan, magenta and black image forming devices 18 are arranged side by side, is provided so as to be opposed to the upper portion of the intermediate transfer medium 50.

In the vicinity of the tandem image forming device 120, an irradiator 21 is provided to irradiate the photoreceptor drums 10 (10Y, 10C, 10M and 10K) with light including information of Y, C, M and K color images to form electrostatic latent images corresponding to Y, C, M and K images on the corresponding photoreceptor drums 10 (10Y, 10C, 10M and 10K). A secondary transfer device 22 is provided in the vicinity of the lower portion of the intermediate transfer medium 50 so as to be contacted with the support roller 16 with the intermediate transfer medium therebetween. The secondary transfer device 22 includes an endless secondary transfer belt 24 tightly stretched by a pair of rollers 23 while rotated thereby. The recording medium fed by the secondary transfer belt 24 is to be contacted with the intermediate transfer belt 50. In the vicinity of the secondary transfer device 22, a fixing device 25 is provided which includes an endless fixing belt 26, and a pressure roller 27 contacted with the fixing belt 26.

In addition, a reversing device 28 is provided in the vicinity of the secondary transfer device 22 and the fixing device 25 to feed the recording medium bearing a toner image on one surface thereof toward the secondary transfer device 22 while reversing the recoding medium to prepare a duplex copy.

Next, the method for forming a full color image (color copy) using the tandem image forming device 120 will be described.

An original to be copied is set on an original table 130 of the automatic document feeder 400. Alternatively, the original may be directly set on a glass plate 32 of the scanner 300 after the automatic document feeder 400 is opened, followed by closing the automatic document feeder 400.

When a start button (not shown) of the image forming apparatus is pushed, the color image of the original set on the glass plate 32 is scanned with a first traveler 33 and a second traveler 34, which move in the right direction in FIG. 3. In the case where the original is set on the table 130 of the automatic document feeder 400, initially the original is fed to the glass plate 32, and then the color image thereon is scanned with the first and second travelers 33 and 34. The first traveler 33 irradiates the color image on the original with light and the second traveler 34 reflects light reflected from the color image to send the optical color image to a sensor 36 via a focusing lens 35. Thus, color image information (i.e., yellow, cyan, magenta and black color image data) of the color image on the original is provided.

Next, the irradiator 21 irradiates the photoreceptor drums 10 (10Y, 10C, 10M and 10K) with light according to the color image information to prepare electrostatic latent images on the photoreceptor drums 10. Developing devices 61 (illustrated in FIG. 4) develop the electrostatic latent images using Y, C, M and K developers to prepare Y, C, M and K toner images on the corresponding photoreceptor drums 10. The Y, C, M and K toner images thus formed on the photoreceptor drums 10 are transferred onto the intermediate transfer medium 50 one by one by transfer rollers 62, thereby forming a combined color toner image on the intermediate transfer medium 50.

Figure 4:
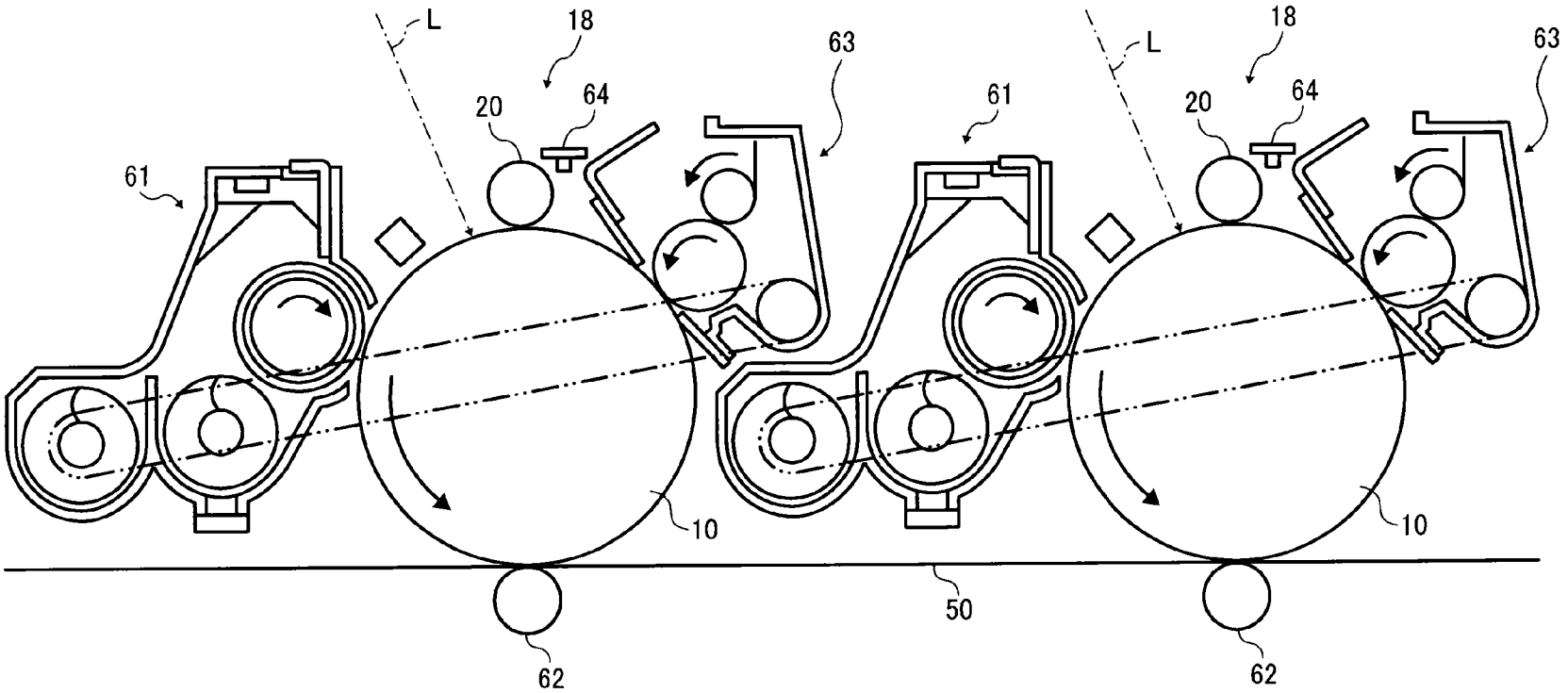
FIG. 4 is a schematic view illustrating an image forming section of the image forming apparatus illustrated in FIG. 3.

As illustrated in FIG. 4, each of the image forming devices 18 includes the photoreceptor drum 10 (10Y, 10C, 10M or 10K), the charging roller 20 to evenly charge the photoreceptor drum 10, the developing device 61 which develops an electrostatic latent image formed on the photoreceptor drum 10 using a developer including Y, C, M, or K toner to form a Y, C, M or K toner image on the photoreceptor drum, the transfer roller 62 to transfer the toner image on the photoreceptor drum 10 to the intermediate transfer medium 50, a cleaner 63 to clean the surface of the photoreceptor drum 10, and a discharging lamp 64 to discharge the photoreceptor drum 10.

Meanwhile, in the recording sheet feeding device 200, one of sheet feeding rollers 142 is selectively rotated to feed the uppermost sheet of recording sheets stacked in one of sheet cassettes 144 in a paper bank 143 while the recording sheet is separated one by one by a separation roller 145 when plural recording medium sheets are continuously fed. The recording sheet is then fed by feed rollers 147 to a passage 148 in the image forming section 150 through a passage 146 in the recording sheet feeding device 200, and is stopped once by a pair of registration rollers 49. Alternatively, a recording sheet can be fed while separated by a separation roller 52 from a manual sheet tray 54. The recording sheet fed from the manual sheet tray 54 is fed to a passage 53, and is also stopped once by the pair of registration rollers 49.

The registration rollers 49 are generally grounded, but a bias can be applied thereto to remove paper dust therefrom. The combined color toner image thus formed on the intermediate transfer medium 50 is secondarily transferred to the recording sheet, which is timely fed to the secondary transfer nip between the intermediate transfer medium and the secondary transfer device 22 by timely rotating the registration rollers 49, at the secondary transfer nip. Thus, a combined color toner image is formed on the recording sheet. Toner particles remaining on the surface of the intermediate transfer medium 50 even after the combined color toner image is transferred are removed therefrom by the intermediate transfer medium cleaner 17.

The recording sheet bearing the combined color toner image thereon is then fed by the secondary transfer device 22 to the fixing device 25, and the toner image is fixed to the recording sheet upon application of heat and pressure thereto by the fixing belt 26 and the pressure roller 27. The recording sheet bearing a fixed toner image thereon is discharged from the image forming section 150 by a discharge roller 56 while the path is properly selected by a sheet path switching pick 55. Thus, a copy is stacked on a copy tray 57.

When a duplex copy is produced, the sheet path switching pick 55 is switched to feed the recording sheet bearing a toner image on one side thereof to the reversing device 28 to reverse the recording sheet. The reversed recording sheet is fed again to the secondary transfer nip so that a second image formed on the intermediate transfer belt 50 is transferred to the other side of the recording sheet by the second transfer device 22. The second image formed on the other side of the recording sheet is also fixed by the fixing device 25 and the duplex copy is discharged to the copy tray 57 by the discharge roller 56.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

In the following examples and comparative examples, the methods for measuring the properties, the melting point (Tm), the phase (degree) of probe of AFM in tapping mode, the relaxation time in pulse NMR, the Martens' hardness at 50° C., the first glass transition temperature (Tg1st) measured in the first heating process, and the second glass transition temperature (Tg2nd) measured in the second heating process, are mentioned above.

The melting point (Tm) and relaxation time in pulse NMR of the block copolymer are determined by measuring those of the copolymers prepared in the below-mentioned manufacturing examples, and are not determined by separating the block copolymers from the toners and then measuring the properties of the block copolymers.

The melting point (Tm) of resins and the maximum melting point peak temperature of toners are determined using a differential scanning calorimetric (DSC) system, DSC-60 from Shimadzu Corp.

Specifically, when measuring the melting point of a resin, the maximum endothermic peak temperature is considered as the melting point. When measuring the melting point of a toner, the maximum endothermic peak temperature corresponding to that of the resin included in the toner is determined by the following method.

Specifically, by using the analysis program (i.e., "endothermic peak temperature") of the system (DSC-60), the endothermic peak of the resin in the DSC curve obtained in the second heating process is considered as the melting point of the toner.

The measuring conditions of the DSC system are the following.

Sample container: Aluminum sample pan with cap
Amount of sample: 5 mg
Reference: Aluminum sample pan containing 10 mg of alumina
Atmosphere: Nitrogen (flow rate of 50 ml/min)
Temperature conditions:
Start temperature: 20° C.
Temperature rising speed (in the first heating process): 10° C./min
End temperature: 150° C.
Retention time No retention time
Cooling speed: 10° C./min
End temperature: −20° C.
Retention time No retention time
Temperature rising speed (in the second heating process): 10° C./min
End temperature: 150° C.

Initially, non-crystalline segments (b) of block copolymers were prepared in Preparation Examples 1-1 to 1-3 below.

Preparation Example 1-1 (Preparation of Non-Crystalline Segment b1)

Propylene glycol serving as a diol component, and a mixture of dimethyl terephthalate and dimethyl adipate in a molar ratio of 90/10, which serves as a dicarboxylic acid component, were fed into a 5-liter four-necked flask equipped with a nitrogen feed pipe, a dewatering conduit, an agitator, and a thermocouple. In this regard, the ratio (OH/COOH) of the hydroxyl group (OH) of the diol component to the carboxyl group (COOH) of the dicarboxylic acid component was 1.2. In addition, titanium tetraisopropoxide was added to the flask in an amount of 300 ppm based on the weight of the raw materials fed into the flask while distilling out methanol to perform a reaction. In this regard, the temperature of the raw materials in the flask was increased to 230° C., and the reaction was performed until the resultant resin had an acid value of not greater than 5 mgKOH/g. The reaction product was further reacted for 4 hours under a reduced pressure of from 20 to 30 mmHg (i.e., 2,666 to 4,000 Pa) to prepare a non-crystalline segment b1, which is composed of a linear non-crystalline polymer (polyester) chain. The acid value (AV), hydroxyl value (OHV), and glass transition temperature (Tg) of the thus prepared non-crystalline polyester (i.e., the non-crystalline segment b1) were 1.08 mgKOH/g, 23.3 mgKOH/g, and 59.2° C., respectively.

Preparation Example 1-2 (Preparation of Non-Crystalline Segment b2)

Propylene glycol serving as a diol component, and a mixture of dimethyl terephthalate and dimethyl fumarate in a molar ratio of 83/17, which serves as a dicarboxylic acid component, were fed into a 5-liter four-necked flask equipped with a nitrogen feed pipe, a dewatering conduit, an agitator, and a thermocouple. In this regard, the ratio (OH/COOH) of the hydroxyl group (OH) of the diol component and the carboxyl group (COOH) of the dicarboxylic acid component was 1.3. In addition, titanium tetraisopropoxide was added to the flask in an amount of 300 ppm based on the weight of the raw materials while distilling out methanol to perform a reaction. In this regard, the temperature of the raw materials in the flask was increased to 230° C., and the reaction was performed until the resultant resin had an acid value of not greater than 5 mgKOH/g. The reaction product was further reacted for 4 hours under a reduced pressure of from 20 to 30 mmHg (i.e., 2,666 to 4,000 Pa) to prepare a non-crystalline segment b2, which is composed of a linear non-crystalline polymer (polyester) chain. The acid value (AV), hydroxyl value (OHV), and glass transition temperature (Tg) of the thus prepared non-crystalline polyester (i.e., the non-crystalline segment b2) were 0.58 mgKOH/g, 24.5 mgKOH/g, and 48.7° C., respectively.

Preparation Example 1-3 (Preparation of Non-Crystalline Segment b3)

Propylene glycol serving as a diol component, and dimethyl terephthalate serving as a dicarboxylic acid component, were fed into a 5-liter four-necked flask equipped with a nitrogen feed pipe, a dewatering conduit, an agitator, and a thermocouple. In this regard, the ratio (OH/COOH) of the hydroxyl group (OH) of the diol component and the carboxyl group (COOH) of the dicarboxylic acid component was 1.2. In addition, titanium tetraisopropoxide was added to the flask in an amount of 300 ppm based on the weight of the raw materials while distilling out methanol to perform a reaction. In this regard, the temperature of the raw materials in the flask was increased to 230° C., and the reaction was performed until the resultant resin had an acid value of not greater than 5 mgKOH/g. The reaction product was further reacted for 4 hours under a reduced pressure of from 20 to 30 mmHg (i.e., 2,666 to 4,000 Pa) to prepare a non-crystalline segment b3, which is composed of a linear non-crystalline polymer (polyester) chain. The acid value (AV), hydroxyl value (OHV), and glass transition temperature (Tg) of the thus prepared non-crystalline polyester (i.e., the non-crystalline segment b3) were 0.37 mgKOH/g, 25.3 mgKOH/g, and 72.0° C., respectively.

Next, crystalline segments (a) of block copolymers were prepared in Preparation Examples 2-1 to 2-3 below.

Preparation Example 2-1 (Preparation of Crystalline Segment a1)

Initially, 1,6-hexanediol serving as a diol component, and adipic acid serving as a dicarboxylic acid component, were fed into a 5-liter four-necked flask equipped with a nitrogen feed pipe, a dewatering conduit, an agitator, and a thermocouple. In this regard, the ratio (OH/COOH) of the hydroxyl group (OH) of the diol component and the carboxyl group (COOH) of the dicarboxylic acid component was 1.1. In addition, titanium tetraisopropoxide was added to the flask in an amount of 300 ppm based on the weight of the raw materials while distilling out water to perform a reaction. In this regard, the temperature of the raw materials in the flask was increased to 230° C., and the reaction was performed until the resultant resin had an acid value of not greater than 5 mgKOH/g. The reaction product was further reacted for 5 hours under a reduced pressure of not greater than 10 mmHg (i.e., 1,333 Pa) to prepare a crystalline segment a1, which is composed of a linear crystalline polymer (polyester) chain. The acid value (AV), hydroxyl value (OHV), and melting point (Tm) of the thus prepared crystalline polyester (i.e., the crystalline segment a1) were 0.45 mgKOH/g, 29.1 mgKOH/g, and 56.7° C., respectively.

Preparation Example 2-2 (Preparation of Crystalline Segment a2)

Initially, 1,6-hexanediol serving as a diol component, and sebacic acid serving as a dicarboxylic acid component, were fed into a 5-liter four-necked flask equipped with a nitrogen feed pipe, a dewatering conduit, an agitator, and a thermocouple. In this regard, the ratio (OH/COOH) of the hydroxyl group (OH) of the diol component and the carboxyl group (COOH) of the dicarboxylic acid component was 1.15. In addition, titanium tetraisopropoxide was added to the flask in an amount of 300 ppm based on the weight of the raw materials while distilling out water to perform a reaction. In this regard, the temperature of the raw materials in the flask was increased to 230° C., and the reaction was performed until the resultant resin had an acid value of not greater than 5 mgKOH/g. The reaction product was further reacted for 4 hours under a reduced pressure of not greater than 10 mmHg (i.e., 1,333 Pa) to prepare a crystalline segment a2, which is composed of a linear crystalline polymer (polyester) chain. The acid value (AV), hydroxyl value (OHV), and melting point (Tm) of the thus prepared crystalline polyester (i.e., the crystalline segment a2) were 0.52 mgKOH/g, 35.8 mgKOH/g, and 67.2° C., respectively.

Preparation Example 2-3 (Preparation of Crystalline Segment a3)

Initially, 1,4-butanediol serving as a diol component, and sebacic acid serving as a dicarboxylic acid component, were fed into a 5-liter four-necked flask equipped with a nitrogen feed pipe, a dewatering conduit, an agitator, and a thermocouple. In this regard, the ratio (OH/COOH) of the diol component and the dicarboxylic acid component was 1.1. In addition, titanium tetraisopropoxide was added to the flask in an amount of 300 ppm based on the weight of the raw materials while distilling out water to perform a reaction. In this regard, the temperature of the raw materials in the flask was increased to 230° C., and the reaction was performed until the resultant resin had an acid value of not greater than 5 mgKOH/g. The reaction product was further reacted for 6 hours under a reduced pressure of not greater than 10 mmHg (i.e., 1,333 Pa) to prepare a crystalline segment a3, which is composed of a linear crystalline polymer (polyester) chain. The acid value (AV), hydroxyl value (OHV), and melting point (Tm) of the thus prepared crystalline polyester (i.e., the crystalline segment a3) were 0.38 mgKOH/g, 22.6 mgKOH/g, and 63.8° C., respectively.

Next, block copolymers were prepared in Preparation Examples 3-1 to 3-7 below.

Preparation Example 3-1 (Preparation of Block Copolymer B1)

Initially, 1,300 g of the non-crystalline segment b1 prepared above and 700 g of the crystalline segment a1 prepared above were fed into a 5-liter four-necked flask equipped with a nitrogen feed pipe, a dewatering conduit, an agitator, and a thermocouple. The mixture was subjected to reduced-pressure drying for 2 hours under conditions of 60° C. in temperature and 10 mmHg (i.e., 1,333 Pa) in pressure. After pressure release was performed using a nitrogen gas, 2,000 g of ethyl acetate subjected to a dewatering treatment using MOLECULAR SIEVE 4 A was fed into the flask to dissolve the segments b1 and a1 in ethyl acetate under a nitrogen gas flow. Next, 136 g of 4,4'-diphenylmethane diisocyanate was fed into the flask, and the mixture was agitated until the mixture became visually uniform. After a catalyst, tin 2-ethylhexanate, was added thereto in an amount of 100 ppm based on the weight of the solid components of the resins, the mixture was heated to 80° C., followed by a reaction for 5 hours under reflux. Next, ethyl acetate was distilled out from the reaction product under a reduced pressure to prepare a block copolymer B1. The melting point (Tm), and spin-spin relaxation time of pulse NMR ((t50), (t130) and (t'70)) of the block copolymer B1 are shown in Table 1 below.

Preparation Example 3-2 (Preparation of Block Copolymer B2)

Initially, 1,480 g of the non-crystalline segment b1 prepared above and 520 g of the crystalline segment a1 prepared above were fed into a 5-liter four-necked flask equipped with a nitrogen feed pipe, a dewatering conduit, an agitator, and a thermocouple. The mixture was subjected to reduced-pressure drying for 2 hours under conditions of 60° C. in temperature and 10 mmHg (i.e., 1,333 Pa) in pressure. After pressure release was performed using a nitrogen gas, 2,000 g of ethyl acetate subjected to a dewatering treatment using MOLECULAR SIEVE 4 A was fed into the flask to dissolve the segments b1 and a1 in ethyl acetate under a nitrogen gas flow. Next, 133 g of 4,4'-diphenylmethane diisocyanate was fed into the flask, and the mixture was agitated until the mixture became visually uniform. After a catalyst, tin 2-ethylhexanate, was added thereto in an amount of 100 ppm based on the weight of the solid components of the resins, the mixture was heated to 80° C., followed by a reaction for 5 hours under reflux. Next, ethyl acetate was distilled out from the reaction product under a reduced pressure to prepare a block copolymer B2. The melting point (Tm), and spin-spin relaxation time of pulse NMR ((t50), (t130) and (t'70)) of the block copolymer B2 are shown in Table 1 below.

Preparation Example 3-3 (Preparation of Block Copolymer B3)

Initially, 1,550 g of the non-crystalline segment b2 prepared above and 450 g of the crystalline segment a2 prepared above were fed into a 5-liter four-necked flask equipped with a nitrogen feed pipe, a dewatering conduit, an agitator, and a thermocouple. The mixture was subjected to reduced-pressure drying for 2 hours under conditions of 60° C. in temperature and 10 mmHg (i.e., 1,333 Pa) in pressure. After pressure release was performed using a nitrogen gas, 2,000 g of ethyl acetate subjected to a dewatering treatment using MOLECULAR SIEVE 4 A was fed into the flask to dissolve the segments b1 and a1 in ethyl acetate under a nitrogen gas flow. Next, 145 g of 4,4'-diphenylmethane diisocyanate was fed into the flask, and the mixture was agitated until the mixture became visually uniform. After a catalyst, tin 2-ethylhexanate, was added thereto in an amount of 100 ppm based on the weight of the solid components of the resins, the mixture was heated to 80° C., followed by a reaction for 5 hours under reflux. Next, ethyl acetate was distilled out from the reaction product under a reduced pressure to prepare a block copolymer B3. The melting point (Tm), and spin-spin relaxation time of pulse NMR ((t50), (t130) and (t'70)) of the block copolymer B3 are shown in Table 1 below.

Preparation Example 3-4 (Preparation of Block Copolymer B4)

Initially, 1,560 g of the non-crystalline segment b1 prepared above and 440 g of the crystalline segment a2 prepared above were fed into a 5-liter four-necked flask equipped with a nitrogen feed pipe, a dewatering conduit, an agitator, and a thermocouple. The mixture was subjected to reduced-pressure drying for 2 hours under conditions of 60° C. in temperature and 10 mmHg (i.e., 1,333 Pa) in pressure. After pressure release was performed using a nitrogen gas, 2,000 g of ethyl acetate subjected to a dewatering treatment using MOLECULAR SIEVE 4 A was fed into the flask to dissolve the segments b1 and a1 in ethyl acetate under a nitrogen gas flow. Next, 140 g of 4,4'-diphenylmethane diisocyanate was fed into the flask, and the mixture was agitated until the mixture became visually uniform. After a catalyst, tin 2-ethylhexanate, was added thereto in an amount of 100 ppm based on the weight of the solid components of the resins, the mixture was heated to 80° C., followed by a reaction for 5 hours under reflux. Next, ethyl acetate was distilled out from the reaction product under a reduced pressure to prepare a block copolymer B4. The melting point (Tm), and spin-spin relaxation time of pulse NMR ((t50), (t130) and (t'70)) of the block copolymer B4 are shown in Table 1 below.

Preparation Example 3-5 (Preparation of Block Copolymer B5)

Initially, 1, 650 g of the non-crystalline segment b1 prepared above and 350 g of the crystalline segment a2 prepared above were fed into a 5-liter four-necked flask equipped with a nitrogen feed pipe, a dewatering conduit, an agitator, and a thermocouple. The mixture was subjected to reduced-pressure drying for 2 hours under conditions of 60° C. in temperature and 10 mmHg (i.e., 1,333 Pa) in pressure. After pressure release was performed using a nitrogen gas, 2,000 g of ethyl acetate subjected to a dewatering treatment using MOLECULAR SIEVE 4 A was fed into the flask to dissolve the segments b1 and a1 in ethyl acetate under a nitrogen gas flow. Next, 137 g of 4,4'-diphenylmethane diisocyanate was fed into the flask, and the mixture was agitated until the mixture became visually uniform. After a catalyst, tin 2-ethylhexanate, was added thereto in an amount of 100 ppm based on the weight of the solid components of the resins, the mixture was heated to 80° C., followed by a reaction for 5 hours under reflux. Next, ethyl acetate was distilled out from the reaction product under a reduced pressure to prepare a block copolymer B5. The melting point (Tm), and spin-spin relaxation time of pulse NMR ((t50), (t130) and (t'70)) of the block copolymer B5 are shown in Table 1 below.

Preparation Example 3-6 (Preparation of Block Copolymer B6)

Initially, 1, 450 g of the non-crystalline segment b3 prepared above and 550 g of the crystalline segment a3 prepared above were fed into a 5-liter four-necked flask equipped with a nitrogen feed pipe, a dewatering conduit, an agitator, and a thermocouple. The mixture was subjected to reduced-pressure drying for 2 hours under conditions of 60° C. in temperature and 10 mmHg (i.e., 1,333 Pa) in pressure. After pressure release was performed using a nitrogen gas, 2,000 g of ethyl acetate subjected to a dewatering treatment using MOLECULAR SIEVE 4 A was fed into the flask to dissolve the segments b1 and a1 in ethyl acetate under a nitrogen gas flow. Next, 132 g of 4,4'-diphenylmethane diisocyanate was fed into the flask, and the mixture was agitated until the mixture became visually uniform. After a catalyst, tin 2-ethylhexanate, was added thereto in an amount of 100 ppm based on the weight of the solid components of the resins, the mixture was heated to 80° C., followed by a reaction for 5 hours under reflux. Next, ethyl acetate was distilled out from the reaction product under a reduced pressure to prepare a block copolymer B6. The melting point (Tm), and spin-spin relaxation time of pulse NMR ((t50), (t130) and (t'70)) of the block copolymer B6 are shown in Table 1 below.

Preparation Example 3-7 (Preparation of Block Copolymer B7)

Initially, 900 g of the non-crystalline segment b1 prepared above and 1,100 g of the crystalline segment a1 prepared above were fed into a 5-liter four-necked flask equipped with a nitrogen feed pipe, a dewatering conduit, an agitator, and a thermocouple. The mixture was subjected to reduced-pressure drying for 2 hours under conditions of 60° C. in temperature and 10 mmHg (i.e., 1,333 Pa) in pressure. After pressure release was performed using a nitrogen gas, 2,000 g of ethyl acetate subjected to a dewatering treatment using MOLECULAR SIEVE 4 A was fed into the flask to dissolve the segments b1 and a1 in ethyl acetate under a nitrogen gas flow. Next, 142 g of 4,4'-diphenylmethane diisocyanate was fed into the flask, and the mixture was agitated until the mixture became visually uniform. After a catalyst, tin 2-ethylhexanate, was added thereto in an amount of 100 ppm based on the weight of the solid components of the resins, the mixture was heated to 80° C., followed by a reaction for 5 hours under reflux. Next, ethyl acetate was distilled out from the reaction product under a reduced pressure to prepare a block copolymer B7. The melting point (Tm), and spin-spin relaxation time of pulse NMR ((t50), (t130) and (t'70)) of the block copolymer B7 are shown in Table 1 below.

TABLE 1

| Block copolymer | Molar ratio (a/b) of crystalline segment (a) to non-crystalline segment (b) | Melting point (Tm) (° C.) | Relaxation time in pulse NMR (ms) t50 | t130 | t'70 |
|---|---|---|---|---|---|
| B1 | 40/60 | 56.3 | 1.8 | 15.2 | 2.7 |
| B2 | 30/70 | 56.3 | 1.2 | 9.0 | 2.0 |
| B3 | 30/70 | 65.4 | 1.1 | 14.2 | 1.5 |
| B4 | 30/70 | 67.2 | 1.1 | 15.1 | 1.1 |
| B5 | 25/75 | 67.0 | 0.7 | 16.0 | 1.4 |
| B6 | 25/75 | 63.7 | 0.4 | 20.1 | 0.7 |
| B7 | 60/40 | 56.8 | 2.3 | 4.5 | 3.9 |

Next, a crosslinking agent was prepared in Preparation Example 4-1, and crosslinked polyester resins were prepared in Preparation Examples 5-1 to 5-13 below.

Preparation Example 4-1 (Preparation of Crosslinking Agent (Ketimine Compound))

One hundred seventy (170) parts of isophoronediamine and 75 parts of methyl ethyl ketone were fed into a reaction container equipped with an agitator and a thermometer, and the mixture was reacted for 5 hours at 50° C. Thus, a ketimine compound 1 serving as a crosslinking agent (i.e., a compound reactive with a reactive precursor) was prepared. The amine value of the ketimine compound was 418 mgKOH/g.

Preparation Example 5-1 (Preparation of Crosslinked Polyester Resin C-1)

Initially, 25.8 parts of terephthalic acid, 27.8 parts of adipic acid, 44.9 parts of 3-methyl-1,5-pentanediol, 1.5 parts of trimethylolpropane, and 0.2 parts of dibutyltin oxide were fed into a reaction container equipped with a condenser, an agitator, and a nitrogen feed pipe. The mixture was reacted for 4 hours at 230° C. under a normal pressure, followed by a reaction for 5 hours under a reduced pressure of from 10 to 15 mmHg (1,333 to 2,000 Pa). Thus, an intermediate resin C-1 of a crosslinked polyester resin C-1 was prepared. The amounts of the monomers used for synthesizing the intermediate resin are described in Table 2-1 below.

Next, 90 parts of the intermediate resin C-1, and 10 parts of isophorone diisocyanate (IPDI) were fed into a reaction container equipped with a condenser, an agitator, and a nitrogen feed pipe. After the mixture was diluted with 100 parts of ethyl acetate, the mixture was subjected to a reaction for 5 hours at 80° C. Thus, an ethyl acetate solution of a prepolymer C-1 of a crosslinked polyester resin C-1 was prepared.

Preparation Examples 5-2 to 5-13 (Preparation of Crosslinked Polyester Resins C-2 to C-13)

The procedure for preparation of the prepolymer C-1 was repeated except that the monomers and the added amounts thereof were changed as described in Tables 2-1 and 2-2 below to prepare prepolymers C-2 to C-13 of crosslinked polyester resins C-2 to C-13.

TABLE 2-1

| Monomer | C-1 | C-2 | C-3 | C-4 | C-5 | C-6 | C-7 |
|---|---|---|---|---|---|---|---|
| Terephthalic acid | 25.8 | 25.8 | 25.5 | 26.1 | 27.3 | 28.9 | 28.9 |
| Adipic acid | 27.8 | 27.8 | 27.4 | 28.1 | 29.3 | 31.1 | 31.1 |
| Ethylene glycol | 0.0 | 0.0 | 0.0 | 0.0 | 0.0 | 0.0 | 0.0 |
| 1,4-Butanediol | 0.0 | 0.0 | 0.0 | 0.0 | 0.0 | 38.3 | 0.0 |
| 1,5-Pentanediol | 0.0 | 0.0 | 0.0 | 0.0 | 41.8 | 0.0 | 0.0 |
| 2-Methyl-1,3-propanediol | 0.0 | 0.0 | 0.0 | 0.0 | 0.0 | 0.0 | 38.3 |
| 3-Methyl-1,5-pentanediol | 44.9 | 44.9 | 44.3 | 43.3 | 0.0 | 0.0 | 0.0 |
| 1,12-Dodecanediol | 0.0 | 0.0 | 0.0 | 0.0 | 0.0 | 0.0 | 0.0 |
| Trimethylolpropane | 1.5 | 0.0 | 0.0 | 2.5 | 1.6 | 1.7 | 1.7 |
| Pentaerythritol | 0.0 | 1.6 | 0.0 | 0.0 | 0.0 | 0.0 | 0.0 |
| Dipentaerythritol | 0.0 | 0.0 | 2.9 | 0.0 | 0.0 | 0.0 | 0.0 |
| Trimellitic acid | 0.0 | 0.0 | 0.0 | 0.0 | 0.0 | 0.0 | 0.0 |
| Dibutyltin oxide | 0.2 | 0.2 | 0.2 | 0.2 | 0.2 | 0.2 | 0.2 |

Unit: molar percent

TABLE 2-2

| Monomer | C-8 | C-9 | C-10 | C-11 | C-12 | C-13 |
|---|---|---|---|---|---|---|
| Terephthalic acid | 34.1 | 39.5 | 25.8 | 26.2 | 19.6 | 32.8 |
| Adipic acid | 20.0 | 14.9 | 27.8 | 28.2 | 21.0 | 35.3 |
| Ethylene glycol | 0.0 | 0.0 | 0.0 | 0.0 | 0.0 | 30.0 |
| 1,4-Butanediol | 0.0 | 0.0 | 0.0 | 0.0 | 0.0 | 0.0 |
| 1,5-Pentanediol | 0.0 | 0.0 | 0.0 | 0.0 | 0.0 | 0.0 |
| 2-Methyl-1,3-propanediol | 0.0 | 0.0 | 0.0 | 0.0 | 0.0 | 0.0 |
| 3-Methyl-1,5-pentanediol | 44.4 | 44.1 | 44.9 | 45.6 | 0.0 | 0.0 |
| 1,12-Dodecanediol | 0.0 | 0.0 | 0.0 | 0.0 | 58.2 | 0.0 |
| Trimethylolpropane | 1.5 | 1.5 | 0.0 | 0.0 | 1.2 | 1.9 |
| Pentaerythritol | 0.0 | 0.0 | 0.0 | 0.0 | 0.0 | 0.0 |
| Dipentaerythritol | 0.0 | 0.0 | 0.0 | 0.0 | 0.0 | 0.0 |
| Trimellitic acid | 0.0 | 0.0 | 1.5 | 0.0 | 0.0 | 0.0 |
| Dibutyltin oxide | 0.2 | 0.2 | 0.2 | 0.2 | 0.2 | 0.2 |

Unit: molar percent

Preparation Example of Crystalline Polyester Resin E1

Initially, 202 parts (1.00 mole) of sebacic acid, 15 parts (0.10 mole) of adipic acid, 177 parts (1.50 mole) of 1,6-hexanediol, and 0.5 parts of tetrabutoxy titanate were fed into a reaction container equipped with a condenser, an agitator, and a nitrogen feed pipe. The mixture was reacted for 8 hours at 180° C. under a nitrogen gas flow while distilling out water generated. The temperature of the reaction product was gradually raised to 220° C. under a nitrogen gas flow, and the reaction product was further reacted for 8 hours while distilling out water generated and 1,6-hexanediol. Further, the reaction product was reacted under a reduced pressure of from 5 to 20 mmHg (667 to 2,666 Pa) until the resin had a weight average molecular weight (Mw) of about 20,000. Thus, a crystalline polyester resin E1 was prepared. It was confirmed that the crystalline polyester resin E1 has a weight average molecular weight (Mw) of 22,000.

By using the block copolymers B1 to B7, and the prepolymers C-1 to C-13 of crosslinked polyester resins C-1 to C-13, and optionally using the crystalline polyester resin E1, toners of Examples 1 to 16 and Comparative Example 1 to 5 were prepared.

Example 1

1. Preparation of Colorant Master Batch P

One hundred (100) parts of the block copolymer B1, 100 parts of a cyan pigment (C.I. Pigment Blue 15:3), and 30 parts of ion-exchange water were well mixed, and the mixture was kneaded using an open-roller type kneader (KNEADEX from NIPPON COKE & ENGINEERING CO., LTD. In this regard, kneading was started from 90° C., and the kneading temperature was gradually decreased to 50° C. The weight ratio of the resin to the pigment was 1:1. Thus, a colorant master batch P1 was prepared. The colorant master batch P1 was used for the toners of Examples 1, 7, 8 and 10-16, and Comparative Examples 1-5.

In addition, colorant master batches P2 to P7 were also prepared by replacing the block copolymer B1 with each of the block copolymers B2 to B7, and the colorant master batches P2 to P7 were used for the toners of Examples 2-6 and 9, respectively.

2. Preparation of Wax Dispersion

Fifty (50) parts of a release agent 1, i.e., a paraffin wax HNP-9 from NIPPON SEIRO CO., LTD., which is a hydrocarbon wax having a melting point of 75° C., and 450 parts of ethyl acetate were fed into a container equipped with an agitator and a thermometer, and the mixture was heated to 80° C. while being agitated. After being heated for 5 hours at 80° C., the mixture was cooled to 30° C. over 1 hour. Next, the mixture was subjected to a dispersing treatment using a bead mill (ULTRAVISCOMILL from AIMEX Co., Ltd.) under the following conditions:

Liquid feeding speed: 1 kg/hr
Peripheral speed of disc: 6 m/s
Beads used: Zirconia beads with a diameter of 0.5 mm
Filling rate of beads: 80% by volume
Number of dispersing treatments performed: 3 (i.e., 3 passes)

Thus, a wax dispersion 1 was prepared.

3. Preparation of Crystalline Polyester Dispersion

Fifty (50) parts of a crystalline polyester resin D-1 serving as a crystalline resin, and 450 parts of ethyl acetate were fed into a container equipped with an agitator and a thermometer, and the mixture was heated to 80° C. while being agitated. After being heated for 5 hours at 80° C., the mixture was cooled to 30° C. over 1 hour. Next, the mixture was subjected to a dispersing treatment using a bead mill (ULTRAVISCOMILL from AIMEX Co., Ltd.) under the above-mentioned conditions. Thus, a crystalline polyester resin dispersion 1 was prepared.

The melting point, acid value, weight average molecular weight (Mw), number average molecular weight (Mn), and Mw/Mn ratio of the crystalline polyester resin D-1 were 65° C., 28 mgKOH/g, 15,000, 3,000 and 4.8 respectively.

4. Preparation of Oil Phase Liquid

The following components were fed into a container.

| | |
|---|---|
| Wax dispersion 1 prepared above | 500 parts |
| Prepolymer C-1 prepared above | 300 parts |
| Ketimine compound 1 prepared above | 2 parts |
| Crystalline polyester resin dispersion 1 prepared above | 500 parts |
| Block copolymer resin B1 prepared above | 700 parts |
| Colorant master batch P1 prepared above | 100 parts |

The mixture was mixed for 60 minutes by a mixer (TK HOMOMIXER from PRIMIX Corp.) under conditions of 50° C. in temperature and 5,000 rpm in revolution of rotor.

Thus, an oil phase liquid 1 was prepared. In this regard, before use, the oil phase liquid 1 was contained in the container while maintaining the temperature thereof at 50° C.

5. Preparation of Particulate Organic Material Emulsion (Particulate Material Dispersion 1)

The following components were fed into a reaction container equipped with an agitator and a thermometer.

| | |
|---|---|
| Water | 683 parts |
| Sodium salt of sulfate of ethylene oxide adduct of methacrylic acid (ELEMINOL RS-30 from Sanyo Chemical Industries Ltd.) | 11 parts |
| Styrene | 138 parts |
| Methacrylic acid | 138 parts |
| Ammonium persulfate | 1 part |

The mixture was agitated for 15 minutes using the agitator rotated at 400 rpm. As a result, a white emulsion was prepared. After the emulsion was heated to 75° C., the emulsion was reacted for 5 hours at 75° C. Further, 30 parts of a 1% aqueous solution of ammonium persulfate was added thereto, and the mixture was aged for 5 hours at 75° C. Thus, an aqueous dispersion of a vinyl resin (i.e., copolymer of styrene-methacrylic acid-sodium salt of sulfate of ethylene oxide adduct of methacrylic acid) (hereinafter referred to as a particulate material dispersion 1) was prepared.

The volume average particle diameter of the particulate material dispersion 1, which was determined by an instrument, LA-920 from HORIBA LTD., was 0.14 μm. In addition, part of the particulate material dispersion 1 was dried to obtain a solid of the resin.

6. Preparation of Aqueous Phase Liquid

The following components were mixed at 40° C. while agitated to prepare an aqueous phase liquid 1, which is a milk white liquid.

| | |
|---|---|
| Water | 990 parts |
| Particulate material dispersion 1 prepared above | 83 parts |
| Aqueous solution of sodium salt of dodecyldiphenyl ether disulfonic acid (ELEMINOL MON-7 from Sanyo Chemical Industries Ltd., solid content of 48.5%) | 37 parts |
| Ethyl acetate | 90 parts |

7. Emulsification and Solvent Removal

One thousand and two hundred (1,200) parts of the aqueous phase liquid 1 was fed into the container including the oil phase liquid 1 whose temperature was maintained at 50° C., and the mixture was mixed for 1 minute using a mixer (TK HOMOMIXER from PRIMIX Corp.) under conditions of 45 to 48° C. in temperature and 12,000 rpm in revolution of rotor. Thus, an emulsion slurry 1 was prepared. The emulsified slurry 1 was fed into a container equipped with an agitator and a thermometer, and was subjected to a solvent removal treatment for 8 hours at 30° C., followed by aging for 4 hours at 45° C. Thus, dispersion slurry 1 was prepared.

8. Washing and Drying

After 100 parts of the dispersion slurry 1 was subjected to filtering under a reduced pressure, the filter cake was washed as follows.

(1) One hundred (100) parts of ion-exchange water was added to the filter cake, and the mixture was well mixed for 10 minutes using a mixer (TK HOMOMIXER from PRIMIX Corp.) under a condition of 12,000 rpm in revolution of rotor, followed by filtering.

(2) One hundred (100) parts of a 10% aqueous solution of sodium hydroxide was added to the filter cake obtained in paragraph (1), and the mixture was well mixed for 30 minutes using the mixer (TK HOMOMIXER from PRIMIX Corp.) under a condition of 12,000 rpm in revolution of rotor, followed by filtering under a reduced pressure.

(3) One hundred (100) parts of a 10% aqueous solution of hydrochloric acid was added to the filter cake obtained in paragraph (2), and the mixture was well mixed for 10 minutes using the mixer (TK HOMOMIXER from PRIMIX Corp.) under a condition of 12,000 rpm in revolution of rotor, followed by filtering.

(4) Three hundred (300) parts of ion-exchange water was added to the filter cake obtained in paragraph (3), and the mixture was well mixed for 10 minutes using the mixer (TK HOMOMIXER from PRIMIX Corp.) under a condition of 12,000 rpm in revolution of rotor, followed by filtering.

(5) The operations (1)-(4) were performed twice to prepare a filter cake 1.

The filter cake 1 was dried for 48 hours at 45° C., followed by sieving using a 75-mesh screen. Thus, toner particles 1 were prepared.

9. Preparation of Toner

The following components were mixed by a HENSCHEL MIXER mixer to prepare a toner 1.

| | |
|---|---|
| Toner particles 1 prepared above | 100 parts |
| Hydrophobized silica (HDK-2000 from Wacker Chemie) | 1.0 part |
| Titanium oxide (MT-150AI from Tayca Corp.) | 0.3 parts |

The phase (degree) of probe of AFM in tapping mode, the relaxation time (t50, t130 and t'70) in pulse NMR, the Martens' hardness at 50° C., the first glass transition temperature (Tg1st) measured in the first heating process, and the second glass transition temperature (Tg2nd) measured in the second heating process of the toner 1 were measured by the methods mentioned above. The evaluation results of the toner 1 are shown in Table 3-1 below.

Example 2

The procedure for preparation of the toner 1 in Example 1 was repeated except that the block copolymer B1 used for preparing the oil phase liquid was replaced with the block copolymer B2, and the colorant master batch P1 using the block copolymer B1 was replaced with the colorant master batch P2 using the block copolymer B2 to prepare a toner 2, and the toner 2 was evaluated by the methods mentioned above.

The evaluation results of the toner 2 are shown in Table 3-1 below.

Example 3

The procedure for preparation of the toner 1 in Example 1 was repeated except that the block copolymer B1 used for preparing the oil phase liquid was replaced with the block copolymer B3, and the colorant master batch P1 using the block copolymer B1 was replaced with the colorant master batch P3 using the block copolymer B3 to prepare a toner 3, and the toner 3 was evaluated by the methods mentioned above.

The evaluation results of the toner 3 are shown in Table 3-1 below.

Example 4

The procedure for preparation of the toner 1 in Example 1 was repeated except that the block copolymer B1 used for preparing the oil phase liquid was replaced with the block copolymer B4, and the colorant master batch P1 using the block copolymer B1 was replaced with the colorant master batch P4 using the block copolymer B4 to prepare a toner 4, and the toner 4 was evaluated by the methods mentioned above.

The evaluation results of the toner 4 are shown in Table 3-2 below.

Example 5

The procedure for preparation of the toner 1 in Example 1 was repeated except that the block copolymer B1 used for preparing the oil phase liquid was replaced with the block copolymer B5, and the colorant master batch P1 using the block copolymer B1 was replaced with the colorant master batch P5 using the block copolymer B5 to prepare a toner 5, and the toner 5 was evaluated by the methods mentioned above.

The evaluation results of the toner 5 are shown in Table 3-2 below.

Example 6

The procedure for preparation of the toner 1 in Example 1 was repeated except that the block copolymer B1 used for preparing the oil phase liquid was replaced with the block copolymer B6, and the colorant master batch P1 using the block copolymer B1 was replaced with the colorant master batch P6 using the block copolymer B6 to prepare a toner 6, and the toner 6 was evaluated by the methods mentioned above.

The evaluation results of the toner 6 are shown in Table 3-2 below.

Example 7

The procedure for preparation of the toner 1 in Example 1 was repeated except that the prepolymer C-1 used for preparing the oil phase liquid was replaced with the prepolymer C-2 to prepare a toner 7, and the toner 7 was evaluated by the methods mentioned above.

The evaluation results of the toner 7 are shown in Table 3-3 below.

Example 8

The procedure for preparation of the toner 1 in Example 1 was repeated except that the prepolymer C-1 used for preparing the oil phase liquid was replaced with the prepolymer C-3 to prepare a toner 8, and the toner 8 was evaluated by the methods mentioned above.

The evaluation results of the toner 8 are shown in Table 3-3 below.

Example 9

The procedure for preparation of the toner 1 in Example 1 was repeated except that the block copolymer B1 used for preparing the oil phase liquid was replaced with the block copolymer B7, and the colorant master batch P1 using the block copolymer B1 was replaced with the colorant master batch P7 using the block copolymer B7 to prepare a toner 9, and the toner 9 was evaluated by the methods mentioned above.

The evaluation results of the toner 9 are shown in Table 3-3 below.

Example 10

The procedure for preparation of the toner 1 in Example 1 was repeated except that the prepolymer C-1 used for preparing the oil phase liquid was replaced with the prepolymer C-4 to prepare a toner 10, and the toner 10 was evaluated by the methods mentioned above.

The evaluation results of the toner 10 are shown in Table 4-1 below.

Example 11

The procedure for preparation of the toner 1 in Example 1 was repeated except that the prepolymer C-1 used for preparing the oil phase liquid was replaced with the prepolymer C-5 to prepare a toner 11, and the toner 11 was evaluated by the methods mentioned above.

The evaluation results of the toner 11 are shown in Table 4-1 below.

Example 12

The procedure for preparation of the toner 1 in Example 1 was repeated except that the prepolymer C-1 used for preparing the oil phase liquid was replaced with the prepolymer C-6 to prepare a toner 12, and the toner 12 was evaluated by the methods mentioned above. The evaluation results of the toner 12 are shown in Table 4-1 below.

Example 13

The procedure for preparation of the toner 1 in Example 1 was repeated except that the prepolymer C-1 used for preparing the oil phase liquid was replaced with the prepolymer C-7 to prepare a toner 13, and the toner 13 was evaluated by the methods mentioned above.

The evaluation results of the toner 13 are shown in Table 4-1 below.

Example 14

The procedure for preparation of the toner 1 in Example 1 was repeated except that the prepolymer C-1 used for preparing the oil phase liquid was replaced with the prepolymer C-8 to prepare a toner 14, and the toner 14 was evaluated by the methods mentioned above.

The evaluation results of the toner 14 are shown in Table 4-2 below.

Example 15

The procedure for preparation of the toner 1 in Example 1 was repeated except that the prepolymer C-1 used for preparing the oil phase liquid was replaced with the prepolymer C-9 to prepare a toner 15, and the toner 15 was evaluated by the methods mentioned above.

The evaluation results of the toner 15 are shown in Table 4-2 below.

Example 16

The procedure for preparation of the toner 1 in Example 1 was repeated except that the prepolymer C-1 used for preparing the oil phase liquid was replaced with the prepolymer C-10 to prepare a toner 16, and the toner 16 was evaluated by the methods mentioned above.

The evaluation results of the toner 16 are shown in Table 4-2 below.

Comparative Example 1

The procedure for preparation of the toner 1 in Example 1 was repeated except that the prepolymer C-1 used for preparing the oil phase liquid was replaced with the prepolymer C-11 to prepare a toner 17, and the toner 17 was evaluated by the methods mentioned above.

The evaluation results of the toner 17 are shown in Table 5-1 below.

Comparative Example 2

The procedure for preparation of the toner 1 in Example 1 was repeated except that the prepolymer C-1 used for preparing the oil phase liquid was replaced with the prepolymer C-12 to prepare a toner 18, and the toner 18 was evaluated by the methods mentioned above.

The evaluation results of the toner 18 are shown in Table 5-1 below.

Comparative Example 3

The procedure for preparation of the toner 1 in Example 1 was repeated except that the prepolymer C-1 used for preparing the oil phase liquid was replaced with the prepolymer C-13 to prepare a toner 19, and the toner 19 was evaluated by the methods mentioned above.

The evaluation results of the toner 19 are shown in Table 5-1 below.

Comparative Example 4

The procedure for preparation of the toner 1 in Example 1 was repeated except that the prepolymer C-1 used for preparing the oil phase liquid was not used to prepare a toner 20, and the toner 20 was evaluated by the methods mentioned above.

The evaluation results of the toner 20 are shown in Table 5-2 below.

Comparative Example 5

The procedure for preparation of the toner 1 in Example 1 was repeated except that the block copolymer B1 used for preparing the oil phase liquid was replaced with the crystalline polyester resin E1 to prepare a toner 21, and the toner 21 was evaluated by the methods mentioned above.

The evaluation results of the toner 21 are shown in Table 5-2 below.

Preparation of Developer

1. Preparation of Carrier

The following components were mixed for 20 minutes using a mixer (HOMOMIXER) to prepare a resin layer coating liquid.

| | |
|---|---|
| Toluene | 100 parts |
| Organo straight silicone resin | 100 parts |
| γ-(2-Aminoethyl)aminopropyltrimethoxysilane | 5 parts |
| Carbon black | 10 parts |

One thousand (1,000) parts of a spherical magnetite with an average particle diameter of 50 μm was coated with the resin layer coating liquid using a fluidized bed type coating device to cover the surface of the spherical magnetite with the resin layer. Thus, a carrier was prepared.

2. Preparation of Developers

The following components were mixed using a ball mill to prepare developers 1 to 21.

| | |
|---|---|
| Each of toners 1 to 21 | 5 parts |
| The carrier prepared above | 95 parts |

Evaluation of the Toners 1-21 and the Developers 1-21

1. Fixability of Toner (Lowest Fixable Temperature)

Each of the developers 1-21 was set in the tandem full color image forming apparatus 100C illustrated in FIG. 3, and a solid toner image with a size of 3 cm×8 cm, which has a weight of 0.85±0.10 mg/cm$^2$, was formed on a position of a surface of a recording paper (copying/printing paper <70> from Ricoh Japan Corp.) apart from the tip of the recording paper by 3.0 cm. The solid toner images were fixed while changing the temperature of the fixing belt. In this regard, the fixing speed was 280 mm/sec. Drawing was performed on the surface of each of the fixed toner images using a drawing tester AD-401 from Ueshima Seisakusho Co., Ltd. In this regard, the fixed toner image was contacted at a load of 50 g with a ruby needle whose tip is rounded while having a radius of from 260 μm to 320 μm and a tip angle of 60°. After the surface of the fixed toner image on which drawing was performed was strongly rubbed 5 times with a nonwoven fabric (HANICOT #440 from Haniron K.K.), the surface was visually observed to determine whether or not the fixed toner image is peeled. The lowest fixable temperature of the toner was determined as a minimum fixing temperature (i.e., temperature of the fixing belt) above which the toner image can be fixed to an extent such that the fixed toner image is not peeled even after being rubbed by the nonwoven fabric.

The lowest fixable temperature property of the toner was graded as follows.

◎◎: The lowest fixable temperature is not higher than 100° C. (Excellent)

◎: The lowest fixable temperature is higher than 100° C. and not higher than 105° C., ○: The lowest fixable temperature is higher than 105° C. and not higher than 115° C.

Δ: The lowest fixable temperature is higher than 115° C. and not higher than 130° C.

X: The lowest fixable temperature is higher than 130° C. (Bad)

2. Fixability of Toner (Hot Offset Resistance, and Fixable Temperature Range)

Each of the developers 1-21 was set in the tandem full color image forming apparatus 100C illustrated in FIG. 3, and a solid toner image with a size of 3 cm×8 cm, which has a weight of 0.85±0.10 mg/cm$^2$, was formed on a position of a surface of a recording paper (TYPE 6200 from Ricoh Japan Corp.) apart from the tip of the recording paper by 3.0 cm. The solid toner images were fixed while changing the temperature of the fixing belt, and the fixed toner images were visually observed. In this regard, the fixing speed was 280 mm/sec. A fixable temperature range of the toner, which means the difference between the lowest fixable temperature of the toner determined above and a highest fixable temperature of the toner, was determined to evaluate the fixability of the toner. In this regard, the highest fixable temperature means a maximum fixing temperature below which the toner does not cause the hot offset problem in that part or entirety of the toner image is adhered to a fixing member of the fixing device, and therefore the fixed toner image is partially or entirely missing.

The fixability of the toner was graded as follows.

◎: The fixable temperature range is wider than 100° C. (Excellent)

○: The fixable temperature range is not wider than 100° C. and wider than 55° C.

Δ: The fixable temperature range is not wider than 55° C. and wider than 30° C.

X: The fixable temperature range is not wider than 30° C. (Bad)

The fixable temperature range of conventional full color toners is about 50° C.

3. High Temperature Preservability of Toner

Each of the toners 1-21 was preserved for 8 hours at 50° C., and the toner was sieved for 2 minutes using 42-mesh screen, followed by measurement of the weight of the toner remaining on the screen to determine the weight ratio of the residual toner (residual ratio). In this regard, the smaller residual ratio a toner has, the better high temperature preservability the toner has. The high temperature preservability of the toner was graded as follows.

◎◎: The residual ratio is less than 5%. (Excellent)

◎: The residual ratio is not less than 5% and less than 10%.

○: The residual ratio is not less than 10% and less than 20%.

Δ: The residual ratio is not less than 20% and less than 30%.

X: The residual ratio is not less than 30%. (Bad)

4. Rub Resistance of Toner

A fixed toner image of each of the developers 1-21 produced by the tandem image forming apparatus 100C illustrated in FIG. 3 was visually observed to determine whether or not the image has a portion having a relatively low or high glossiness, and to determine whether or not the image has a defective image such as scratched image or image having a portion missing. The rub resistance of the toner was graded as follows.

◎◎: The image has no portion having different glossiness and no defective image. (Excellent)

◎: A portion of the image contacted with a feeding member of the image forming apparatus and a portion of the image not contacted with the feeding member have slightly different glossinesses, and when the image is observed by properly changing the light irradiation direction, the trail of the feeding member can be visually observed marginally.

○: A portion of the image contacted with a feeding member of the image forming apparatus and a portion of the image not contacted with the feeding member have slightly different glossinesses, and when the image is observed by properly changing the light irradiation direction, the trail of the feeding member can be visually observed.

Δ: A portion of the image contacted with a feeding member of the image forming apparatus and a portion of the image not contacted with the feeding member clearly have different glossinesses, and therefore the trail of the feeding member can be visually observed.

X: A portion of the image contacted with a feeding member of the image forming apparatus and a portion of the image not contacted with the feeding member clearly have different glossinesses, and in addition the image has a scratched image and an image having a portion missing. (Bad)

TABLE 3-1

| Example No. | | Example 1 | Example 2 | Example 3 |
|---|---|---|---|---|
| Toner No. | | Toner 1 | Toner 2 | Toner 3 |
| Block copolymer B | Name | B1 | B2 | B3 |
| | Crystalline segment (a) | a1 | a1 | a2 |
| | Diol | 1,6-Hexanediol | 1,6-Hexanediol | 1,6-Hexanediol |
| | Dicarboxylic acid | Adipic acid | Adipic acid | Sebacic acid |
| | Non-crystalline segment (b) | b1 | b1 | b2 |
| | Diol | Propylene glycol | Propylene glycol | Propylene glycol |
| | Dicarboxylic acid | DMTP/DMAP (90/10 by mole) | DMTP/DMAP (90/10 by mole) | DMTP/DMFM (83/17 by mole) |
| | Crystalline segment (a)/non-crystalline segment (b) | 40/60 by mole | 30/70 by mole | 30/70 by mole |
| | Melting point (° C.) | 56.5 | 56.3 | 65.4 |
| Non-linear crosslinked polyester resin C | | C-1 | C-1 | C-1 |
| Phase of probe of AFM in tapping mode | A (degree) | 70 | 70 | 71 |
| | B (degree) | 60 | 60 | 60 |
| | C (degree) | 70 | 70 | 70 |
| | C − B (degree) | 10 | 10 | 10 |
| Relaxation time in pulse NMR | t50 | 0.95 | 0.25 | 0.65 |
| | t'70 | 1.55 | 1.3 | 1.3 |
| | t130 | 13 | 11 | 14 |
| Martens' hardness at 50° C. ($N/mm^2$) | | 56 | 60 | 59 |
| First glass transition temperature (Tg1st) | | 40 | 43 | 45 |
| Second glass transition temperature (Tg2nd) | | 20 | 26 | 26 |
| Evaluation results | Lowest fixable temperature | ○ | ○ | ○ |
| | Fixable temperature range | ○ | ○ | ○ |
| | High temperature preservability | ○ | ○ | ◎ |
| | Rub resistance | ○ | ◎ | ◎ |

DMTP: Dimethyl terephthalate
DMAP: Dimethyl adipate
DMFM: Dimethyl fumarate

TABLE 3-2

| Example No. | | Example 4 | Example 5 | Example 6 |
|---|---|---|---|---|
| Toner No. | | Toner 4 | Toner 5 | Toner 6 |
| Block copolymer B | Name | B4 | B5 | B6 |
| | Crystalline segment (a) | a2 | a2 | a3 |
| | Diol | 1,6-Hexanediol | 1,6-Hexanediol | 1,4-Butanediol |
| | Dicarboxylic acid | Sebacic acid | Sebacic acid | Sebacic acid |
| | Non-crystalline segment (b) | b1 | b1 | b3 |
| | Diol | Propylene glycol | Propylene glycol | Propylene glycol |
| | Dicarboxylic acid | DMTP/DMAP (90/10 by mole) | DMTP/DMAP (90/10 by mole) | DMTP |
| | Crystalline segment (a)/non-crystalline segment (b) | 30/70 by mole | 25/75 by mole | 25/75 by mole |
| | Melting point (° C.) | 67.1 | 67.1 | 63.4 |

TABLE 3-2-continued

| Example No. | | Example 4 | Example 5 | Example 6 |
|---|---|---|---|---|
| Non-linear crosslinked polyester resin C | | C-1 | C-1 | C-1 |
| Phase of probe of AFM in tapping mode | A (degree) | 74 | 70 | 71 |
| | B (degree) | 61 | 57 | 55 |
| | C (degree) | 70 | 70 | 70 |
| | C − B (degree) | 9 | 13 | 15 |
| Relaxation time in pulse NMR | t50 | 0.05 | 0.03 | 0.02 |
| | t'70 | 0.1 | 0.2 | 0.1 |
| | t130 | 13 | 10 | 10 |
| Martens' hardness at 50° C. ($N/mm^2$) | | 78 | 82 | 90 |
| First glass transition temperature (Tg1st) | | 47 | 48 | 44 |
| Second glass transition temperature (Tg2nd) | | 27 | 28 | 27 |
| Evaluation results | Lowest fixable temperature | ○ | ○ | ◎ |
| | Fixable temperature range | ○ | ○ | ○ |
| | High temperature preservability | ◎ | ◎◎ | ◎◎ |
| | Rub resistance | ◎◎ | ◎◎ | ◎◎ |

DMTP: Dimethyl terephthalate
DMAP: Dimethyl adipate

TABLE 3-3

| Example No. | | Example 7 | Example 8 | Example 9 |
|---|---|---|---|---|
| Toner No. | | Toner 7 | Toner 8 | Toner 9 |
| Block copolymer B | Name | B1 | B1 | B7 |
| | Crystalline segment (a) | a1 | a1 | a1 |
| | Diol | 1,6-Hexanediol | 1,6-Hexanediol | 1,6-Hexanediol |
| | Dicarboxylic acid | Adipic acid | Adipic acid | Adipic acid |
| | Non-crystalline segment (b) | b1 | b1 | b1 |
| | Diol | Propylene glycol | Propylene glycol | Propylene glycol |
| | Dicarboxylic acid | DMTP/DMAP (90/10 by mole) | DMTP/DMAP (90/10 by mole) | DMTP/DMAP (90/10 by mole) |
| | Crystalline segment (a)/non-crystalline segment (b) | 40/60 by mole | 40/60 by mole | 60/40 by mole |
| | Melting point (° C.) | 56.5 | 56.5 | 56.5 |
| Non-linear crosslinked polyester resin C | | C-2 | C-3 | C-1 |
| Phase of probe of AFM in tapping mode | A (degree) | 72 | 70 | 72 |
| | B (degree) | 60 | 60 | 60 |
| | C (degree) | 69 | 70 | 70 |
| | C − B (degree) | 9 | 10 | 10 |
| Relaxation time in pulse NMR | t50 | 0.05 | 1.15 | 1.45 |
| | t'70 | 1.7 | 1.9 | 2.8 |
| | t130 | 16 | 12 | 10 |
| Martens' hardness at 50° C. ($N/mm^2$) | | 75 | 50 | 18 |
| First glass transition temperature (Tg1st) | | 42 | 40 | 39 |
| Second glass transition temperature (Tg2nd) | | 22 | 23 | 18 |
| Evaluation results | Lowest fixable temperature | ○ | Δ | ◎ |
| | Fixable temperature range | ○ | ○ | ○ |
| | High temperature preservability | ○ | ○ | Δ |
| | Rub resistance | ○ | ○ | Δ |

DMTP: Dimethyl terephthalate
DMAP: Dimethyl adipate

TABLE 4-1

| Example No. | | Example 10 | Example 11 | Example 12 | Example 13 |
|---|---|---|---|---|---|
| Toner No. | | Toner 10 | Toner 11 | Toner 12 | Toner 13 |
| Block copolymer B | Name | B1 | B1 | B1 | B1 |
| | Crystalline segment (a) | a1 | a1 | a1 | a1 |
| | Diol | 1,6-Hexanediol | 1,6-Hexanediol | 1,6-Hexanediol | 1,6-Hexanediol |
| | Dicarboxylic acid | Adipic acid | Adipic acid | Adipic acid | Adipic acid |
| | Non-crystalline segment (b) | b1 | b1 | b1 | b1 |
| | Diol | Propylene glycol | Propylene glycol | Propylene glycol | Propylene glycol |
| | Dicarboxylic acid | DMTP/DMAP (90/10 by mole) | DMTP/DMAP (90/10 by mole) | DMTP/DMAP (90/10 by mole) | DMTP/DMAP (90/10 by mole) |
| | Crystalline segment (a)/non-crystalline segment (b) | 40/60 by mole | 40/60 by mole | 40/60 by mole | 40/60 by mole |
| | Melting point (° C.) | 56.5 | 56.5 | 56.5 | 56.5 |
| Non-linear crosslinked polyester resin C | | C-4 | C-5 | C-6 | C-7 |
| Phase of probe of AFM in tapping mode | A (degree) | 70 | 70 | 70 | 70 |
| | B (degree) | 60 | 60 | 60 | 60 |
| | C (degree) | 73 | 72 | 70 | 68 |
| | C − B (degree) | 13 | 12 | 10 | 8 |
| Relaxation time in pulse NMR | t50 | 0.90 | 0.80 | 0.45 | 0.05 |
| | t'70 | 2 | 1.8 | 1.5 | 0.7 |
| | t130 | 10 | 12 | 10 | 18 |
| Martens' hardness at 50° C. ($N/mm^2$) | | 70 | 73 | 16 | 75 |
| First glass transition temperature (Tg1st) | | 37 | 48 | 49 | 43 |
| Second glass transition temperature (Tg2nd) | | 12 | 24 | 25 | 25 |
| Evaluation results | Lowest fixable temperature | ◎ | ○ | ○ | ○ |
| | Fixable temperature range | Δ | ○ | ○ | ○ |
| | High temperature preservability | Δ | Δ | Δ | ◎ |
| | Rub resistance | ○ | ○ | Δ | ○ |

DMTP: Dimethyl terephthalate
DMAP: Dimethyl adipate

TABLE 4-2

| Example No. | | Example 14 | Example 15 | Example 16 |
|---|---|---|---|---|
| Toner No. | | Toner 14 | Toner 15 | Toner 16 |
| Block copolymer B | Name | B1 | B1 | B7 |
| | Crystalline segment (a) | a1 | a1 | a1 |
| | Diol | 1,6-Hexanediol | 1,6-Hexanediol | 1,6-Hexanediol |
| | Dicarboxylic acid | Adipic acid | Adipic acid | Adipic acid |
| | Non-crystalline segment (b) | b1 | b1 | b1 |
| | Diol | Propylene glycol | Propylene glycol | Propylene glycol |
| | Dicarboxylic acid | DMTP/DMAP (90/10 by mole) | DMTP/DMAP (90/10 by mole) | DMTP/DMAP (90/10 by mole) |
| | Crystalline segment (a)/non-crystalline segment (b) | 40/60 by mole | 40/60 by mole | 40/60 by mole |
| | Melting point (° C.) | 56.5 | 56.5 | 56.5 |
| Non-linear crosslinked polyester resin C | | C-8 | C-9 | C-10 |
| Phase of probe of AFM in tapping mode | A (degree) | 70 | 70 | 72 |
| | B (degree) | 60 | 60 | 60 |
| | C (degree) | 69 | 68 | 68 |
| | C − B (degree) | 9 | 8 | 8 |
| Relaxation time in pulse NMR | 150 | 0.03 | 0.02 | 0.03 |
| | t'70 | 1 | 0.5 | 0.6 |
| | t130 | 13 | 7 | 18 |

TABLE 4-2-continued

| Example No. | | Example 14 | Example 15 | Example 16 |
|---|---|---|---|---|
| Martens' hardness at 50° C. ($N/mm^2$) | | 77 | 80 | 72 |
| First glass transition temperature (Tg1st) | | 46.5 | 48 | 42 |
| Second glass transition temperature (Tg2nd) | | 29 | 32 | 22 |
| Evaluation results | Lowest fixable temperature | ○ | Δ | Δ |
| | Fixable temperature range | ○ | ○ | Δ |
| | High temperature preservability | ◎ | ◎ | ◎ |
| | Rub resistance | ◎ | ◎◎ | ◎ |

DMTP: Dimethyl terephthalate
DMAP: Dimethyl adipate

TABLE 5-1

| Example No. | | Comp. Ex. 1 | Comp. Ex. 2 | Comp. Ex. 3 |
|---|---|---|---|---|
| Toner No. | | Toner 17 | Toner 18 | Toner 19 |
| Block copolymer B | Name | B1 | B1 | B1 |
| | Crystalline segment (a) | a1 | a1 | a1 |
| | Diol | 1,6-Hexanediol | 1,6-Hexanediol | 1,6-Hexanediol |
| | Dicarboxylic acid | Adipic acid | Adipic acid | Adipic acid |
| | Non-crystalline segment (b) | b1 | b1 | b1 |
| | Diol | Propylene glycol | Propylene glycol | Propylene glycol |
| | Dicarboxylic acid | DMTP/DMAP (90/10 by mole) | DMTP/DMAP (90/10 by mole) | DMTP/DMAP (90/10 by mole) |
| | Crystalline segment (a)/non-crystalline segment (b) | 40/60 by mole | 40/60 by mole | 40/60 by mole |
| | Melting point (° C.) | 56.5 | 56.5 | 56.5 |
| Non-linear crosslinked polyester resin C | | C-11 | C-12 | C-13 |
| Phase of probe of AFM in tapping mode | A (degree) | 70 | 70 | 70 |
| | B (degree) | 60 | 60 | 60 |
| | C (degree) | 73 | 76 | 64 |
| | C − B (degree) | 13 | 16 | 4 |
| Relaxation time in pulse NMR | t50 | 1.9 | 1.1 | 0.5 |
| | t'70 | 3 | 2 | 0.6 |
| | t130 | 22 | 20 | 7 |
| Martens' hardness at 50° C. ($N/mm^2$) | | 60 | 70 | 120 |
| First glass transition temperature (Tg1st) | | 41 | 35 | 45 |
| Second glass transition temperature (Tg2nd) | | 15 | 10 | 28 |
| Evaluation results | Lowest fixable temperature | ◎ | ◎ | X |
| | Fixable temperature range | X | X | Δ |
| | High temperature preservability | X | Δ | ○ |
| | Rub resistance | X | X | ○ |

DMTP: Dimethyl terephthalate
DMAP: Dimethyl adipate

TABLE 5-2

| Example No. | | Comp. Ex. 4 | Comp. Ex. 5 |
|---|---|---|---|
| Toner No. | | Toner 20 | Toner 21 |
| Block copolymer B | Name | B1 | Crystalline resin E1 |
| | Crystalline segment (a) | a1 | — |
| | Diol | 1,6-Hexanediol | 1,6-Hexanediol |
| | Dicarboxylic acid | Adipic acid | Adipic acid/ sebacic acid |

TABLE 5-2-continued

| Example No. | Comp. Ex. 4 | Comp. Ex. 5 |
|---|---|---|
| Non-crystalline segment (b) | b1 | — |
| Diol | Propylene glycol | — |
| Dicarboxylic acid | DMTP/DMAP (90/10 by mole) | — |

TABLE 5-2-continued

| Example No. | | Comp. Ex. 4 | Comp. Ex. 5 |
|---|---|---|---|
| | Crystalline segment (a)/non-crystalline segment (b) | 40/60 by mole | 100/0 by mole |
| | Melting point (° C.) | 56.5 | 59 |
| Non-linear crosslinked polyester resin C | | Not used | C-1 |
| Phase of probe of AFM in tapping mode | A (degree) | 70 | — |
| | B (degree) | 60 | — |
| | C (degree) | No | — |
| | C − B (degree) | No | — |
| Relaxation time in pulse | t50 | 1.5 | 2.3 |
| | t'70 | 2.7 | 5 |
| NMR | t130 | 15 | 25 |
| Martens' hardness at 50° C. ($N/mm^2$) | | 60 | 43 |
| First glass transition temperature (Tg1st) | | 44 | 40 |
| Second glass transition temperature (Tg2nd) | | 10 | 8 |
| Evaluation results | Lowest fixable temperature | Δ | ◎ |
| | Fixable temperature range | Δ | X |
| | High temperature preservability | X | X |
| | Rub resistance | Δ | X |

DMTP: Dimethyl terephthalate
DMAP: Dimethyl adipate

It is clear from the evaluation results that the toners of Examples 1-16, which include a block copolymer including a crystalline segment (a) and a non-crystalline segment (b), and a crosslinked polyester resin including an aliphatic diol component having 3 to 10 carbon atoms in an amount of 50% by mole and a crosslinked component (which is at least one of a crosslinked component of an aliphatic alcohol having three or more valences and a crosslinked component of an aliphatic acid having three or more valences) and which have a first glass transition temperature (Tg1st) of from 20° C. to 50° C. determined in a first heating process of differential scanning calorimetry (DSC), have a good combination of fixing properties (lowest fixable temperature, hot offset resistance and fixable temperature range), high temperature preservability, and rub resistance.

As described above, the molar ratio (a/b) of the crystalline segment (a) to the non-crystalline segment (b) is preferably from 10/90 to 40/60. Since the molar ratio (a/b) of the toner 9 is 60/40, the toner has slightly deteriorated rub resistance.

Although the toner 17 of Comparative Example 1, which includes a polyester resin C-11 including no crosslinked component, the toner 18 of Comparative Example 2, which includes a polyester resin C-12 including an aliphatic diol component having 12 carbon atoms which is out of the preferable range of from C3 to C10, the toner 19 of Comparative Example 3, which includes a polyester resin C-13 including an aliphatic diol component having 2 carbon atoms which is out of the preferable range of from C3 to C10, and the toner 20 of Comparative Example 4, which includes no polyester resin C, have a first glass transition temperature (Tg1st) in the preferable range of from 20° C. to 50° C., the toners 17-20 have one or more problems concerning the fixing properties (lowest fixable temperature, hot offset resistance and fixable temperature range), and the high temperature preservability.

In addition, the toners 17 and 18 have a problem concerning the rub resistance. The toner 21 of Comparative Example 5, which includes a crystalline polyester resin instead of a block copolymer B1, has problems concerning the fixing properties (lowest fixable temperature, hot offset resistance and fixable temperature range), the high temperature preservability, and the rub resistance.

As mentioned above, the toner of this disclosure has a relatively small particle diameter, and therefore the toner can produce high quality images. In addition, the toner of this disclosure has a good combination of low temperature fixability (i.e., hot offset resistance and fixing energy saving) and high temperature preservability (i.e., preservability under high temperature conditions in storage in warehouses and transportation). Therefore, the toner of this disclosure can fulfill the recent high-level needs of users. By using a developer including the toner of this disclosure, high quality images can be produced over a long period of time even at a high image forming speed.

Additional modifications and variations of the present invention are possible in light of the above teachings. It is therefore to be understood that within the scope of the appended claims the invention may be practiced other than as specifically described herein.

What is claimed is:

1. A toner, comprising:

a crosslinked polyester resin; comprising a diol component comprising an aliphatic diol component having 3 to 10 carbon atoms in an amount of not less than 50% by mole, and a crosslinked component, which is at least one of a crosslinked component of an aliphatic alcohol having three or more valences and a crosslinked component of an aliphatic acid having three or more valences;

a block copolymer comprising a crystalline polyester segment (a) and a non-crystalline polyester segment (b); and a crystalline polyester resin comprising a diol component comprising a linear aliphatic diol component having 2 to 12 carbon atoms, and a dicarboxylic acid component comprising a linear aliphatic dicarboxylic having 4 to 12 carbon atoms, wherein the toner has a first glass transition temperature (Tg1st) of from 20° C. to 42° C., wherein the first glass transition temperature (Tg1st) is determined by subjecting the toner to differential scanning calorimetry (DSC) and measuring a glass transition temperature in a first temperature rising process in the differential scanning calorimetry (DSC).

2. The toner according to Claim 1, wherein the crosslinked component of the crosslinked polyester is at least one of a crosslinked component of an aliphatic alcohol having three or four valences and a crosslinked component of an aliphatic acid having three or four valences.

3. The toner according to claim 1, wherein the diol component of the crosslinked polyester has an odd-numbered carbon atoms in a main chain thereof, and has an alkyl group in a side chain thereof.

4. The toner according to claim 1, wherein the crosslinked polyester resin comprises a crosslinked polyester resin obtained by reacting a compound having a group comprising an active hydrogen atom with a polymer reactive with the compound.

5. The toner according to claim 1, wherein the toner has a second glass transition temperature (Tg2nd) of from 0° C. to 30° C., which is determined by subjecting the toner to the differential scanning calorimetry (DSC) and measuring a glass transition temperature in a second temperature rising process in the differential scanning calorimetry (DSC), and wherein the first glass transition temperature (Tg1st) is higher than the second glass transition temperature (Tg2nd).

6. The toner according to claim 1, wherein a molar ratio (a/b) of the crystalline polyester segment (a) to the non-crystalline polyester segment (b) is from 10/90 to 40/60.

7. The toner according to claim 1, wherein the toner has spin-spin relaxation time properties such that a spin-spin relaxation time at 50° C. (t50) measured by a solid echo method using pulse nuclear magnetic resonance (NMR) is not greater than 1.0 ms, a spin-spin relaxation time at 130° C. (t130) measured by heating the toner from 50° C. to 130° C. in the solid echo method is not less than 10 ms, and a spin-spin relaxation time at 70° C. (t'70) measured by cooling the toner from 130° C. to 70° C. in the solid echo method is not greater than 3.0 ms.

8. The toner according to claim 1, wherein the toner satisfies relationships (2) and (3 ):

$$Ta \geq Tc > Tb \quad (2), \text{ and}$$

$$Tc - Tb \geq 5 \quad (3),$$

wherein:

Tc represents a phase in units of degree of a probe of an atomic force microscope (AFM) in a tapping mode when the crosslinked polyester resin is observed;

Tb represents a phase in units of degree of the probe of the atomic force microscope (AFM) when the non-crystalline polyester segment (b) of the block copolymer is observed; and Ta represents a phase in units of degree of the probe of the atomic force microscope (AFM) when the crystalline polyester segment (a) of the block copolymer is observed, and wherein conditions of the tapping mode of the atomic force microscope (AFM) are that a cantilever having a Si probe is used, a resonance frequency of the Si probe is 300 kHz, and a spring constant of the Si probe is 42N/m.

9. A developer comprising the toner according to claim 1, and a carrier.

10. An image forming apparatus, comprising:

an image carrier bearing an electrostatic latent image on a surface thereof; and a developing device to develop the electrostatic latent image using the toner according to claim 1 to form a visible image on the surface of the image carrier.

11. The toner according to claim 1, wherein the first glass transition temperature (Tg1st) of the toner is from 20° C. to 40° C.

12. The toner according to claim 5, wherein the second glass transition temperature (Tg2nd) of the toner is from 0° C. to 18° C.

13. A toner, consisting of, based on 100 parts of the toner:

from 5 to 25 parts of a crosslinked polyester resin comprising a diol component comprising an aliphatic diol component having 3 to 10 carbon atoms in an amount of not less than 50% by mole, and a crosslinked component, which is at least one of a crosslinked component of an aliphatic alcohol having three or more valences and a crosslinked component of an aliphatic acid having three or more valences;

a block copolymer comprising a crystalline polyester segment (a) and a non-crystalline polyester segment (b);

optionally from 3 to 20 parts of a crystalline polyester resin;

optionally from 2 to 10 parts of a release agent;

optionally from 3 to 10 parts of a colorant;

optionally from 0.1 to 10 parts of a charge controlling agent; and optionally from 0.1 to 5 parts of an external additive, wherein the toner has a first glass transition temperature (Tg1st) of from 20° C. to 50° C., wherein the first glass transition temperature (Tg1st) is determined by subjecting the toner to differential scanning calorimetry (DSC) and measuring a glass transition temperature in a first temperature rising process in the differential scanning calorimetry (DSC).

* * * * *